United States Patent [19]

Nishijima et al.

[11] Patent Number: 4,752,561

[45] Date of Patent: Jun. 21, 1988

[54] LIGHT-SENSITIVE SILVER HALIDE PHOTOGRAPHIC MATERIAL INCORPORATING METAL COMPLEX WITH HIGH QUENCHING CONSTANT AND AN OIL SOLUBLE DYE

[75] Inventors: Toyoki Nishijima; Kaoru Onodera, both of Odawara, Japan

[73] Assignee: Konishiroku Photo Industry Co., Ltd., Tokyo, Japan

[21] Appl. No.: 861,311

[22] Filed: May 9, 1986

[30] Foreign Application Priority Data

May 17, 1985 [JP] Japan ..... 60-104994
May 20, 1985 [JP] Japan ..... 60-108053

[51] Int. Cl.[4] ..... G03C 1/08; G03C 7/26; G03C 7/32

[52] U.S. Cl. ..... 430/551; 430/542; 430/554; 430/558; 430/559; 430/561

[58] Field of Search ..... 430/551, 554, 558, 559, 430/561, 542

[56] References Cited

U.S. PATENT DOCUMENTS 4,239,843 12/1980 Hara et al. ..... 430/551 X
4,242,430 12/1980 Hara et al. ..... 430/551 X
4,246,330 1/1981 Hara et al. ..... 430/551 X
4,343,886 8/1982 Nakamura et al. ..... 430/551 X
4,346,165 8/1982 Sawada et al. ..... 430/551 X
4,540,653 9/1985 Nishijima et al. ..... 430/551 X
4,590,153 5/1986 Kawagishi et al. ..... 430/551

*Primary Examiner*—Mukund J. Shah
*Attorney, Agent, or Firm*—Frishauf, Holtz, Goodman & Woodward

[57] ABSTRACT

There is disclosed a light-sensitive silver halide photographic material having a silver halide emulsion layer containing a coupler on a support, comprising at least one of the metal complexes having a quenching constant of singlet oxygen of $3\times10^7$ $M^{-1}.sec^{-1}$ or higher and at least one of oil-soluble dyes, and which may further comprise at least one of the magenta couplers represented by the formula (I) shown below:

(I)

wherein Z represents a group of non-metal atoms necessary for formation of a nitrogen-containing heterocyclic ring, and the ring formed by the Z may have substituents; X represents a hydrogen atom or a substituent eliminable through the reaction with the oxidized product of a color developing agent; and R represents a hydrogen atom or a substituent.

11 Claims, No Drawings

LIGHT-SENSITIVE SILVER HALIDE PHOTOGRAPHIC MATERIAL INCORPORATING METAL COMPLEX WITH HIGH QUENCHING CONSTANT AND AN OIL SOLUBLE DYE

BACKGROUND OF THE INVENTION

This invention relates to a light-sensitive silver halide photographic material, more particularly to a light-sensitive silver halide color photographic material which is excellent in fastness to light, and further excellent in sharpness without impairing whiteness of the white portion.

As a method for forming a dye image by use of a light-sensitive silver halide color photographic material, there may be mentioned the method in which the dye image is formed by the reaction between a coupler for photography and the oxidized product of a color developing agent. As the couplers for photography for effecting conventional color reproduction, respective couplers of magenta, yellow and cyan have been employed and, as the color developing agent, aromatic primary amine type color developing agents have been used, respectively. Through the reaction of the respective couplers of magenta and yellow with the oxidized product of an aromatic primary amine type color developing agent, dyes such as azomethine dye, etc., are formed, while through the reaction of a cyan coupler with an aromatic primary amine type color developing agent, dyes such as indoaniline dye, etc., are formed.

Among them, for formation of magenta color images, 5-pyrazolone, cyanoacetophenone, indazolone, pyrazolobenzimidazole, pyrazolotriazole type couplers are used.

Most of the magenta color image forming couplers practically used in the prior art were 5-pyrazolone type couplers. The color image formed from a 5-pyrazolone type coupler is excellent in fastness to light or heat but the tone of this dye is not satisfactory and unnecessary absorption having yellow components exist at around 430 nm. Also, due to the broad absorption spectrum of visible light at around 550 nm, color turbidity is caused to give a photographic image which lacks sharpness.

As the coupler having no such unnecessary absorption, 1H-pyrazolo[3,2-c]-s-triazole type couplers, 1H-imidazo[1,2-b]-pyrazole type couplers, 1H-b pyrazolo[1,5-b-]pyrazole type couplers or 1H-b pyrazolo[1,5-d]tetrazole type couplers as disclosed in U.S. Pat. No. 3,725,067, Japanese Provisional Patent Publication Nos. 162548/1984 and 171956/1984 are particularly excellent.

However, the magenta dye image formed from these couplers is markedly low in fastness to light. When these couplers are used for light-sensitive materials, particularly for light-sensitive materials suitable for direct viewing, the essential necessary conditions of photographic materials to record and store images will be impaired, thus involving a drawback in practical application.

For improvement of fastness of these color images to light, a number of methods have been proposed in the prior art. As the typical methods, there have been practiced the method in which the dye itself formed from the coupler is made fast and the method in which fastness is improved by addition of various fading preventives. The method of adding a fading preventive is an effective fading preventing means and is frequently used.

As the compound for improving fastness of a dye image to light, there may be included, for example, hydroquinone derivatives disclosed in U.S. Pat. Nos. 2,360,290, 2,418,613, 2,675,314, 2,701,197; derivatives of couromane or coumarane disclosed in U.S. Pat. Nos. 3,432,300, 3,573,050, 3,574,627, 3,764,337, 3,574,626, 3,698,909, 4,015,990; p-alkoxyphenols disclosed in U.S. Pat. Nos. 3,457,079 and 3,069,262; Japanese Patent Publication No. 13496/1968; etc.

However, these compounds are not satisfactory in their effects. On the other hand, light fastness improvement techniques with metal complexes are disclosed in Japanese Provisional Patent Publication Nos. 99340/1981, 168652/1981 and 51834/1985. These metal complexes are effective as the agent for imparting light fastness, but the metal complex itself is greatly colored, thus having the drawback that the white portion of the photographic image appears tinted with yellow, yellowish green or green.

Accordingly, it has been desired to improve light fastness by use of a metal complex in combination and also improve whiteness of the white portion. As improvement of whiteness, there have been employed in the prior art the methods which can be broadly classified into two categories. One category is the method in which whiteness of the original paper support itself is improved as disclosed in Japanese Provisional Patent Publication No. 19021/1978, and the other is the method in which an oil-soluble dye is used as disclosed in Japanese Provisional Patent Publication No. 93150/1980. Improvement of whiteness of the original support paper itself is determined depending on the properties of the titanium oxide contained in the original paper and therefore it is difficult to improve whiteness to a great extent.

Improvement of whiteness with an oil-soluble dye can be easily used in a light-sensitive silver halide photographic material and the extent of the improvement of whiteness is effectively greater.

Accordingly, the present inventors have made various investigations, and consequently found surprisingly that by using in combination at least one of a specific class of metal complexes and at least one of oil-soluble dyes, and further at least one of a specific class of magenta couplers, light fastness of color image can be improved without impairing whiteness of the white portion of photographic image, and further sharpness of the dye image can be improved.

Particularly, the effects of improvement of light fastness and sharpness for the color image obtained from the specific class of magenta couplers used in the above combination of the present invention surpass greatly the improved effect expected from the combined use with the couplers of the prior art, and this could not be expected at all from any of the above prior art techniques.

SUMMARY OF THE INVENTION

Accordingly, a first object of the present invention is to provide a light-sensitive silver halide photographic material which is excellent in light fastness of the dye image and also excellent in sharpness without impairing whiteness of the white portion.

A second object of the present invention is to provide a light-sensitive silver halide photographic material which is excellent in color reproduction of magenta dye image and also improved in color light fastness of magenta dye image.

The above objects of the present invention can be accomplished by a light-sensitive silver halide photographic material having a silver halide emulsion layer containing a coupler on a support, comprising at least one of the metal complexes having quenching constant of singlet oxygen of $3\times10^7M^{-1}.sec^{-1}$ or higher and at least one of oil-soluble dyes.

Also, the above objects of the present invention can be accomplished by the above light-sensitive silver halide photographic material further comprising at least one of the magenta couplers represented by the formula (I) shown below:

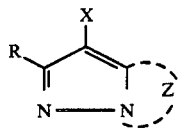

(I)

wherein

Z represents a group of non-metal atoms necessary for formation of a nitrogen-containing heterocyclic ring, and the ring formed by said Z may have substituents;

X represents a hydrogen atom or a substituent eliminable through the reaction with the oxidized product of a color developing agent;

and R represents a hydrogen atom or a substituent.

DESCRIPTION OF THE PREFERRED EMBODIMENTS

The metal complex according to the present invention is a metal complex having a quenching constant of singlet oxygen of $3\times10^7M^{-1}.sec^{-1}$ or higher.

The above quenching constant of singlet oxygen is determined according to the method for measuring photobleaching of rubrene described in Journal of Physical Chemistry 83, 591 (1979), etc.

More specifically, a chloroform solution of rubrene and a chloroform solution of a mixture of a rubrene and the compound to be measured are irradiated with light of equal energy.

When the initial concentration of rubrene is defined as [R], the concentration of the compound to be measured as [Q], the concentration of rubrene in the solution rubrene alone after the test as $[R]_F^0$ and the concentration of rublene in the mixed solution of rubrene and the compound to be measured after the test as $[R]_F^Q$, then the quenching constant of singlet oxygen (kq) is calculated by the following formula:

$$kq = \frac{5.3\times10^7([R]_F^Q - [R]_F^0) + 1.7\times10^4\ln([R]_F^Q/[R]_F^0)}{[Q]\ln([R]/[R]_F^Q)}$$

The metal complex according to the present invention has the quenching constant of singlet oxygen as defined by the above formula of $3\times10^7M^{-1}.sec^{-1}$ or higher, but it is preferably a compound having a quenching constant of $1\times10^8M^{-1}.sec^{-1}$ or higher. The central atom of the metal complex should preferably be a transition metal, more preferably each metal atom of Fe, Co, Ni, Pd, Pt, particularly preferably Ni metal atom.

The metal complex having a quenching constant of singlet oxygen of $3\times10^7M^{-1}.sec^{-1}$ according to the present invention include preferably those represented by the formulae (II) to (V) shown below.

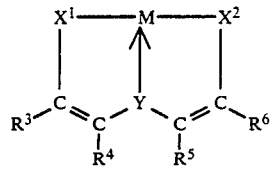

(II)

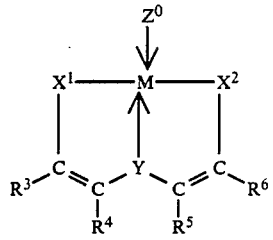

(III)

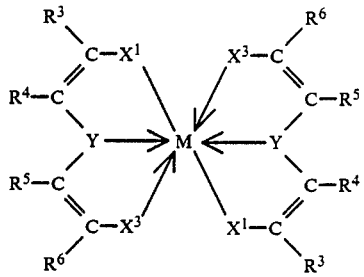

IV)

In the formulae (II), (III) and (IV), M represents a metal atom.

$X^1$ and $X^2$ each represent an oxygen atom, a sulfur atom or —$NR^7$— ($R^7$ represents a hydrogen atom, an alkyl group, an aryl group or a hydroxyl group). $X^3$ represents a hydroxy group or a mercapto group. Y represents an oxygen atom or a sulfur atom. $R^3$, $R^4$, $R^5$ and $R^6$ each represent a hydrogen atom, a halogen atom, a cyano group; or an alkyl group, an aryl group, a cycloalkyl group or a heterocyclic group each of which is bonded directly or through a divalent linking group to the carbon atom. At least one of the combinations of $R^3$ and $R^4$, and $R^5$ and $R^6$ may be linked together to form a 5- or 6-membered ring together with the carbon atom bonded thereto.

$Z^0$ represents a compound coordinatable with M or a residue thereof.

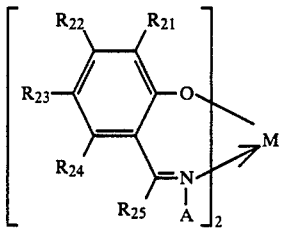

(V)

In the formula, $R_{21}$, $R_{22}$, $R_{23}$ and $R_{24}$ each represent a hydrogen atom, a halogen atom, a hydroxy group, a cyano group; or an alkyl group, an aryl group, a cycloalkyl group or a heterocyclic group each of which is bonded directly or indirectly through a divalent linking group to the carbon atom on the benzene ring. Also, $R_{21}$ and $R_{22}$, $R_{22}$ and $R_{23}$ or $R_{23}$ and $R_{24}$ may be bonded together to form a 6-membered ring.

$R_{25}$ represents a hydrogen atom, an alkyl group or an aryl group. A represents a hydrogen atom, an alkyl group, an aryl group or a hydroxy group. M represents a metal atom.

In the above formulae (II), (III) and (IV), $X^1$ and $X^2$ may be mutually the same or different, and each represents an oxygen atom, a sulfur atom or —$NR^7$— ($R^7$ is a hydrogen atom, an alkyl group [e.g. a methyl group, an ethyl group, an n-propyl group, an i-propyl group, an n-butyl group, a t-butyl group, an i-butyl group, a benzyl group and the like], an aryl group [e.g. a phenyl group, a tolyl group, a naphthyl group and the like] or a hydroxyl group), preferably an oxygen atom or a sulfur atom, more preferably an oxygen atom.

$X^3$ in the formula (IX) represents a hydroxyl group or a mercapto group, preferably a hydroxyl group.

Y in the formulae (II), (III) and (IV) (in the formula (IV), Y existing in number of two may be mutually the same or different) represents an oxygen atom or a sulfur atom, preferably a sulfur atom.

$R^3$, $R^4$, $R^5$ and $R^6$ in the formulae (II), (III) and (IV) may be mutually the same or different, and each represents a hydrogen atom, a halogen atom (fluorine, chlorine, bromine, iodine), a cyano group; an alkyl group (e.g. a methyl group, an ethyl group, a propyl group, a butyl group, a hexyl group, an octyl group, a dodecyl group, a hexadecyl group and the like; these alkyl groups may be either straight or branched), an aryl group (e.g. a phenyl group, a naphthyl group and the like), a cycloalkyl group (e.g. a cyclopentyl group, a cyclohexyl group) or a heterocyclic group (e.g. a pyridyl group, an imidazolyl group, a furyl group, a thienyl group, a pyrrolyl group, a pyrrolydinyl group, a quinolyl group, a morpholinyl group and the like) which is bonded to the carbon atom directly or through a divalent linking group [e.g. —O—, —S—, —NH—, —NR-$^{7'}$—, {$R^{7'}$ represents a monovalent group such as a hydroxyl group, an alkyl group (e.g. a methyl group, an ethyl group, an n-propyl group, an i-propyl group, an n-butyl group, a t-butyl group, an i-butyl group and the like), an aryl group (such as a phenyl group, a tolyl group, a naphthyl group and the like), etc.}, —OCO—, —CO—, —NHCO—, —CONH—, —COO—, —$SO_2$NH—, —NH$SO_2$—, —$SO_2$—, etc.]. Among them, examples of the group formed by the alkyl group, the aryl group, the cycloalkyl group or the heterocyclic group bonded through a divalent linking group to the carbon atom together with said divalent linking group include alkoxy groups (straight or branched alkyloxy groups such as methoxy group, an ethoxy group, an n-butyloxy group, an octyloxy group and the like), alkoxycarbonyl groups (straight or branched alkyloxycarbonyl groups such as a methoxycarbonyl group, an ethoxycarbonyl group, an n-hexadecyloxycarbonyl group and the like), alkylcarbonyl groups (straight or branched alkylcarbonyl group such as an acetyl group, a valeryl group, a stearolyl group and the like), aryl carbonyl groups (e.g. a benzoyl group and the like), alkylamino groups (straight or branched alkylamino groups such as an N-n-butylamino group, an N,N-di-n-butylamino group, an N,N-di-n-octylamino group and the like), alkylcarbamoyl groups (straight or branched alkylcarbamoyl groups such as an n-butylcarbamoyl group, an n-dodecylcarbamoyl group and the like), alkylsulfamoyl groups (straight or branched alkylsulfamoyl groups such as an n-butylsulfamoyl group, an n-dodecylsulfamoyl group and the like), alkylacylamino groups (straight or branched alkylcarbonylamino group such as an acetylamino group, a palmitoylamino group and the like), aryloxy groups (e.g. a phenoxy group, a naphthoxy group and the like), aryloxycarbonyl groups (e.g. a phenoxycarbonyl group, a naphthoxycarbonyl group and the like), arylamino groups (e.g. an N-phenylamino group, an N-phenyl-N-methylamino group and the like), arylcarbamoyl groups (e.g. a phenylcarbamoyl group and the like), arylsulfamoyl groups (e.g. a phenylsulfamoyl group and the like), arylacylamino groups (e.g. a benzoylamino group and the like) and so on.

Also, in the formulae (II), (III) and (IV), at least one of the combinations of $R^3$ and $R^4$ and of $R^5$ and $R^6$ may be linked together to form a 5- or 6-membered ring together with the carbon atoms bonded thereto. In this case, examples of the 5- or 6-membered ring formed by mutual linking of at least one of the combinations of $R^3$ and $R^4$ and of $R^5$ and $R^6$ together with the carbon atom include hydrocarbon rings having at least one unsaturation such as cyclopentene ring, cyclohexene ring, benzene ring (provided that this benzene ring is inclusive of fused benzene rings such as naphthalene ring, anthracene ring) and heterocyclic rings (e.g. nitrogen-containing 5- or 6-membered heterocyclic ring). When these 5- or 6-membered rings have substituents, examples of the substituents include halogen atoms (fluorine, chlorine, bromine, iodine), a cyano group, an alkyl group (e.g. straight or branched alkyl groups having 1 to 20 carbon atoms such as a methyl group, an ethyl group, an n-propyl group, an n-butyl group, an n-octyl group, a t-octyl group, an n-hexadecyl and the like), an aryl group (e.g. a phenyl group, a naphthyl group and the like), an alkoxy group (straight or branched alkyloxy groups such as a methoxy group, an n-butoxy group, a t-butoxy group and the like), an aryloxy group (e.g. a phenoxy group and the like), an alkoxycarbonyl group (e.g. straight or branched alkyloxycarbonyl groups such as an n-pentyloxycarbonyl group, a t-pentyloxycarbonyl group, an n-octyloxycarbonyl group, a t-octyloxycarbonyl group and the like), an aryloxycarbonyl group (e.g. a phenoxycarbonyl group and the like), an acyl group (e.g. straight or branched alkylcarbonyl groups such as an acetyl group, a stearoyl group and the like), an acylamino group (e.g. straight or branched alkylcarbonylamino groups such as an acetamide group and the like, an arylcarbonylamino group such as a benzoylamino group and the like), an arylamino group (e.g. an N-phenylamino group and the like), an alkylamino group (straight or branched alkylamino groups such as an N-n-butylamino group, an N,N-diethylamino group and the like), a carbamoyl group (straight or branched alkylcarbamoyl groups such as an n-butylcarbamoyl group and the like), a sulfamoyl group (e.g. straight or branched alkylsulfamoyl groups such as an N,N-di-n-butylsulfamoyl group, an N-n-dodecylsulfamoyl group and the like), a sulfonamide group (straight or branched alkylsulfonylamino groups such as a methylsulfonylamino group and the like; an arylsulfonylamino groups such as a phenylsulfonylamino group and the like), a sulfonyl group (e.g. straight or branched alkylsulfonyl groups such as a mesyl group and the like; arylsulfonyl groups such as a tosyl group and the like), a cycloalkyl group (e.g. a cyclohexyl group and the like) and so on.

The formulae (II), (III) and (IV) may be preferably selected from the case when $R^3$, $R^4$ and $R^6$ represent alkyl groups, aryl groups or at least one of the combinations of $R^3$ and $R^4$ and of $R^5$ and $R^6$ are mutually linked together to form a 5- or 6-membered ring together with the carbon atom bonded thereto, more preferably the case when each of the combinations of $R^3$ and $R^4$ and $R^5$ and $R^6$ are linked mutually to form a 6-membered ring, particularly preferably benzene ring together with the carbon atom bonded thereto.

M in the formulae (II), (III) and (IV) represents a metal atom, preferably a transition metal atom, more preferably a nickel atom, a copper atom, an iron atom, a cobalt atom, a palladium atom and a platinum atom, most preferably a nickel atom.

The compound coordinatable with M represented by $Z^0$ in the formula (III) may preferably an alkylamine having a straight or branched alkyl group, particularly preferably a dialkylamine, trialkylamine in which the total carbon atoms in the alkyl group are 2 to 36, further 3 to 24. Specific examples of these alkylamines include monoalkylamines such as butylamine, octylamine (e.g. t-octylamine), dodecylamine (e.g. n-dodecylamine), hexadecylamine, octanolamine and the like; dialkylamines such as diethylamine, dibutylamine, dioctylamine, didodecylamine, diethanolamine, dibutanolamine and the like; and trialkylamines such as triethylamine, tributylamine, trioctylamine, triethanolamine, tributanolamine, trioctanolamine and the like.

More preferably, the metal complexes according to the present invention shown by the formulae (II), (III) and (IV) are metal complexes shown by the formulae (IIa), (IIIa) and (IVa) shown below.

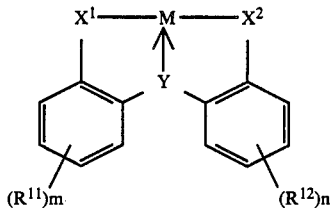

(IIa)

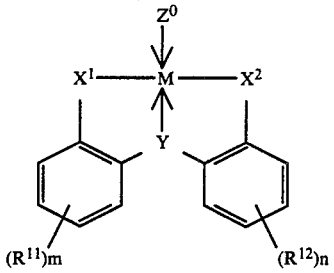

(IIIa)

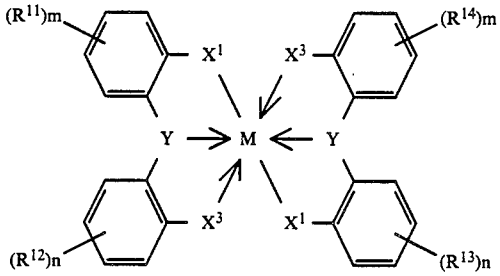

(IVa)

In the formulae (IIa), (IIIa) and (IVa), M, $X^1$, $X^2$, $X^3$, Y and $Z^0$ have the same meanings as defined above respectively.

In the formulae (IIa), (IIIa) and (IVa), $R^{11}$, $R^{12}$, $R^{13}$ and $R^{14}$ each represent an alkyl group (straight or branched alkyl groups having 1 to 20 carbon atoms such as a methyl group, an ethyl group, an n-propyl group, an n-butyl group, an n-octyl group, a t-octyl group, an n-hexadecyl group and the like), an aryl group (e.g. a phenyl group, a naphthyl group and the like), an alkoxy group (e.g. straight or branched alkyloxy groups such as a methoxy group, an n-butoxy group, a t-butoxy group and the like), an aryloxy group (e.g. a phenoxy group and the like), an alkoxycarbonyl group (straight or branched alkyloxycarbonyl groups such as an n-pentyloxycarbonyl group, a t-pentyloxycarbonyl group, an n-octyloxycarbonyl group, a t-octyloxycarbonyl group and the like), an aryloxycarbonyl group (e.g. a phenoxycarbonyl group and the like), an acyl group (e.g. straight or branched alkylcarbonyl groups such as an acetyl group, a stearoyl group and the like), an acylamino group (a straight or branched alkylcarbonylamino groups such as an acetamide group and the like), an arylcarbonylamino group (e.g. a benzoylamino group and the like), an arylamino group (e.g. an N-phenylamino group and the like), an alkylamino group (straight or branched alkylamino groups such as an N-n-butylamino group, an N,N-dietylamino group and the like), a carbamoyl group (e.g. straight or branched alkylcarbamoyl groups such as an n-butylcarbamoyl group and the like), a sulfamoyl group (e.g. straight or branched alkylsulfamoyl groups such as an N,N-di-n-butylsulfamoyl group, an N-n-dodecylsulfamoyl group and the like), a sulfonamide group (e.g. straight or branched alkylsulfonylamino groups such as a methylsulfonylamino group and the like; arylsulfonylamino groups such as a phenylsulfonylamino group and the like), a sulfonyl group (e.g. straight or branched alkylsulfonyl groups such as a mesyl group; arylsulfonyl groups such as a tosyl group and the like) or a cycloalkyl group (e.g. a cyclohexyl group and the like) and so on. Each of m and n represents an integer of 0 to 4.

Of the compounds represented by the formulae (IIa), (IIIa) and (IVa), more preferable compounds are those represented by the formula (IIIa). Of the compounds represented by the formula (IIIa), the most preferable is the compound represented by the formula (IIIb).

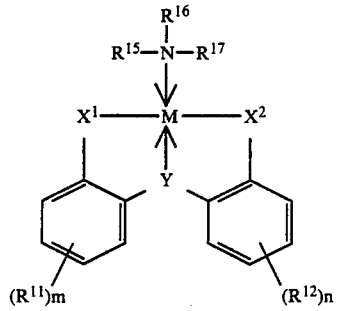

(IIIb)

In the formula (IIIb), M, $X^1$, $X^2$, Y, $R^{11}$, $R^{12}$, m and n have the same meanings as defined above, $R^{15}$, $R^{16}$ and $R^{17}$ represent a hydrogen atom, an alkyl group (e.g. a butyl group, an octyl group, a stearyl group and the like) or an aryl group (e.g. a phenyl group, a naphtyl group and the like), provided that at least two of $R^{15}$, $R^{16}$ and $R^{17}$ represent an alkyl group or an aryl group.

In the above formula (V), the halogen atom represented by $R_{21}$, $R_{22}$, $R_{23}$ and $R_{24}$ is inclusive of a fluorine atom, a chlorine atom, a bromine atom and an iodine atom.

The alkyl group represented by $R_{21}$, $R_{22}$, $R_{23}$ and $R_{24}$ may preferably be an alkyl group having 1 to 19 carbon atoms, may be either straight or branched alkyl groups, and may also have substituents.

The aryl group represented by $R_{21}$, $R_{22}$, $R_{23}$ and $R_{24}$ may preferably be an aryl group having 6 to 14 carbon atoms and may also have substituents.

The heterocyclic group represented by $R_{21}$, $R_{22}$, $R_{23}$ and $R_{24}$ may preferably a 5- or 6-membered ring and may also have substituents.

The cycloalkyl group represented by $R_{21}$, $R_{22}$, $R_{23}$ and $R_{24}$ may preferably be a 5- or 6-membered cyclic group and may also have substituents.

The 6-membered ring formed by mutual bonding between $R_{21}$ and $R_{22}$ may include, for example,

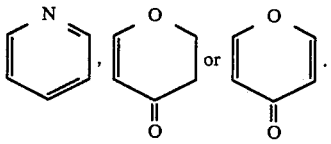

The 6-membered ring formed by mutual bonding between $R_{22}$ and $R_{23}$ or between $R_{23}$ and $R_{24}$ may preferably a benzene ring, and this benzene ring may also have substituents or it may also be bonded.

Examples of the alkyl group represented by $R_{21}$, $R_{22}$, $R_{23}$ and $R_{24}$ include a methyl group, an ethyl group, a propyl group, a butyl group, a t-butyl group, a hexyl group, an octyl group, a decyl group, a dodecyl group, a tetradecyl group, a hexadecyl group, an octadecyl group and the like.

The aryl group represented by $R_{21}$, $R_{22}$, $R_{23}$ and $R_{24}$ may be, for example, a phenyl group, a naphthyl group and the like.

The heterocyclic group represented by $R_{21}$, $R_{22}$, $R_{23}$ and $R_{24}$ may preferably be a 5- to 6-membered heterocyclic group containing at least one of a nitrogen atom, an oxygen atom or a sulfur atom in the ring, including, for example, a furyl group, a hydrofuryl group, a thienyl group, a pyrrolyl group, a pyrrolidyl group, a pyridyl group, an imidazolyl group, a pyrazolyl group, a quinolyl group, an indolyl group, an oxazolyl group, a thiazolyl group and the like.

The cycloalkyl group represented by $R_{21}$, $R_{22}$, $R_{23}$ and $R_{24}$ may include, for example, a cyclopentyl group, a cyclohexyl group, a cyclohexyl group, a cyclohexadienyl group and the like.

The 6-membered ring formed by mutual bonding of $R_{21}$, $R_{22}$,$R_{23}$ and $R_{24}$ may include, for example, a benzene ring, a naphthalene ring, an isobenzothiophene ring, an isobenzofuran ring, an isoindone ring and the like.

The alkyl group, cycloalkyl group, aryl group or heterocyclic group represented by the above $R_{21}$, $R_{22}$, $R_{23}$ and $R_{24}$ may be bonded to the carbon atom on the benzene ring through a divalent linking group such as an oxy (—O—) group, a thio (—S—) group, an amino group, an oxycarbonyl group, a carbonyl group, a carbamoyl group, a sulfamoyl group, a carbonylamino group, a sulfonylamino group, a sulfonyl group or a carbonyloxy group and among them some preferable groups are included.

Examples of the alkyl group represented by $R_{21}$, $R_{22}$, $R_{23}$ and $R_{24}$ bonded to the carbon atom on the benzene ring through the above divalent linking group include alkoxy groups (e.g. a methoxy group, an ethoxy group, a butoxy group, a propoxy group, a 2-ethylhexyloxy group, an n-decyloxy group, an n-dodecyloxy group or an n-hexadecyloxy group), alkoxycarbonyl groups (e.g. a methoxycarbonyl group, an ethoxylcarbonyl group, a butoxycarbonyl group, an n-decyloxycarbonyl group or an n-hexadecyloxycarbonyl group), acyl groups (e.g. an acetyl group, a valeryl group, a stearoyl group, a benzoyl group or a toluoyl group), acyloxy groups (e.g. an acetoxy group or a hexadecylcarbonyloxy group), alkylamino groups (e.g. an n-butylamino group, an N,N-diethylamino group or an N,N-didecylamino group), alkylcarbamoyl groups (e.g. a butylcarbamoyl group, an N,N-diethylcarbamoyl group or an n-dodecylcarbamoyl group), alkylsulfamoyl groups (e.g. a butylsulfamoyl group, an N,N-diethylsulfamoyl group or an n-dodecylsulfamoyl group), sulfonylamino groups (e.g. a methylsulfonylamino group or a butylsulfonylamino group), sulfonyl groups (e.g. a mesyl group or an ethanesulfonyl group) or acylamino groups (e.g. an acetylamino group, a valerylamino group, a palmitoylamino group, a benzoylamino group or a toluoylamino group).

Examples of the cycloalkyl group represented by $R_{21}$, $R_{22}$, $R_{23}$ and $R_{24}$ bonded to the carbon atom on the ring through the above divalent linking group include a cyclohexyloxy group, a cyclohexylcarbonyl group, a cyclohexyloxycarbonyl group, a cyclohexylamino group, a cyclohexenylcarbonyl group or a cyclohexenyloxy group.

Examples of the aryl group represented by $R_{21}$, $R_{22}$, $R_{23}$ and $R_{24}$ bonded to the carbon atom on the ring through the above divalent linking group include aryloxy groups (e.g. a phenoxy group or a naphthoxy group), aryloxycarbonyl groups (e.g. a phenoxycarbonyl group or a naphthoxycarbonyl group), acyl groups (e.g. a benzoyl group or a naphthoyl group), anilino groups (e.g. a phenylamino group, an N-methylanilino group or an N-acetylanilino group), acyloxy groups (e.g. a benzoyloxy group or a toluoyloxy group), arylcarbamoyl groups (e.g. a phenylcarbamoyl group), arylsulfamoyl groups (e.g. a phenylsulfamoyl group), arylsulfonylamino groups (e.g. a phenylsulfonylamino group, a p-tolylsulfonylamino group), arylsulfonyl groups (e.g. a benzenesulfonyl group, a tosyl group) or acylamino groups (e.g. a benzoylamino group).

The alkyl group, aryl group, heterocyclic group, cycloalkyl group represented by the above $R_{21}$, $R_{22}$, $R_{23}$ and $R_{24}$ or the 6-membered ring formed by mutual bonding of $R_{21}$ and $R_{22}$, $R_{22}$ and $R_{23}$ or $R_{23}$ and $R_{24}$ may be substituted with halogen atoms (e.g. a chlorine atom, a bromine atom or a fluorine atom), or groups such as a cyano group, an alkyl group (e.g. a methyl group, an ethyl group, an i-propyl group, a butyl group, a hexyl group, an octyl group, a decyl group, a dodecyl group, a tetradecyl group, a hexadecyl group, a heptadecyl group, an octadecyl group or a methoxyethoxyethyl group), an aryl group (e.g. a phenyl group, a tolyl group, a naphthyl group, a chlorophenyl group, a methoxyphenyl group or an acetylphenyl group), an alkoxy group (e.g. a methoxy group, an ethoxy group, a butoxy group, a propoxy group or a methoxyethoxy group), an aryloxy group (e.g. a phenoxy group, a tolyloxy group, a naphthoxy group or a methoxyphenoxy group), an alkoxycarbonyl group (e.g. a methoxycarbonyl group, a butoxycarbonyl group or a phenoxymethoxycarbonyl group), an aryloxycarbonyl group (e.g. a phenoxycarbonyl group, a tolyloxycarbonyl group or a methoxyphenoxylcarbonyl group), an acyl group (e.g. a formyl group, an acetyl group, a valeryl group, a stearoyl group, a benzoyl group, a toluoyl group, a naphthoyl group or a p-methoxybenzoyl group), an acyloxy group (e.g. an acetoxy group or an acyloxy group), an acylamino group (e.g. an acetamide group, a benzamide group or a methoxyacetamide group), an anilino group (e.g. a phenylamino group, an N-methylanilino group, an N-phenylanilino group or an N-acetylanilino group), an alkylamino group (e.g. an n-butylamino group, an N,N-diethylamino group, a 4-methoxy-n-butylamino group), an carbamoyl group (e.g. an n-butylcarbamoyl group, an N,N-diethylcarbamoyl group, an n-butylsulfamoyl group, an N,N-diethylsulfamoyl group, an n-dodecylsulfamoyl group or an N-(4-methoxy-n-butyl)-sulfamoyl group), an sulfonylamino group (e.g. a methylsulfonylamino group, a phenylsulfonylamino group or a methoxymethylsulfonylamino group), or a sulfonyl group (e.g. a mesyl group, a tosyl group or a methoxymethanesulfonyl group), etc.

The alkyl group represented by $R_{25}$ and A may have also substituents, and may be either straight or branched. These alkyl groups are preferably alkyl groups having 1 to 20 carbon atoms except for the carbon atoms at the substituent moiety, including a methyl group, an ethyl group, a propyl group, a butyl group, a hexyl group, an octyl group, a decyl group, a dodecyl group, a tetradecyl group, a hexadecyl group, a heptadecyl group or an octadecyl group.

The aryl group represented by $R_{25}$ and A may also have substituents, preferably aryl groups having 6 to 14 carbon atoms except for the carbon atoms at the substituent moiety, including, for example, a phenyl group, a tolyl group or a naphthyl group. Two ligands may also be linked through A.

In the formula, M represents a metal atom, preferably a transition metal atom, more preferably Cu, Co, Ni, Pd, Fe or Pt, particularly preferably Ni. The preferably group of A is a hydroxy group.

Of the complex represented by the above formula (V), preferably used are those in which $R_{21}$ is an alkyl group, a cycloalkyl group, an aryl group or a heterocyclic group through an oxy group, a thio group or a carbonyl group; a hydroxy group or a fluorine atom, at least one of the groups represented by $R_{22}$, $R_{23}$ or $R_{24}$ is a hydrogen atom, a hydroxy group, an alkyl group or an alkoxy group. Among them, further preferred are complexes in which $R_{25}$ is a hydrogen atom, and the total number of carbon atoms of the groups represented by $R_{21}$, $R_{22}$, $R_{23}$ or $R_{24}$ is at least 4.

In the following, specific examples of the metal complexes accroding to the present invention are shown, but the present invention is not limited to these compounds.

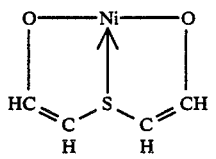
(1)

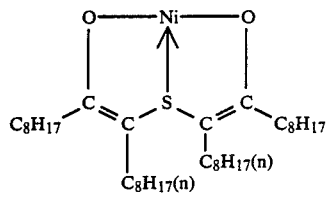
(2)

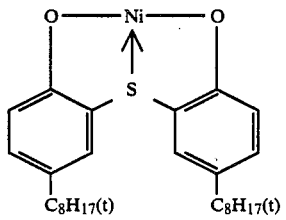
(3)

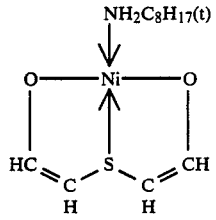
(4)

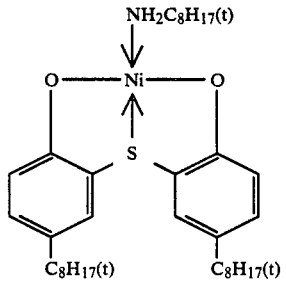
(5)

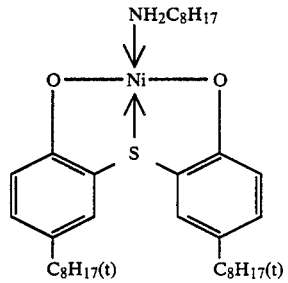
(6)

-continued
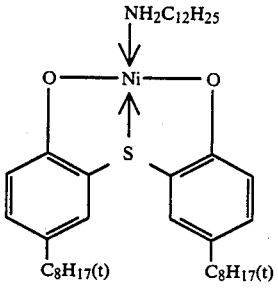
(7)
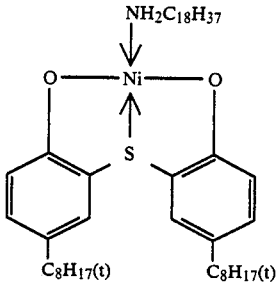
(8)
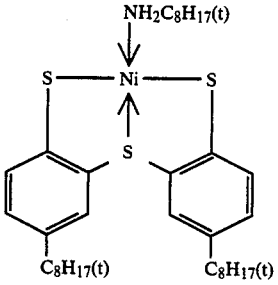
(9)
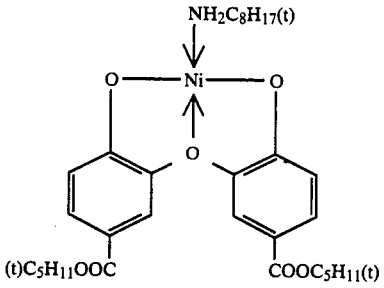
(10)
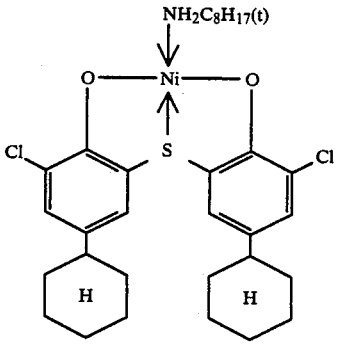
(11)
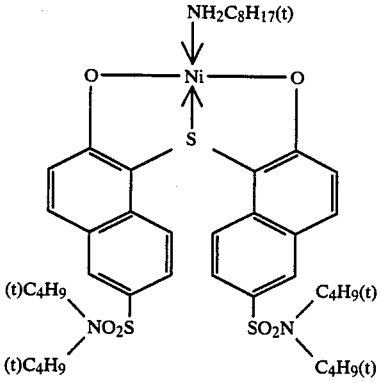
(12)
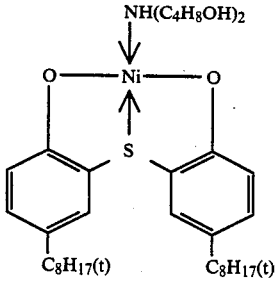
(13)
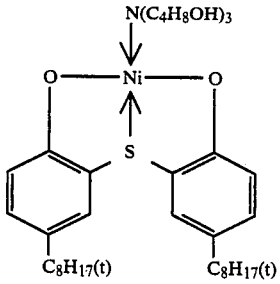
(14)
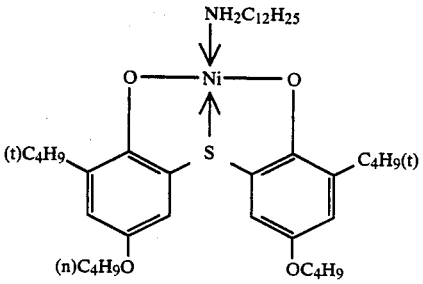
(15)
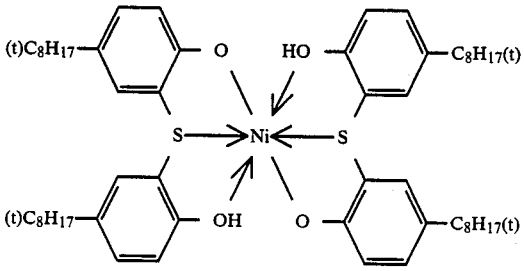
(16)

-continued
(17)
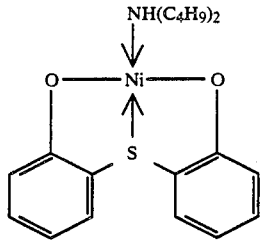
(18)
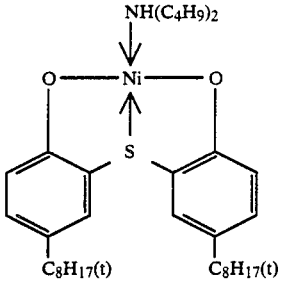
(19)
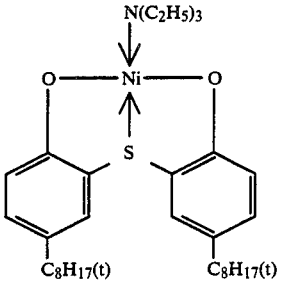
(20)
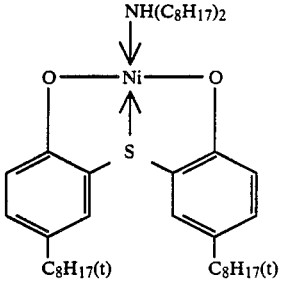
(21)
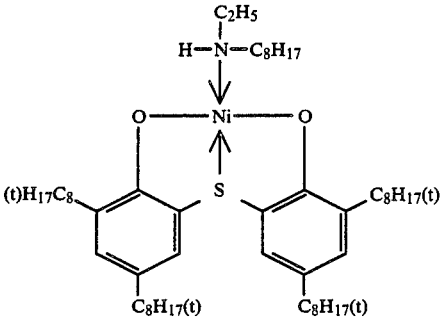
(22)
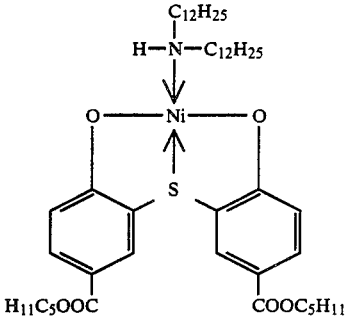
(23)
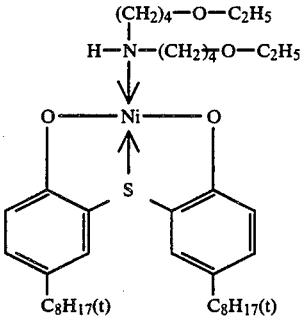
(24)
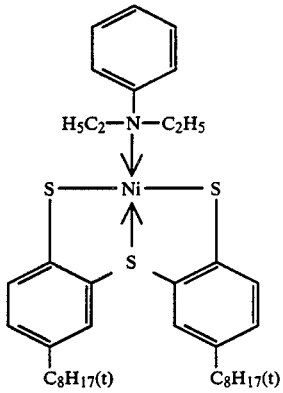
(25)
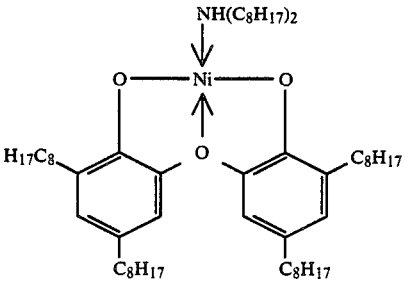
(26)
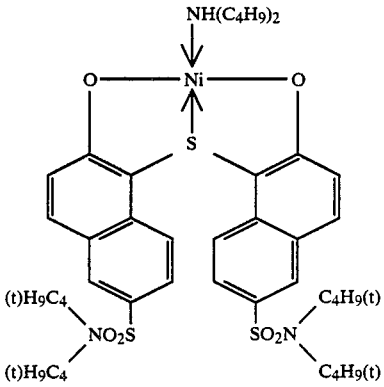

-continued
(27)
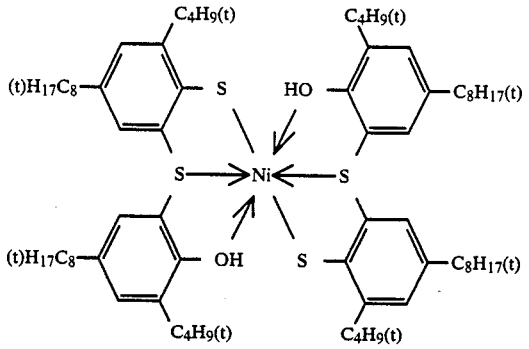
(28)
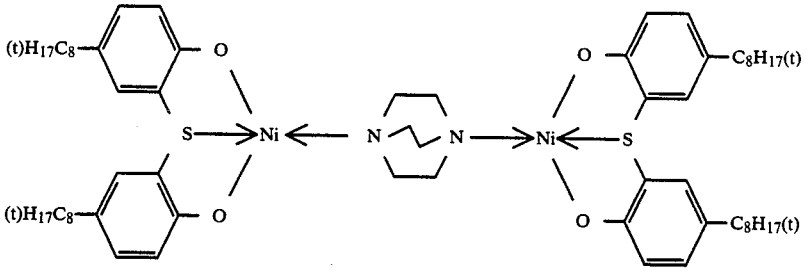
(29)
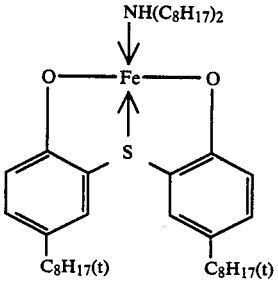
(30)
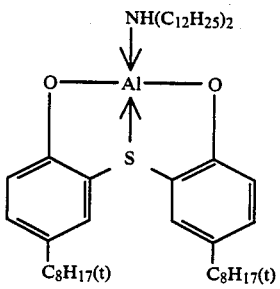
(31)
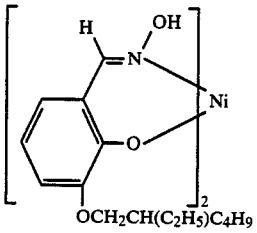
(32)
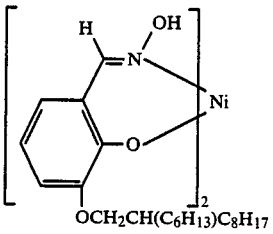
(33)
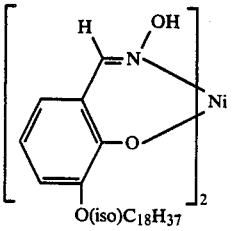
(34)
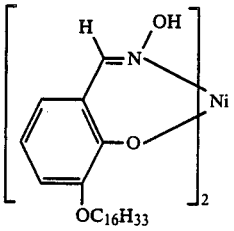
(35)
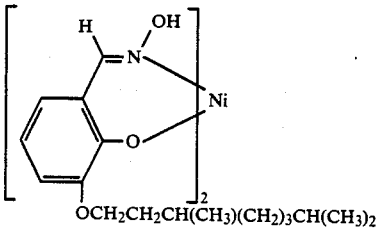
(36)
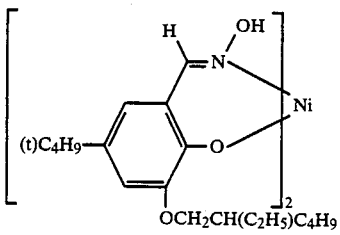

-continued
(37)
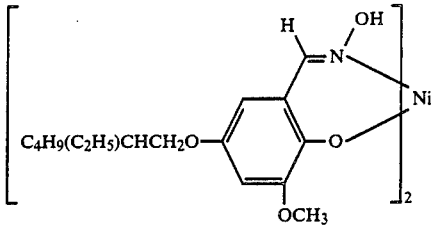
(38)
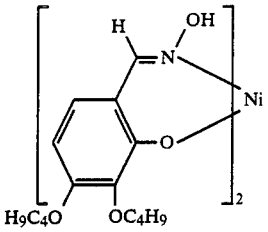
(39)
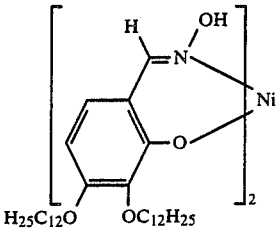
(40)
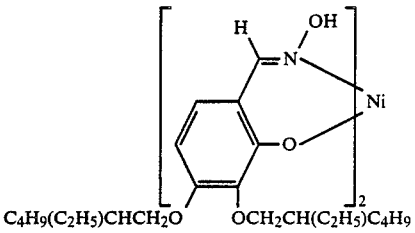
(41)
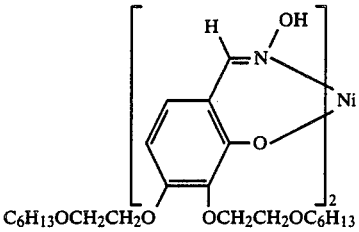
(42)
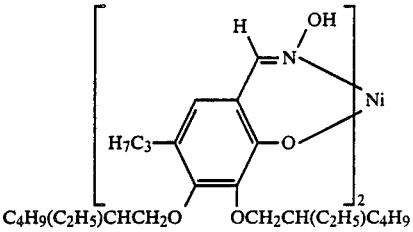
(43)
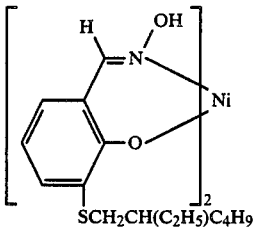
(44)
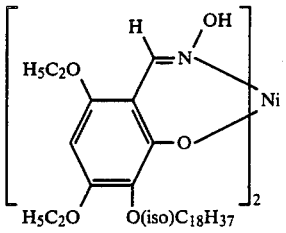
(45)
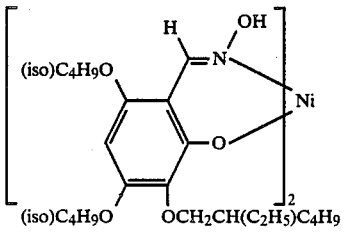
(46)
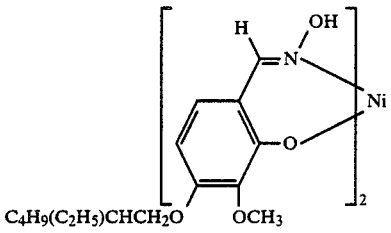
(47)
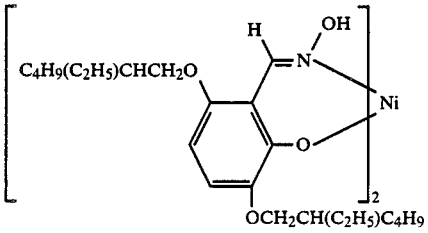
(48)
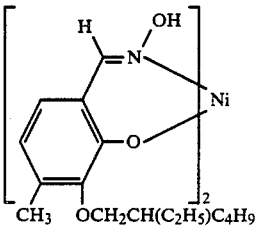

-continued
(49)
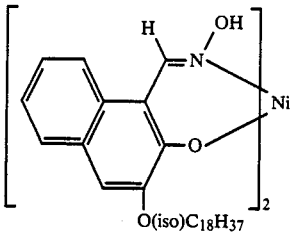
(50)
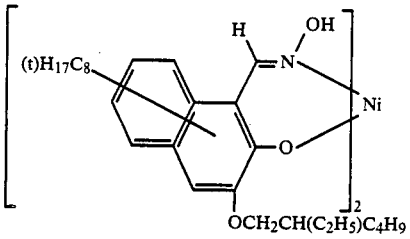
(51)
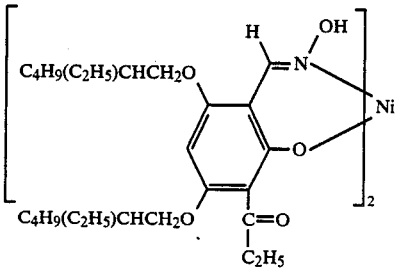
(52)
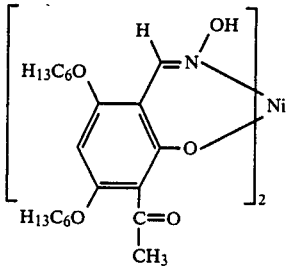
(53)
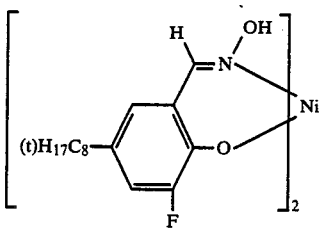
(54)
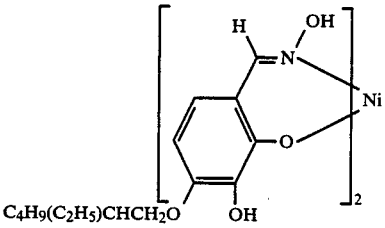
(55)
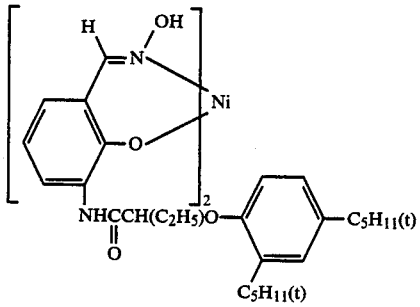
(56)
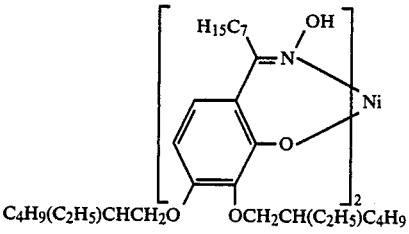
(57)
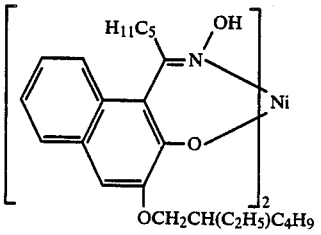
(58)
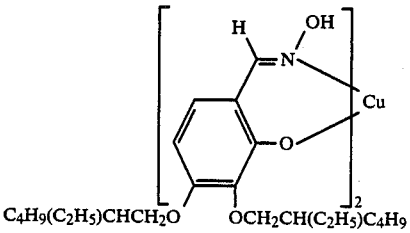
(59)
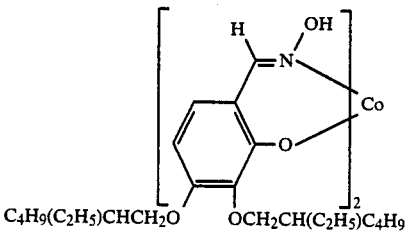
(60)
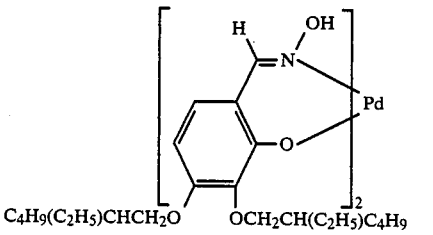

-continued
(61)
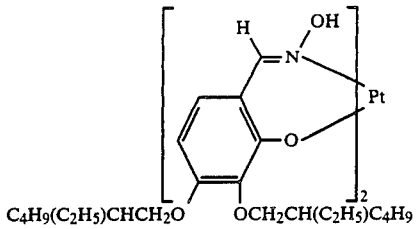
(62)
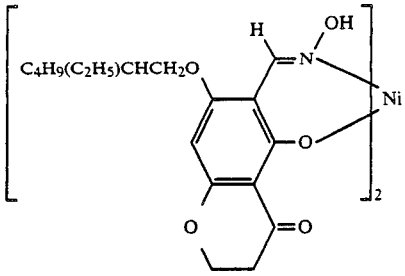
(63)
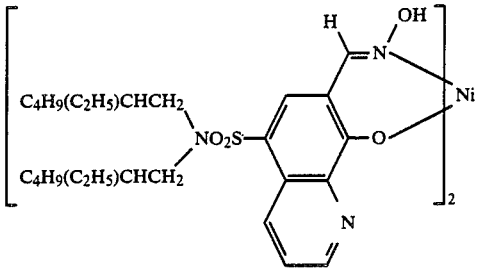
(64)
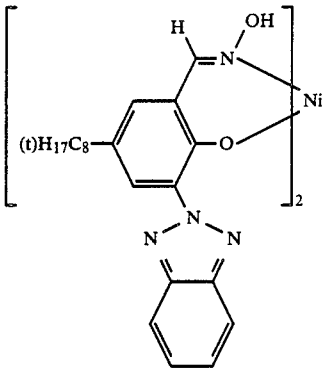
(65)
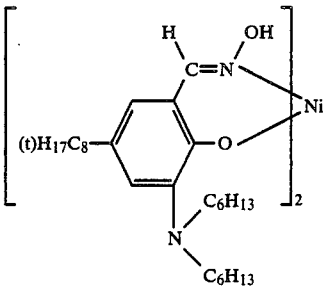
(66)
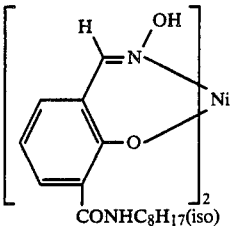
(67)
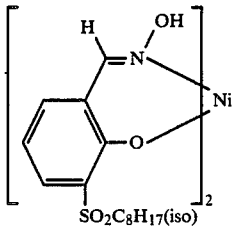
(68)
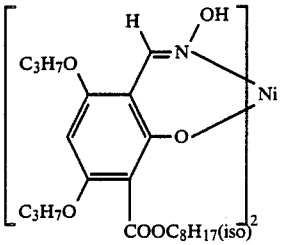
(69)
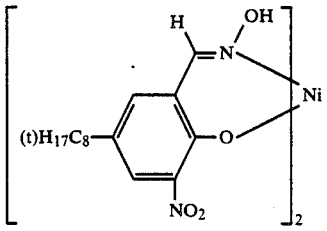
(70)
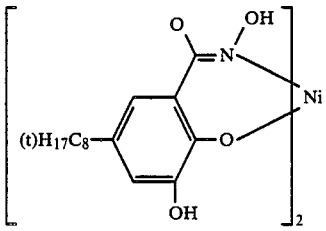

-continued
(71)
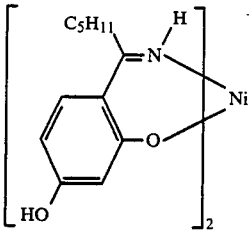
(72)
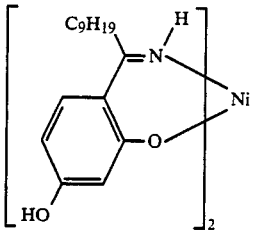
(73)
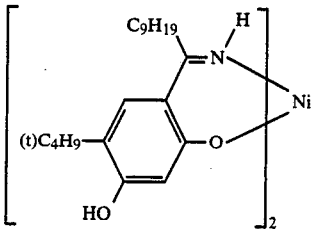
(74)
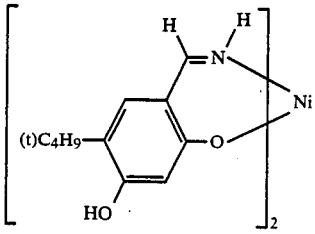
(75)
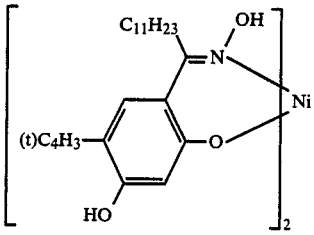
(76)
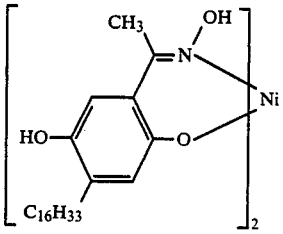
(77)
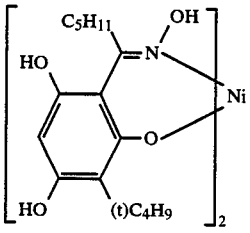
(78)
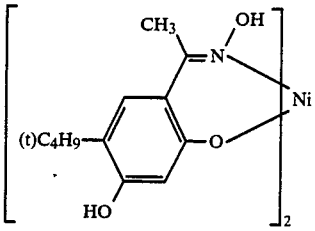
(79)
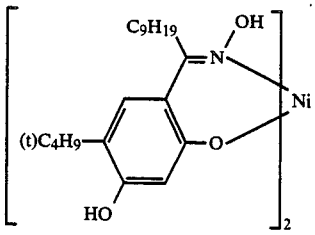
(80)
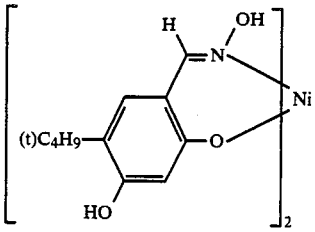
(81)
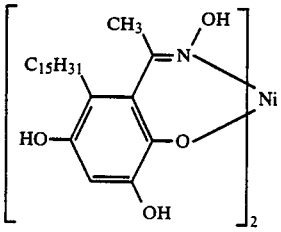
(82)
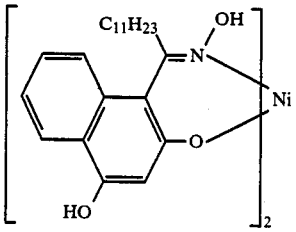

-continued
(83)
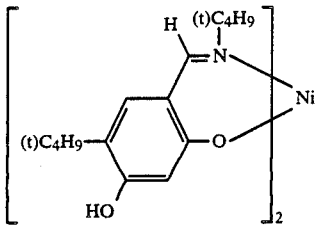
(84)
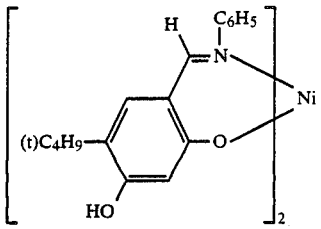
(85)
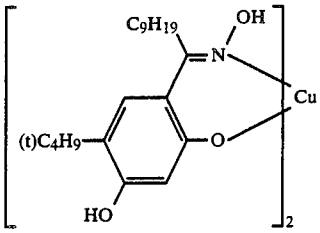
(86)
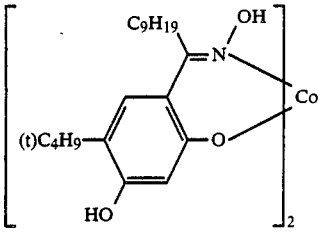
(87)
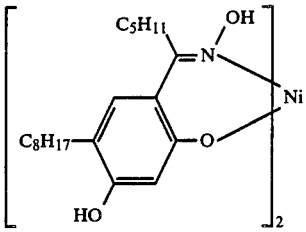
(88)
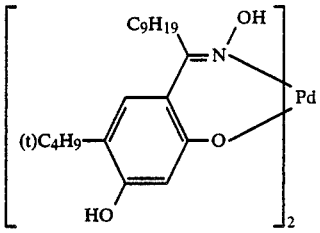
(89)
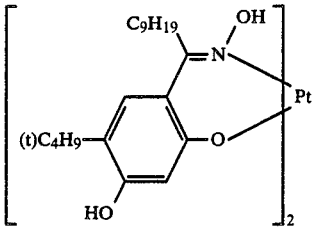
(90)
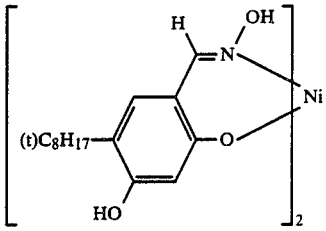
(91)
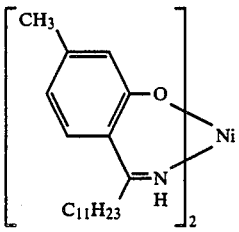
(92)
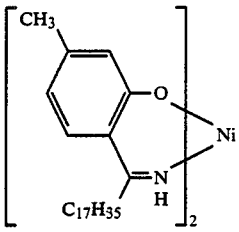
(93)
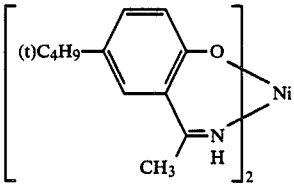
(94)
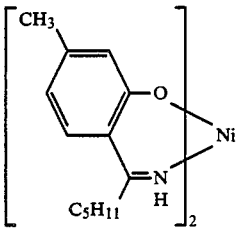
(95)
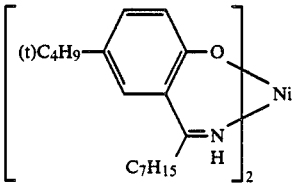
(96)
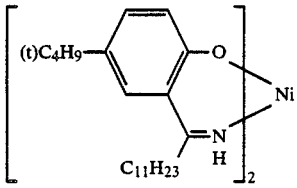

-continued
(97)
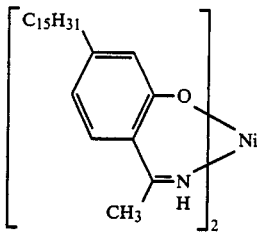
(98)
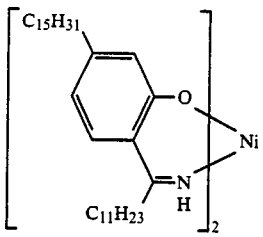
(99)
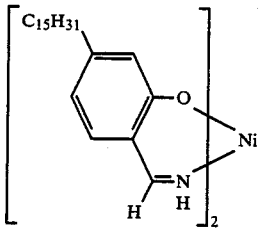
(100)
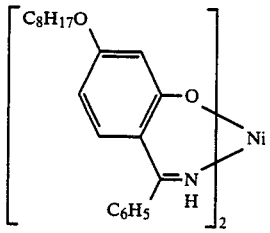
(101)
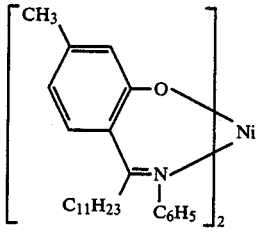
(102)
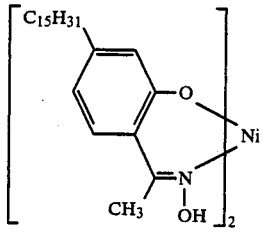
(103)
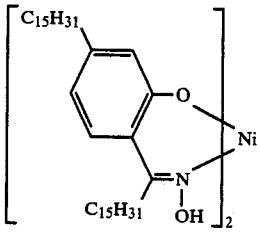
(104)
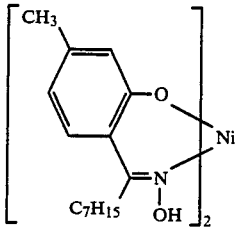
(105)
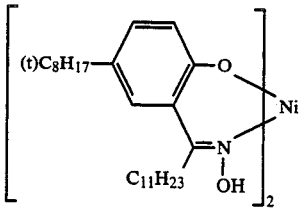
(106)
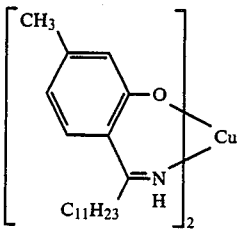
(107)
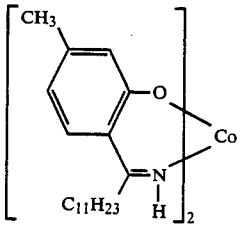
(108)
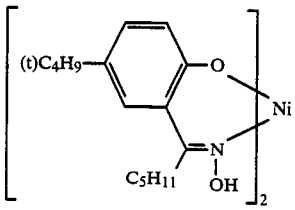

-continued
(109)
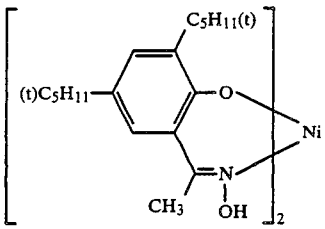
(110)
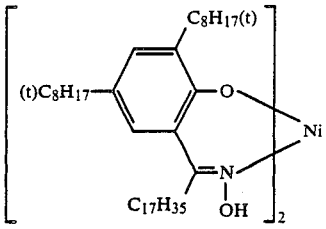
(111)
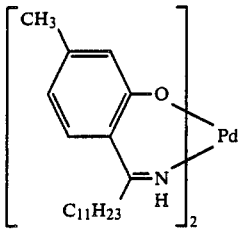
(112)
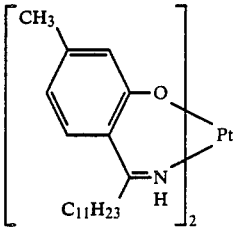
(113)
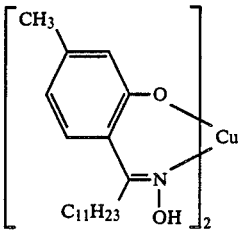
(114)
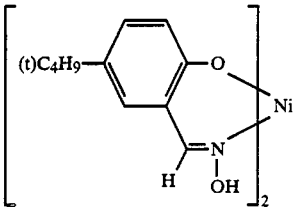
(115)
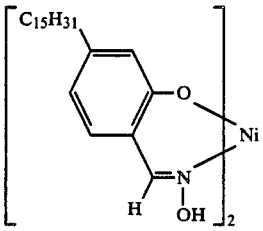
(116)
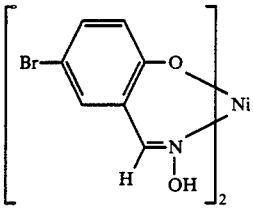
(117)
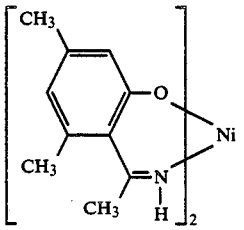
(118)
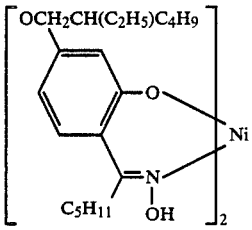
(119)
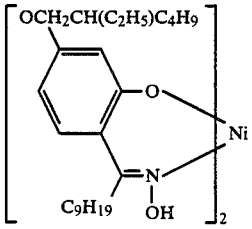
(120)
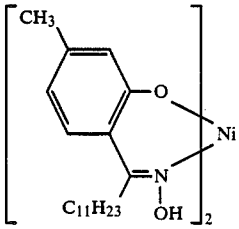

-continued
(121)
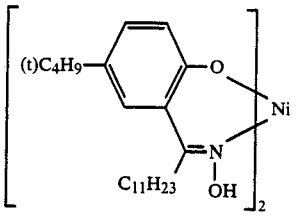
(122)
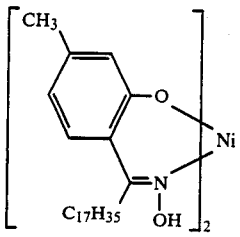
(123)
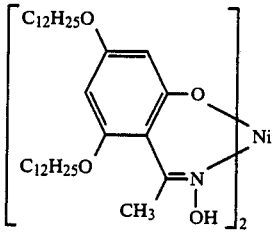
(124)
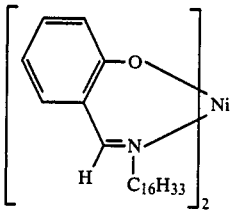
(125)
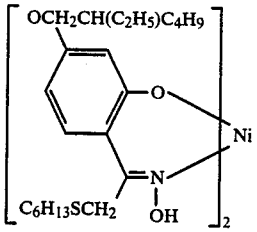
(126)
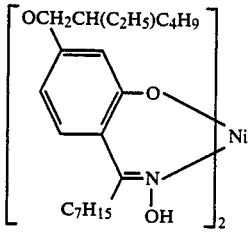
(127)
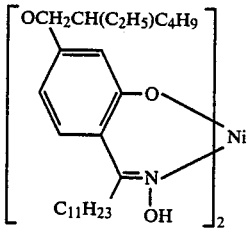
(128)
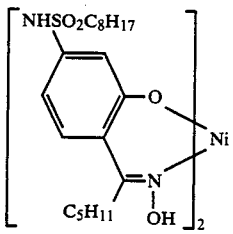
(129)
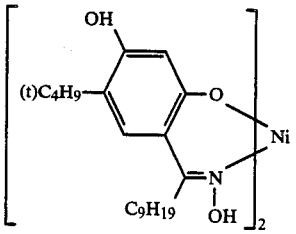
(130)
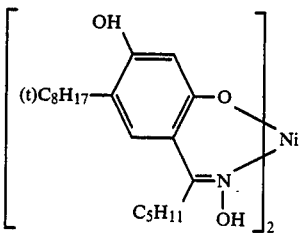
(131)
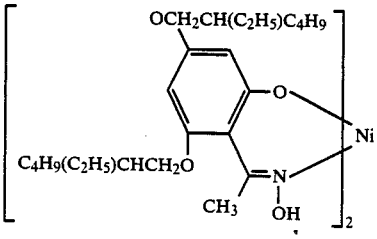
(132)
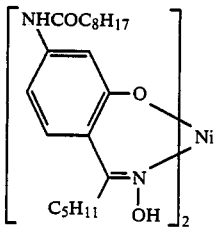

-continued (133)

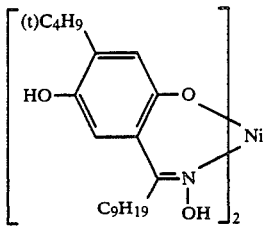

(134)

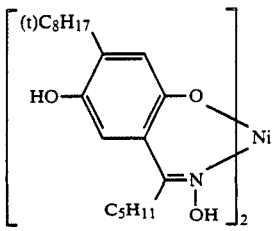

(135)

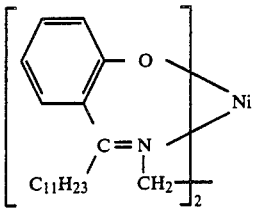

(136)

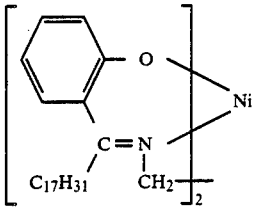

(137)

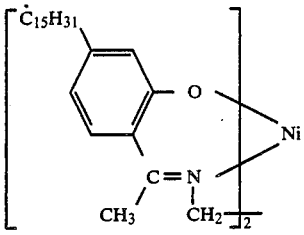

The metal complexes represented by the above formulae (II) to (IV) can be synthesized according to the methods disclosed in U.K. Pat. No. 858,890, West German OLS No. 2,042,652, etc.

The metal complexes represented by the above formula (V) can be synthesized according to the method described in E. G. Cox, F. W. Pinkard, W. Wardlaw and K. C. Webster, J. Chem. Soc., 1935, p. 459.

The metal complex according to the present invention may be used in a coated amount, which may also differ on the metal complex employed and the coupler employed but preferably from about 20 mg/m$^2$ to 500 mg/m$^2$, more preferably from 50 mg/m$^2$ to 300 mg/m$^2$.

The metal complex according to the present invention may be added into the coupler-added layer and/or the layer adjacent to the coupler-added layer of the light-sensitive silver halide photographic material according to the oil-in-water type dispersing method, the latex dispersing method, etc., but it is preferred that the metal complex according to the present invention should be added into the same layer as the coupler-added layer. Further, it is preferable to add the complex in the same oil droplet as the coupler.

In the specification of Japanese Provisional Patent Publication No. 93150/1980, reference is made to copper phthalocyanine type compouds, but these compounds are employed in very minute amount for controlling the whiteness of the white portion and entirely different in physical characteristics (quenching constant of singlet oxygen), amount used, the method of use, and purpose from the metal complexes according to the present invention to be used for making fast the dye image.

The oil-soluble dye according to the present invention refers to an organic dye having a solubility of $1\times10^{-2}$ [g/100 g water] in water at 20° C. (weight of substance soluble in 100 g of water), and typical compounds include anthoraquinone type compounds and azo type compounds.

The oil-soluble dye according to the present invention should preferably have a molecular extinction coefficient of the maximum absorption wavelength at the wavelength of 400 nm or longer (solvent: chloroform) of 5,000 or higher, more preferably 20,000 or higher.

The oil-soluble dye according to the present invention should preferably be used in a coated amount of 0.01 mg/m$^2$ to 10 mg/m$^2$, more preferably 0.05 mg/m$^2$ to 5 mg/m$^2$.

The oil-soluble dye according to the present invention can be used in any of the photographic emulsion layers, but it is more preferable to add the dye in non-light-sensitive layers other than the coupler-containing layer.

A particularly preferable method of using the oil-soluble dye according to the present invention is to incorporate an oil-soluble dye having a molecular extinction coefficient of the maximum absorption wavelength at the wavelength of 400 nm or longer of 20,000 or higher, in a coated amount of 0.05 mg/m$^2$ to 5 mg/m$^2$ in the non-light-sensitive layer other than the coupler-added layer.

Preferable oil-soluble dyes in the present invention are compounds represented by the following formula (VI) or (VII).

(VI)

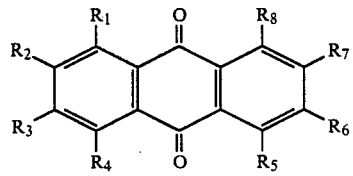

wherein $R_1$ to $R_8$ each represent a hydrogen atom, a hydroxy group, an amino group or a halogen atom.

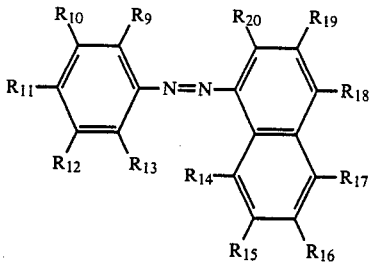

(VII)

wherein $R_9$ to $R_{20}$ each represent a hydrogen atom, a halogen atom, a nitro group, a hydroxy group, an alkyl group, an alkoxy group, an aminocarbonyl group, an amino group or an —N=N—R group (wherein R is an aryl group).

Examples of halogen atoms represented by $R_1$ to $R_8$ in the formula (VI) are chlorine and bromine atoms. The amino group represented by $R_1$ to $R_8$ may have also substituents, and examples of these substituents are alkyl groups (e.g. a methyl group, a butyl group), aryl groups (e.g. a phenyl group), acyl groups (e.g. a methoxy group, a benzoyl group) and the like.

Examples of the halogen atom represented by $R_9$ to $R_{20}$ in the formula (VII) include chlorine and bromine atoms. Examples of the alkyl group may include a methyl group, an ethyl group, a propyl group and the like; examples of the alkoxy group may include a methoxy group, an ethoxy group, a propoxy group and the like; exmaples of the aminocarbonyl group may include a methylaminocarbonyl group, a phenylaminocarbonyl group and the like. Also, the amino group represented by $R_9$ to $R_{20}$ may have the same substituents as in the formula (VI).

Typical examples of the oil-soluble dye to be used in the present invention are shown below, but these are not limitative of the invention.

Exemplary oil-soluble dyes

1

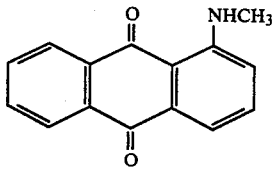

2

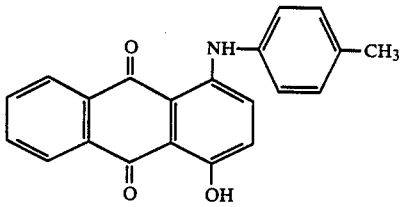

3

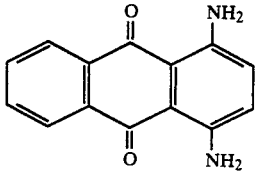

-continued

4

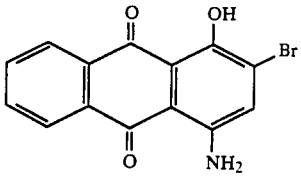

5

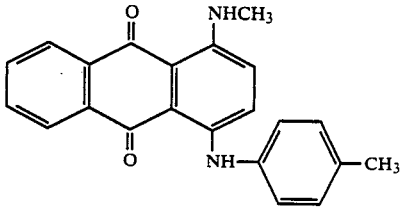

6

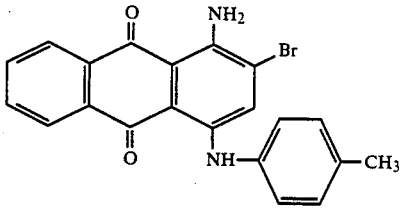

7

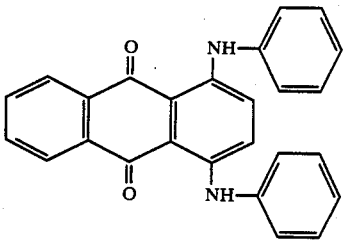

8

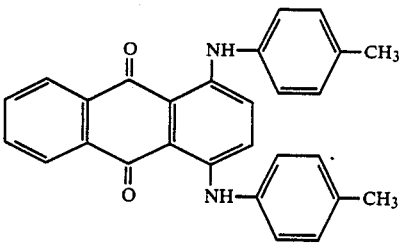

9

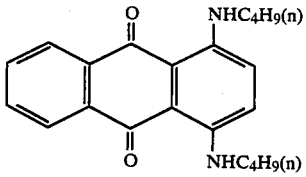

10

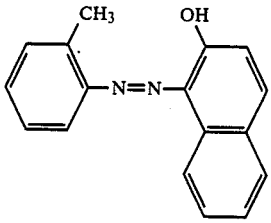

-continued
11
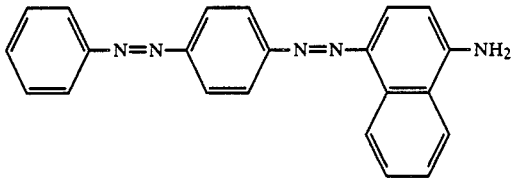
12
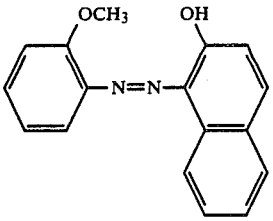
13
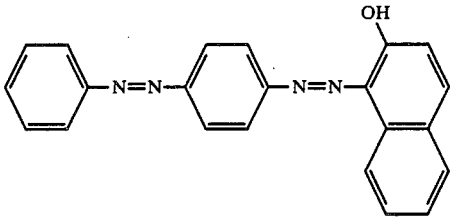
14
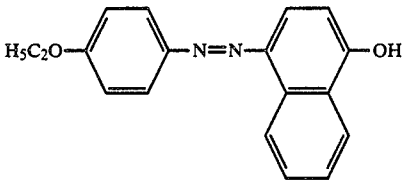
15
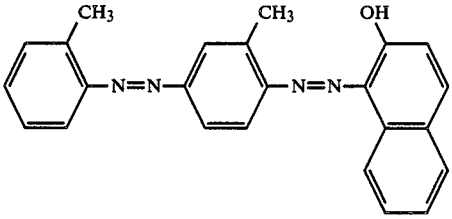
16
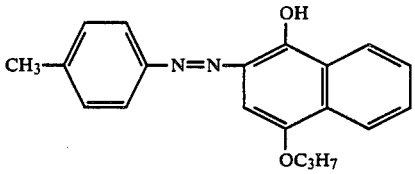
17
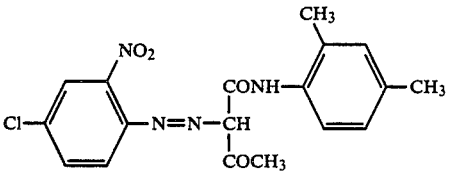
18
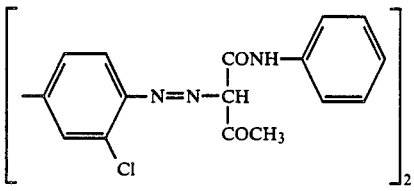
-continued
19
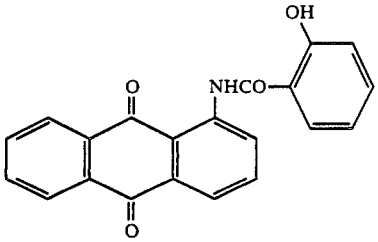
20
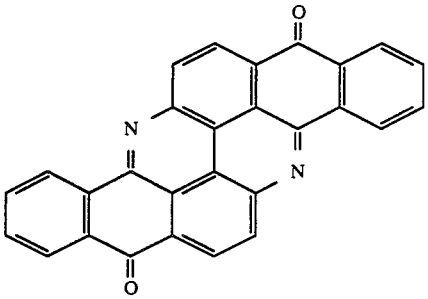
21
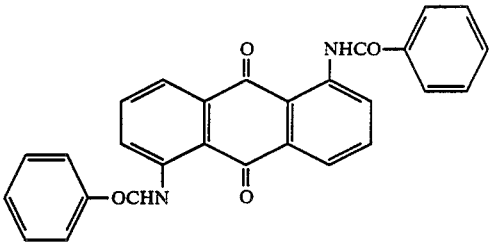
22
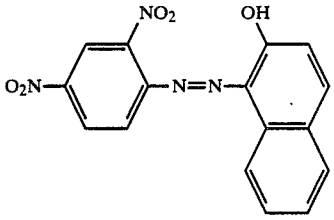
23
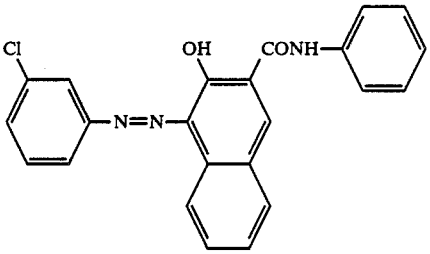
24
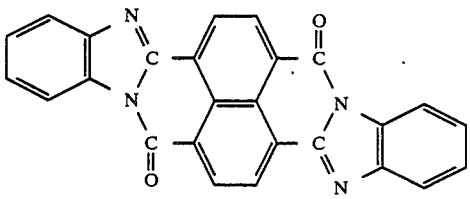

-continued

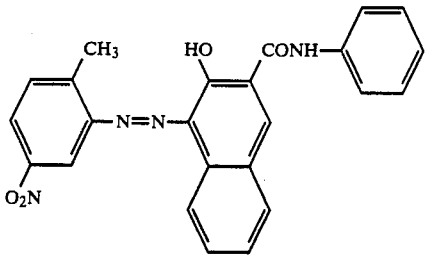

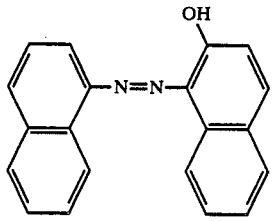

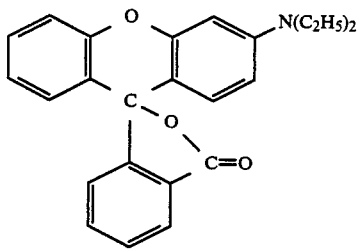

As the method for using the metal complex and the oil-soluble dye according to the present invention in combination, it is preferable to use a metal complex having a quenching constant of singlet oxygen of $3\times10^7$ $M^{-1}.sec^{-1}$ or higher in a coated amount of 20 $mg/m^2$ to 500 $mg/m^2$ and a oil-soluble dye in a coated amount of 0.01 $mg/m^2$ to 10 $mg/m^2$.

Further, it is more preferable to use a metal complex having a quenching constant of singlet oxygen of $3\times10^7$ $M^{-1}.sec^{-1}$ or higher in a coated amount of 20 $mg/m^2$ to 500 $mg/m^2$ in the coupler-containing layer and an oil-soluble dye in a coated amount of 0.01 $mg/m^2$ to 10 $mg/m^2$ in a non-light-sensitive layer other than the coupler-containing layer.

In the light-sensitive silver halide photographic material of the present invention, at least one of the following magenta coupler (I) may preferably be contained in addition to the above metal complexes and the oil-soluble dyes.

In the magenta coupler represented by the above formula (I) according to the present invention:

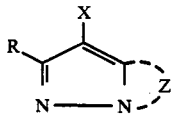

(I)

Z represents a group of non-metal atoms necessary for formation of a nitrogen-containing heterocyclic ring, and the ring formed by said Z may have substituents.

X represents a hydrogen atom or a substituent eliminable through the reaction with the oxidized product of a color developing agent.

R represents a hydrogen atom or a substituent.

Examples represented by the above R may include a halogen atoms, an alkyl group, a cycloalkyl group, an alkenyl group, a cycloalkenyl group, an alkynyl group, an aryl group, a heterocyclic group, an acyl group, a sulfonyl group, a sulfinyl group, a phosphonyl group, a carbamoyl group, a sulfamoyl group, a cyano group, a spiro compound residual group, a bridged hydrocarbon compound residual group, an alkoxy group, an aryloxy group, a heterocyclicoxy group, a siloxy group, an acyloxy group, a carbamoyloxy group, an amino group, an acylamino group, a sulfonamide group, an imide group, an ureido group, a sulfamoylamino group, an alkoxycarbonylamino group, an aryloxycarbonylamino group, an alkoxycarbonyl group, an aryloxycarbonyl group, an alkylthio group, an arylthio group and a heterocyclicthio group.

As a halogen atom, for example, a chlorine atom, a bromine atom may be used, particularly preferably a chlorine atom.

The alkyl group represented by R may include preferably those having 1 to 32 carbon atoms, the alkenyl group or the alkynyl group those having 2 to 32 carbon atoms and the cycloalkyl group or the cycloalkenyl group those having 3 to 12 carbon atoms, particularly 5 to 7 carbon atoms. The alkyl group, alkenyl group or alkynyl group may be either straight or branched.

These alkyl group, alkenyl group, alkynyl group, cycloalkyl group and cycloalkenyl group may also have substituents [e.g. an aryl group, a cyano group, a halogen atom, a heterocyclic ring, a cycloalkyl group, a cycloalkenyl group, a spiro ring compound residual group, a bridged hydrocarbon compound residual group; otherwise those substituted through a carbonyl group such as an acyl group, a carboxy group, a carbamoyl group, an alkoxycarbonyl group and an aryloxycarbonyl group; further those substituted through a hetero atom, specifically those substituted through an oxygen atom such as of a hydroxy group, an alkoxy group, an aryloxy group, a heterocyclicoxy group, a siloxy group, an acyloxy group, a carbamoyloxy group, etc.; those substituted through a nitrogen atom such as of a nitro group, an amino (including a dialkylamino group, etc.), a sulfamoylamino group, an alkoxycarbonylamino group, an aryloxycarbonylamino group, an acylamino group, a sulfonamide group, an imide group, an ureido group, etc.; those substituted through a sulfur atom such as of an alkylthio group, an arylthio group, a heterocyclicthio group, a sulfonyl group, a sulfinyl group, a sulfamoyl group, etc.; and those substituted through a phosphorus atom such as of a phosphonyl group, etc.].

More specifically, there may be included, for example, a methyl group, an ethyl group, an isopropyl group, a t-butyl group, a pentadecyl group, a heptadecyl group, a 1-hexynonyl group, a 1,1'-dipentylnonyl group, a 2-chloro-t-butyl group, a trifluoromethyl group, a 1-ethoxytridecyl group, a 1-methoxyisopropyl group, a methanesulfonylethyl group, a 2,4-di-t-amylphenoxymethyl group, an anilino group, a 1-phenylisopropyl group, a 3-m-butanesulfoneaminophenoxypropyl group, a 3,4'-{α-[4''-(p-hydroxybenzenesulfonyl)-phenoxy]dodecanoylamino}phenylpropyl group, a 3-{4'-[α-(2'',4''-di-t-amylphenoxy)butaneamido]phenyl}propyl group, a 4-[α-(o-chlorophenoxy)tetradecaneamidophenoxy]propyl group, an allyl group, a cyclopentyl group, a cyclohexyl group, and so on.

The aryl group represented by R may preferably be a phenyl group, which may also have a substituent (e.g.

an alkyl group, an alkoxy group, an acylamino group, etc.).

More specifically, there may be included a phenyl group, a 4-t-butylphenyl group, a 2,4-di-t-amylphenyl group, a 4-tetradecaneamidophenyl group, a hexadecyloxyphenyl group, a 4'-[α-(4''-t-butylphenoxy)tetradecaneamido]phenyl group and the like.

The heterocyclic group represented by R may preferably be a 5- to 7-membered ring, which may either be substituted or fused. More specifically, a 2-furyl group, a 2-thienyl group, a 2-pyrimidinyl group, a 2-benzothiazolyl group, etc. may be mentioned.

The acyl group represented by R may be, for example, an alkylcarbonyl group such as an acetyl group, a phenylacetyl group, a dodecanoyl group, an α-2,4-di-t-amylphenoxybutanoyl group and the like; an arylcarbonyl group such as a benzoyl group, a 3-pentadecyloxybenzoyl group, a p-chlorobenzoyl group and the like.

The sulfonyl group represented by R may include alkylsulfonyl groups such as a methylsulfonyl group, a dodecylsulfonyl group and the like; arylsulfonyl groups such as a benzenesulfonyl group, a p-toluenesulfonyl group and the like.

Examples of the sulfinyl group represented by R are alkylsulfinyl groups such as an ethylsulfinyl group, an octylsulfinyl group, a 3-phenoxybutylsulfinyl group and the like; arylsulfinyl groups such as a phenylsulfinyl group, a m-pentadecylphenylsulfinyl group and the like.

The phosphonyl group represented by R may be exemplified by alkylphosphonyl groups such as a butyloctylphosphonyl group and the like; alkoxyphosphonyl groups such as an octyloxyphosphonyl group and the like; aryloxyphosphonyl groups such as a phenoxyphosphonyl group and the like; and arylphosphonyl groups such as a phenylphosphonyl group and the like.

The carbamoyl group represented by R may be substituted by an alkyl group, an aryl group (preferably a phenyl group), etc., including, for example, an N-methylcarbamoyl group, an N,N-dibutylcarbamoyl group, an N-(2-pentadecyloctylethyl)carbamoyl group, an N-ethyl-N-dodecylcarbamoyl group, an N-{3-(2,4-di-t-amylphenoxy)propyl}carbamoyl group and the like.

The sulfamoyl group represented by R may be substituted by an alkyl group, an aryl group (preferably a phenyl group), etc., including, for example, an N-propylsulfamoyl group, an N,N-diethylsulfamoyl group, an N-(2-pentadecyloxyethyl)sulfamoyl group, an N-ethyl-N-dodecylsulfamoyl group, an N-phenylsulfamoyl group and the like.

The spiro compound residue represented by R may be, for example, spiro[3.3]heptan-1-yl and the like.

The bridged hydrocarbon residual group represented by R may be, for example, bicyclo[2.2.1]heptan-1-yl, tricyclo[3.3.1.1$^{3,7}$]decan-1-yl, 7,7-dimethylbicyclo[2.2.1]heptan-1-yl and the like.

The alkoxy group represented by R may be substituted by those as mentioned above as substituents for alkyl groups, including a methoxy group, a propoxy group, a 2-ethoxyethoxy group, a pentadecyloxy group, a 2-dodecyloxyethoxy group, a phenethyloxyethoxy group and the like.

The aryloxy group represented by R may preferably be a phenyloxy group of which the aryl nucleus may be further substituted by those as mentioned above as substituents or atoms for the aryl groups, including, for example, a phenoxy group, a p-t-butylphenoxy group, a m-pentadecylphenoxy group and the like.

The heterocyclicoxy group represented by R may preferably be one having a 5- to 7-membered hetero ring, which hetero ring may further have substituents, including a 3,4,5,6-tetrahydropyranyl-2-oxy group, a 1-phenyltetrazole-5-oxy group and the like.

The siloxy group represented by R may further be substituted by an alkyl group, etc., including a siloxy group, a trimethylsiloxy group, a triethylsiloxy group, a dimethylbutylsiloxy group and the like.

The acyloxy group represented by R may be exemplified by an alkylcarbonyloxy group, an arylcarbonyloxy group, etc., which may further have substituents, including specifically an acetyloxy group, an α-chloroacetyloxy group, a benzoyloxy and the like.

The carbamoyloxy group represented by R may be substituted by an alkyl group, an aryl group, etc., including an N-ethylcarbamoyloxy group, an N,N-diethylcarbamoyloxy group, an N-phenylcarbamoyloxy group and the like.

The amino group represented by R may be substituted by an alkyl group, an aryl group (preferably a phenyl group), etc., including an ethylamino group, an anilino group, an m-chloroanilino group, a 3-pentadecyloxycarbonylanilino group, a 2-chloro-5-hexadecaneamidoanilino group and the like.

The acylamino group represented by R may include an alkylcarbonylamino group, an arylcarbonylamino group (preferably an phenylcarbonylamino group), etc., which may further have substituents, specifically an acetamide group, an α-ethylpropaneamide group, an N-phenylacetamide group, a dodecaneamide group, a 2,4-di-t-amylphenoxyacetoamide group, an α-3-t-butyl-4-hydroxyphenoxybutaneamide group and the like.

The sulfonamide group represented by R may include an alkylsulfonylamino group, an arylsulfonylamino group, etc., which may further have substituents, specifically a methylsulfonylamino group, a pentadecylsulfonylamino group, a benzenesulfonamide group, a p-toluenesulfonamide group, a 2-methoxy-5-t-amylbenzenesulfonamide and the like.

The imide group represented by R may be either openchained or cyclic, which may also have substituents, as exemplified by a succinimide group, a 3-heptadecylsuccinimide group, a phthalimide group, a glutarimide group and the like.

The ureido group represented by R may be substituted by an alkyl group, an aryl group (preferably a phenyl group), etc., including an N-ethylureido group, an N-methyl-N-decylureido group, an N-phenylureido group, an N-p-tolylureido group and the like.

The sulfamoylamino group represented by R may be substituted by an alkyl group, an aryl group (preferably a phenyl group), etc., including an N,N-dibutylsulfamoylamino group, an N-methylsulfamoylamino group, an N-phenylsulfamoylamino group and the like.

The alkoxycarbonylamino group represented by R may further have substituents, including a methoxycarbonylamino group, a methoxyethoxycarbonylamino group, an octadecyloxycarbonylamino group and the like.

The aryloxycarbonylamino group represented by R may have substituents, and may include a phenoxycarbonylamino group, a 4-methylphenoxycarbonylamino group and the like.

The alkoxycarbonyl group represented by R may further have substituents, and may include a methoxycarbonyl group, a butyloxycarbonyl group, a dodecyloxycarbonyl group, an octadecyloxycarbonyl group, an ethoxymethoxycarbonyloxy group, an benzyloxycarbonyl group and the like.

The aryloxycarbonyl group represented by R may further have substituents, and may include a phenoxycarbonyl group, a p-chlorophenoxycarbonyl group, a m-pentadecyloxyphenoxycarbonyl group and the like.

The alkylthio group represented by R may further have substituents, and may include an ethylthio group, a dodecylthio group, an octadecylthio group, a phnethylthio group, a 3-phenoxypropylthio group and the like.

The arylthio group represented by R may preferably be a phenylthio group, which may further have substituents, and may include, for example, a phenylthio group, a p-methoxyphenylthio group, a 2-t-octylphenylthio group, a 3-octadecylphenylthio group, a 2-carboxyphenylthio group, a p-acetaminophenylthio group and the like.

The heterocyclicthio group represented by R may preferably be a 5- to 7-membered heterocyclicthio group, which may further have a fused ring or have substituents, including, for example, a 2-pyridylthio group, a 2-benzothiazolylthio group, a 2,4-di-phenoxy-1,3,5-triazole-6-thio group and the like.

The atom eliminable through the reaction with the oxidized product of a color developing agent represented by X may include halogen atoms (e.g. a chlorine atom, a bromine atom, a fluorine atom, etc.) and also groups substituted through a carbon atom, an oxygen atom, a sulfur atom or a nitrogen atom.

The group substituted through a carbon atom may include, in addition to the carboxyl group, the groups represented by the formula:

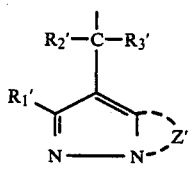

wherein $R_1'$ has the same meaning as the above R,

Z' has the same meaning as the above Z, $R_2'$ and $R_3'$ each represent a hydrogen atom, an aryl group, an alkyl group or a heterocyclic group, a hydroxymethyl group and a triphenylmethyl group.

The group substituted through an oxygen atom may include an alkoxy group, an aryloxy group, a heterocyclicoxy group, an acyloxy group, a sulfonyloxy group, an alkoxycarbonyloxy group, an aryloxycarbonyloxy group, an alkyloxalyloxy group, an alkoxyoxalyloxy groups.

Said alkoxy group may further have substituents, including an ethoxy group, a 2-phenoxyethoxy group, a 2-cyanoethoxy group, a phenethyloxy group, a p-chlorobenzyloxy group and the like.

Said aryloxy group may preferably be a phenoxy group, which aryl group may further have substituents. Specific examples may include a phenoxy group, a 3-methylphenoxy group, a 3-dodecylphenoxy group, a 4-methanesulfonamidophenoxy group, a 4-[α-(3'-pentadecylphenoxy)butaneamido]phenoxy group, a hexadecylcarbamoylmethoxy group, a 4-cyanophenoxy group, a 4-methanesulfonylphenoxy group, a 1-naphthyloxy group, a p-methoxyphenoxy group and the like.

Said heterocyclicoxy group may preferably be a 5- to 7-membered heteroxyclicoxy group, which may be a fused ring or have substituents. Specifically, a 1-phenyltetrazolyloxy group, a 2-benzothiazolyloxy group and the like may be included.

Said acyloxy group may be exemplified by an alkylcarbonyloxy group such as an acetoxy group, a butanoyloxy group, etc.; an alkenylcarbonyloxy group such as a cinnamoyloxy group; an arylcarbonyloxy group such as a benzoyloxy group.

Said sulfonyloxy group may be, for example, a butanesulfonyloxy group, a methanesulfonyloxy group and the like.

Said alkoxycarbonyloxy group may be, for example, an ethoxycarbonyloxy group, a benzyloxycarbonyloxy group and the like.

Said aryloxycarbonyl group may be, for example, a phenoxycarbonyloxy group and the like.

Said alkyloxalyloxy group may be, for example, a methyloxalyloxy group.

Said alkoxyoxalyloxy group may be, for example, an ethoxyoxalyloxy group and the like.

The group substituted through a sulfur atom may include an alkylthio group, an arylthio group, a heterocyclicthio group, an alkyloxythiocarbonylthio groups.

Said alkylthio group may include a butylthio group, a 2-cyanoethylthio group, a phenethylthio group, a benzylthio group and the like.

Said arylthio group may include a phenylthio group, a 4-methanesulfonamidophenylthio group, a 4-dodecylphenethylthio group, a 4-nonafluoropentaneamidophenethylthio group, a 4-carboxyphenylthio group, a 2-ethoxy-5-t-butylphenylthio group and the like.

Said heterocyclicthio group may be, for example, a 1-phenyl-1,2,3,4-tetrazolyl-5-thio group, a 2-benzothiazolylthio group and the like.

Said alkyloxythiocarbonylthio group may include a dodecyloxythiocarbonylthio group and the like.

The group substituted through a nitrogen atom may include, for example, those represented by the formula:

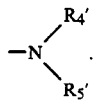

Here, $R_4'$ and $R_5'$ each represent a hydrogen atom, an alkyl group, an aryl group, a heterocyclic group, a sulfamoyl group, a carbamoyl group, an acyl group, a sulfonyl group, an aryloxycarbonyl group or an alkoxycarbonyl group. $R_4'$ and $R_5'$ may be bonded to each other to form a hetero ring. However, $R_4'$ and $R_5'$ cannot both be hydrogen atoms.

Said alkyl group may be either straight or branched, having preferably 1 to 22 carbon atoms. Also, the alkyl group may have substituents such as an aryl group, an alkoxy group, an aryloxy group, an alkylthio group, an arylthio group, an alkylamino group, an arylamino group, an acylamino group, a sulfonamide group, an imino group, an acyl group, an alkylsulfonyl group, an arylsulfonyl group, a carbamoyl group, a sulfamoyl group, an alkoxycarbonyl group, an aryloxycarbonyl group, an alkyloxycarbonylamino group, an aryloxycarbonylamino group, a hydroxyl group, a carboxyl group, a cyano group, halogen atoms, etc. Typical examples of said alkyl group may include an ethyl group, an octyl group, a 2-ethylhexyl group, a 2-chloroethyl group and the like.

The aryl group represented by $R_4'$ or $R_5'$ may preferably have 6 to 32 carbon atoms, particularly a phenyl group or a naphthyl group, which aryl group may also have substituents such as those as mentioned above for substituents on the alkyl group represented by $R_4'$ and $R_5'$ and alkyl groups. Typical examples of said aryl group may be, for example, a phenyl group, a 1-naphthyl group, a 4-methylsulfonylphenyl group and the like.

The heterocyclic group represented by $R_4'$ or $R_5'$ may preferably a 5- or 6-membered ring, which may be a fused ring or have substituents. Typical examples may include a 2-furyl group, a 2-quinolyl group, a 2-pyrimidyl group, a 2-benzothiazolyl group, a 2-pyridyl group and the like.

The sulfamoyl group represented by $R_4'$ or $R_5'$ may include an N-alkylsulfamoyl group, an N,N-dialkylsulfamoyl group, an N-arylsulfamoyl group, an N,N-diarylsulfamoyl group and the like, and these alkyl and aryl groups may have substituents as mentioned above for the alkyl groups and aryl groups. Typical examples of the sulfamoyl group are, for example, an N,N-diethylsulfamoyl group, an N-methylsulfamoyl group, an N-dodecylsulfamoyl group, an N-p-tolylsulfamoyl group and the like.

The carbamoyl group represented by $R_4'$ or $R_5'$ may include an N-alkylcarbamoyl group, an N,N-dialkylcarbamoyl group, an N-arylcarbamoyl group, an N,N-diarylcarbamoyl group and the like, and these alkyl and aryl groups may have substituents as mentioned above for the alkyl groups and aryl groups. Typical examples of the carbamoyl group are an N,N-diethylcarbamoyl group, an N-methylcarbamoyl group, an N-dodecylcarbamoyl group, an N-p-cyanocarbamoyl group, an N-p-tolylcarbamoyl group and the like.

The acyl group represented by $R_4'$ or $R_5'$ may include an alkylcarbonyl group, an arylcarbonyl group, a heterocyclic carbonyl group, which alkyl group, aryl group and heterocyclic group may have substituents. Typical examples of the acyl group are a hexafluorobutanoyl group, a 2,3,4,5,6-pentafluorobenzoyl group, an acetyl group, a benzoyl group, a naphthoyl group, a 2-furylcarbonyl group and the like.

The sulfonyl group represented by $R_4'$ or $R_5'$ may be, for example, an alkylsulfonyl group, an arylsulfonyl group or a heterocyclic sulfonyl group, which may also have substituents, including specifically an ethanesulfonyl group, a benzenesulfonyl group, an octanesulfonyl group, a naphthalenesulfonyl group, a p-chlorobenzenesulfonyl group and the like.

The aryloxycarbonyl group represented by $R_4'$ or $R_5'$ may have substituents as mentioned for the above aryl group, including specifically a phenoxycarbonyl group and the like.

The alkoxycarbonyl group represented by $R_4'$ or $R_5'$ may have substituents as mentioned for the above alkyl group, and its specific examples are a methoxycarbonyl group, a dodecyloxycarbonyl group, a benzyloxycarbonyl group and the like.

The heterocyclic ring formed by bonding between $R_4'$ and $R_5'$ may preferably be a 5- or 6-membered ring, which may be either saturated or unsaturated, either has aromaticity or not, or may also be a fused ring. Said heterocyclic ring may include, for example, an N-phthalimide group, an N-succinimide group, a 4-N-urazolyl group, a 1-N-hydantoinyl group, a 3-N-2,4-dioxooxazolidinyl group, a 2-N-1,1-dioxo-3-(2H)-oxo-1,2-benzothiazolyl group, a 1-pyrrolyl group, a 1-pyrrolidinyl group, a 1-pyrazolyl group, a 1-pyrazolidinyl group, a 1-piperidinyl group, a 1-pyrrolinyl group, a 1-imidazolyl group, a 1-imidazolinyl group, a 1-indolyl group, a 1-isoindolinyl group, a 2-isoindolyl group, a 2-isoindolinyl group, a 1-benzotriazolyl group, a 1-benzoimidazolyl group, a 1-(1,2,4-triazolyl) group, a 1-(1,2,3-triazolyl) group, a 1-(1,2,3,4-tetrazolyl) group, an N-morpholinyl group, a 1,2,3,4-tetrahydroquinolyl group, a 2-oxo-1-pyrrolidinyl group, a 2-1H-pyrridone group, a phthaladione group, a 2-oxo-1-piperidinyl group, etc. These heterocyclic groups may be substituted by an alkyl group, an aryl group, an alkyloxy group, an aryloxy group, an acyl group, a sulfonyl group, an alkylamino group, an arylamino group, an acylamino group, a sulfonamino group, a carbamoyl group, a sulfamoyl group, an alkylthio group, an arylthio group, an ureido group, an alkoxycarbonyl group, an aryloxycarbonyl group, an imide group, a nitro group, a cyano group, a carboxyl group or halogen atoms.

The nitrogen-containing heterocyclic ring formed by Z and Z' may include a pyrazole ring, a imidazole ring, a triazole ring or a tetrazole ring, and the substituents which may be possessed by the above rings may include those as mentioned for the above R.

When the substituent (e.g. R, $R_1$ to $R_8$) on the heterocyclic ring in the formula (I) and the formulae (VI) to (XII) as hereinafter described has a moiety of the formula:

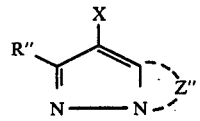

(wherein R", X and Z" have the same meanings as R, X and Z in the formul (I)), the so-called bis-form type coupler is formed, which is of course included in the present invention. The ring formed by Z, Z', Z" and $Z_1$ as hereinafter described may also be fused with another ring (e.g. a 5- to 7-membered cycloalkene). For example, $R_5$ and $R_6$ in the formula (IX), $R_7$ and $R_8$ in the formula (X) may be bonded to each other to form a ring (e.g. a 5- to 7-membered rings).

The compounds represented by the formula (I) can be also represented specifically by the following formulae (VI) through (XII).

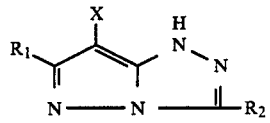

(VI)

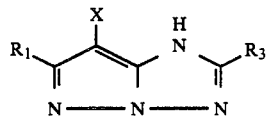

(VII)

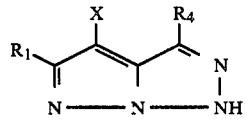

(VIII)

-continued

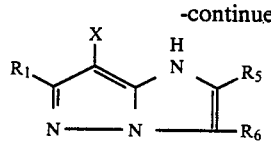

(IX)

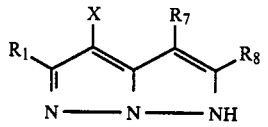

(X)

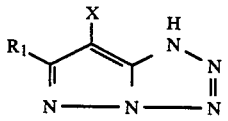

(XI)

In the above formulae (VI) to (XI), $R_1$ to $R_8$ and X have the same meanings as the above R and X.

Of the compounds represented by the formula (I), those represented by the following formula (XII) are preferred.

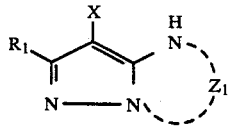

(XII)

wherein $R_1$, X and $Z_1$ have the same meanings as R, X and Z in the formula (I).

Of the magenta couplers represented by the formulae (VI) to (XI), the magenta coupler represented by the formula (VI) is particularly preferred.

To describe about the substituents on the heterocyclic ring in the formulae (I) and (VI) to (XII), R in the formula (I) and $R_1$ in the formulae (VI) to (XII) should preferably satisfy the following condition 1, more preferably satisfy the following conditions 1 and 2, and particularly preferably satisfy the following conditions 1, 2 and 3:

Condition 1: a root atom directly bonded to the heterocyclic ring is a carbon atom, Condition 2: only one of hydrogen atom is bonded to said carbon atom or no hydrogen atom is bonded to it, and Condition 3: the bondings between the root atom and adjacent atoms are all single bonds.

Of the substituents R and $R_1$ on the above heterocyclic ring, most preferred are those represented by the formula (XIII) shown below:

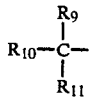

(XIII)

In the above formula, each of $R_9$, $R_{10}$ and $R_{11}$ represents a hydrogen atom, a halogen atom, an alkyl group, a cycloalkyl group, an alkenyl group, a cycloalkenyl group, an alkynyl group, an aryl group, a heterocyclic group, an acyl group, a sulfonyl group, a sulfinyl group, a phosphonyl group, a carbamoyl group, a sulfamoyl group, a cyano group, a spiro compound residual group, a bridged hydrocarbon compound residual group, an alkoxy group, an aryloxy group, a heterocyclicoxy group, a siloxy group, an acyloxy group, a carbamoyloxy group, an amino group, an acylamino group, a sulfonamide group, an imide group, an ureido group, a sulfamoylamino group, an alkoxycarbonylamino group, an aryloxycarbonylamino group, an alkoxycarbonyl group, an aryloxycarbonyl group, an alkylthio group, an arylthio group or a heterocyclicthio group.

Also, at least two of said $R_9$, $R_{10}$ and $R_{11}$, for example, $R_9$ and $R_{10}$ may be bonded together to form a saturated or unsaturated ring (e.g. cycloalkane ring, cycloalkene ring or heterocyclic ring), and further to form a bridged hydrocarbon compound residual group by bonding $R_{11}$ to said ring.

The groups represented by $R_9$ to $R_{11}$ may have substituents, and examples of the groups represented by $R_9$ to $R_{11}$ and the substituents which may be possessed by said groups may include examples of the substituents which may be possessed by the R in the above formula (I), and substituents which may be possessed by said substituents.

Also, examples of the ring formed by bonding between $R_9$ and $R_{10}$, the bridged hydrocarbon compound residual group formed by $R_9$ to $R_{11}$ and the substituents which may be possesed thereby may include examples of cycloalkyl, cycloalkenyl and heterocyclic groups as mentioned for substituents on the R in the aforesaid formula (I) and substituents thereof.

Of the compounds of the formula (XIII), preferred are:

(i) the case where two of $R_9$ to $R_{11}$ are alkyl groups; and (ii) the case where one of $R_9$ to $R_{11}$, for example, $R_{11}$ is a hydrogen atom and two of the other $R_9$ and $R_{10}$ are bonded together with the root carbon atom to form a cycloalkyl group.

Further, preferred in (i) is the case where two of $R_9$ to $R_{11}$ are alkyl groups and the other one is a hydrogen atom or an alkyl group.

Here, said alkyl and said cycloalkyl may further have substituents, and examples of said alkyl, said cycloalkyl and substituents thereof may include those of alkyl, cycloalkyl and substituents thereof as mentioned for the substituents on the R in the formula (I) and the substituents thereof.

The substituent which may possessed by the ring formed by Z in the formula (I) and $Z_1$ in the formula (XII), and $R_2$ to $R_8$ in the formulae (VI) to (X) may be preferably those represented by the following formula (XIV):

$$-R^1-SO_2-R^2 \qquad \text{(XIV)}$$

wherein $R^1$ represents an alkylene group and $R^2$ represents an alkyl group, a cycloalkyl group or an aryl group.

The alkylene represented by $R^1$ may preferably one, of which the straight moiety has carbon atoms of 2 or more, more preferably 3 to 6, and may be either straight or branched, this alkylene may also have a substituent.

Examples of said substituent include those mentioned above for the alkyl group of R in the above formula (I).

A phenyl is preferred as the substituent.

Specific preferable examples of the alkylene shown by $R_1$ are shown below.

$-CH_2CH_2CH_2-$, $-\underset{\underset{CH_3}{|}}{C}HCH_2CH_2-$, $-\underset{\underset{C_2H_5}{|}}{C}HCH_2CH_2-$, $-CH_2CH_2\underset{\underset{C_7H_{15}}{|}}{C}H-$, $-CH_2CH_2\underset{\underset{C_2H_5}{|}}{C}H-$, $-CH_2CH_2CH_2CH_2-$, $-CH_2CH_2CH_2\underset{\underset{C_6H_{13}}{|}}{C}H-$, $-CHCH_2CH_2-$,

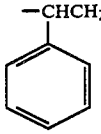

$-\overset{\overset{CH_3}{|}}{\underset{\underset{CH_3}{|}}{C}}-CH_2CH_2-$.

The alkyl group represented by $R^2$ may be either straight or branched.

Specifically, there may be included methyl, ethyl, propyl, iso-propyl, butyl, 2-ethylhexyl, octyl, dodecyl, tetradecyl, hexadecyl, octadecyl, 2-hexyldecyl and the like.

The cycloalkyl group represented by $R^2$ may be preferably 5- to 6-membered group, as exemplified by cyclohexyl.

The alkyl and cycloalkyl represented by $R_2$ may have substituents and their examples may include those as exemplified as the substituents for $R^1$ as described above.

The aryl represented by $R^2$ may include specifically phenyl, naphthyl. Said aryl group may have substituents. Examples of said substituents may include straight or branched alkyls, or otherwise those exemplified above as the substituents for $R^1$.

When there are two or more substituents, those substituents may be either the same or different.

Of the compounds represented by the formula (I), particularly preferred are those represented by the following formula (XV).

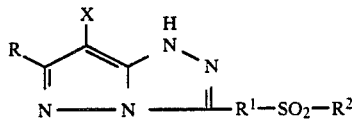

(XV)

wherein

R, X are the same as R, X in the formula (I), $R^1$, $R^2$ are the same as $R^1$ and $R^2$ in the formula (XIV).

In the following, examples of the magenta coupler of the present invention are enumerated, which are not limitative of the present invention.

1

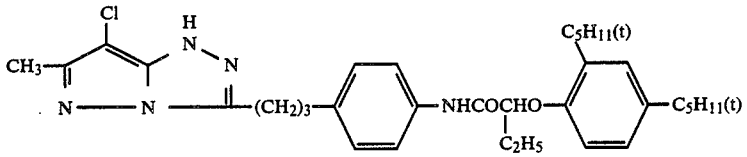

2

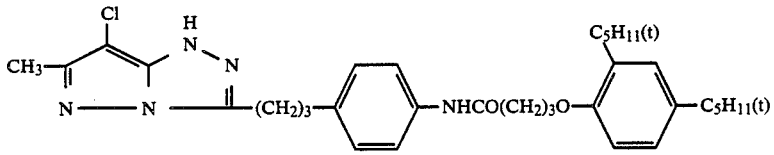

3

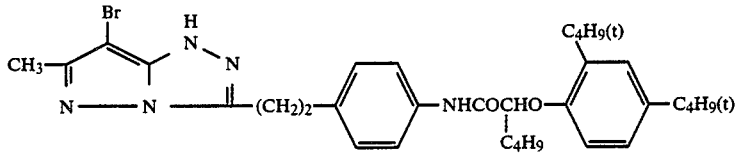

4

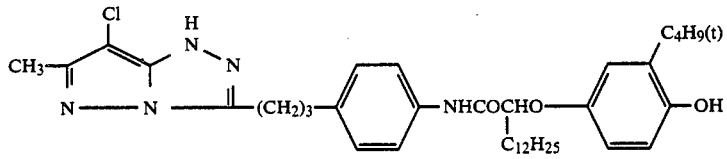

5

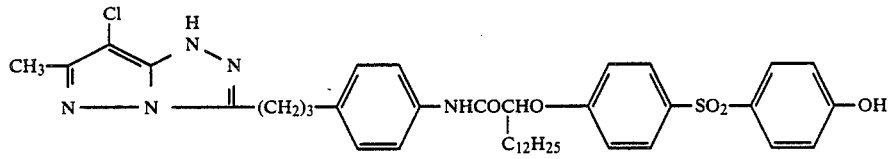

-continued
6
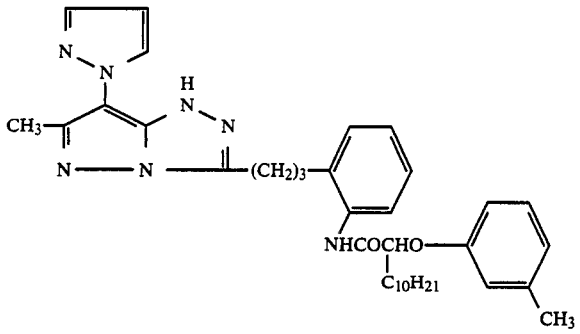
7
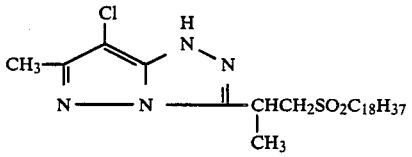
8
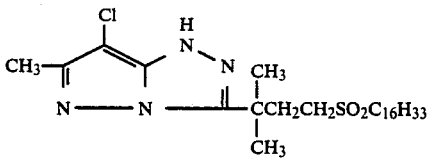
9
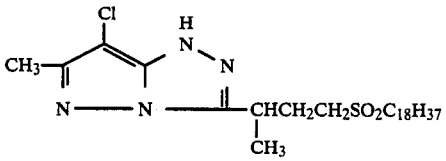
10
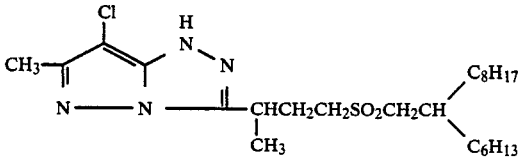
11
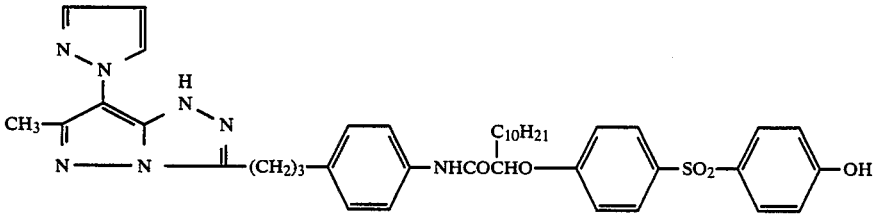
12
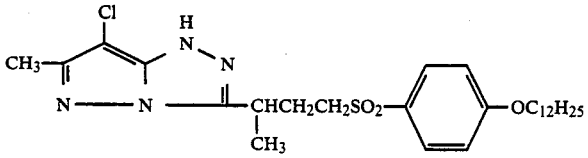
13
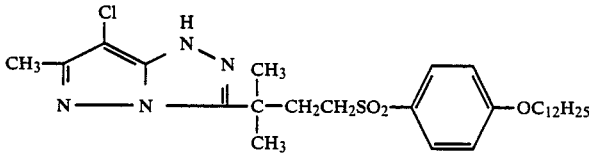

-continued
14
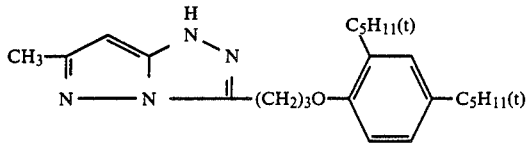
15
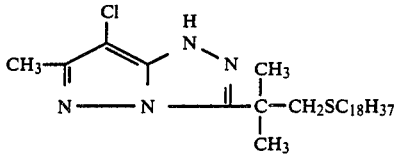
16
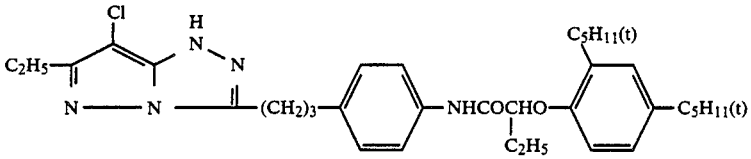
17
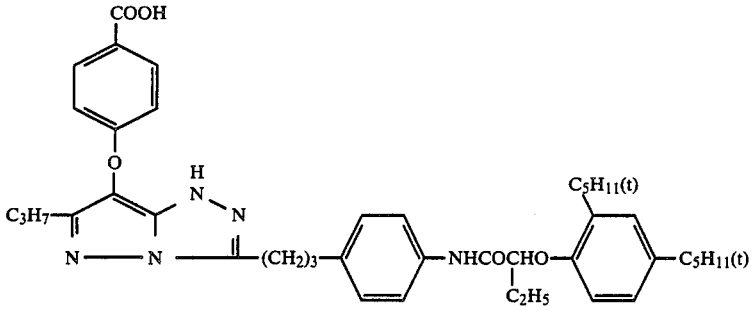
18
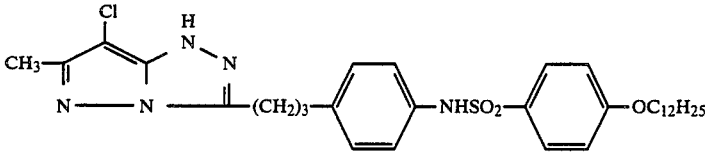
19
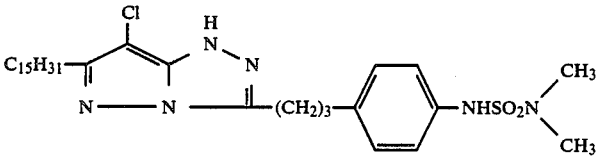
20
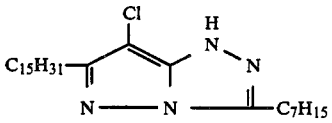
21
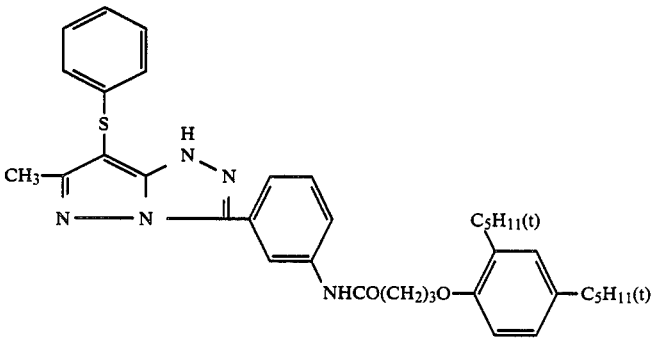

-continued
22
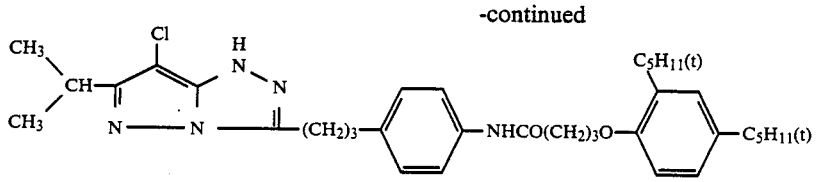
23
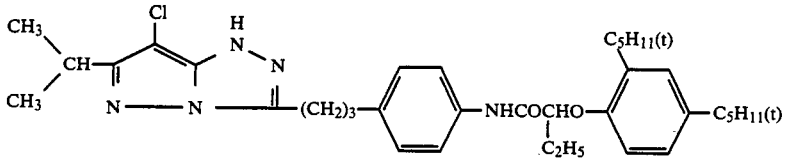
24
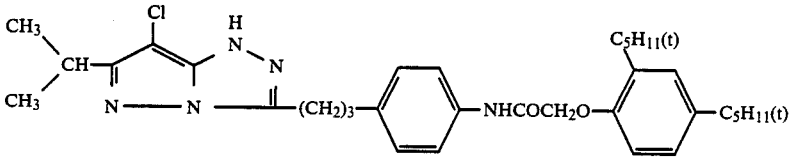
25
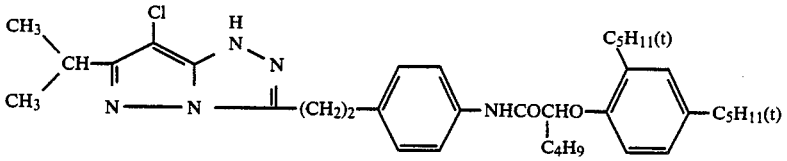
26
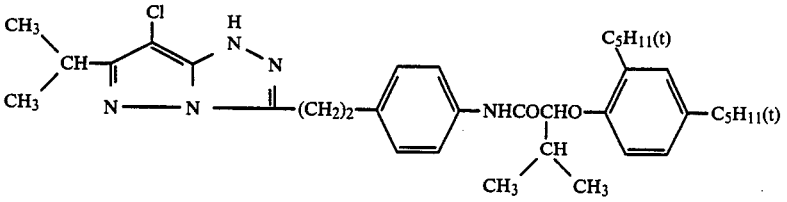
27
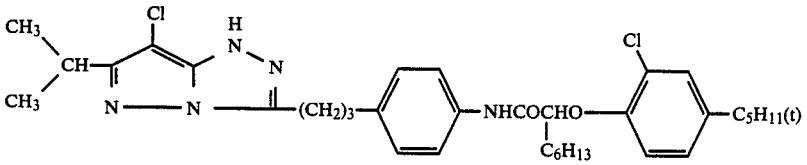
28
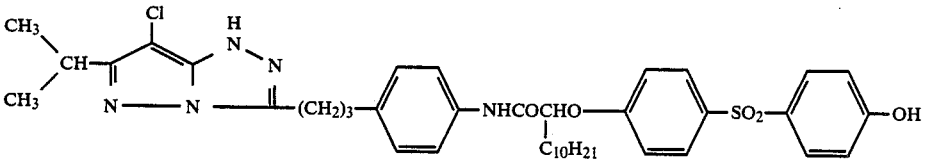
29
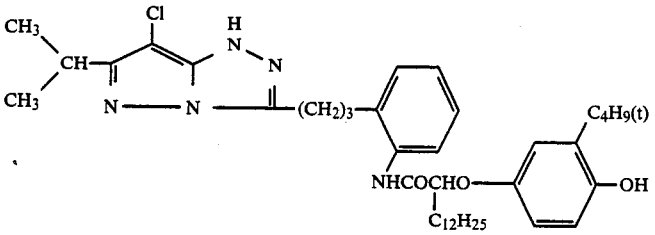
30
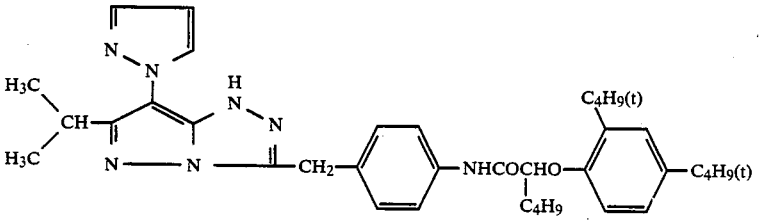

-continued
31
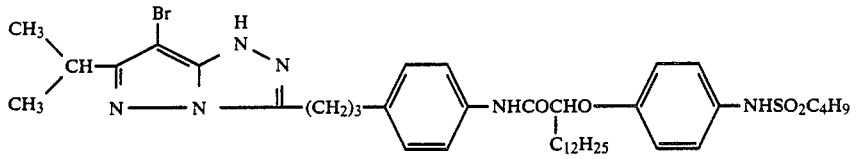
32
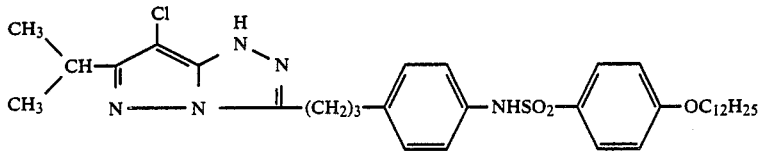
33
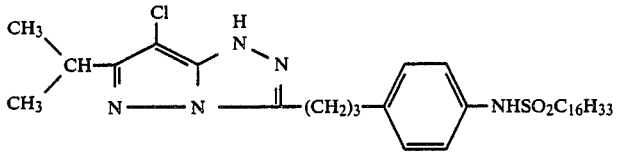
34
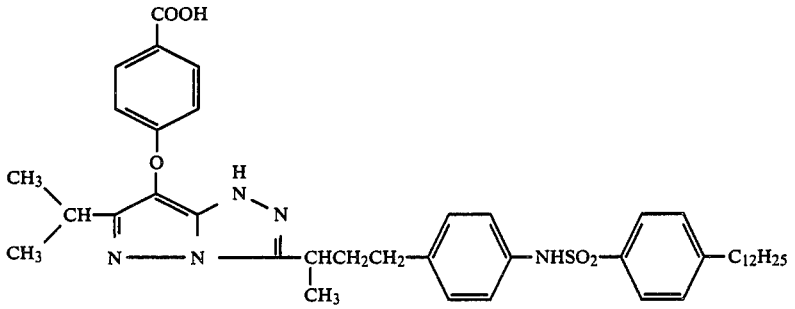
35
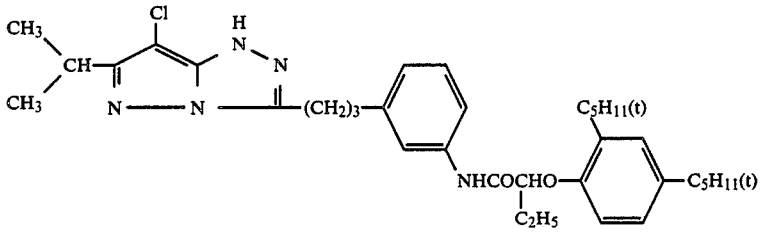
36
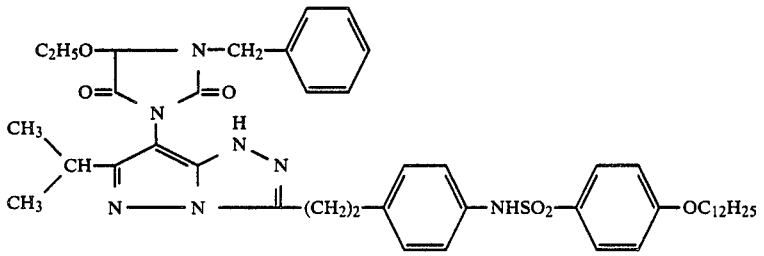

-continued
37
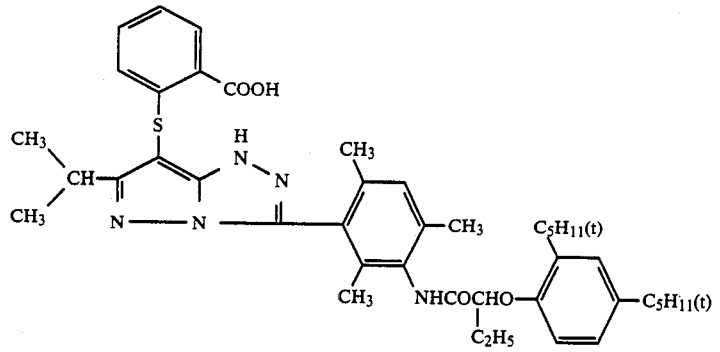
38
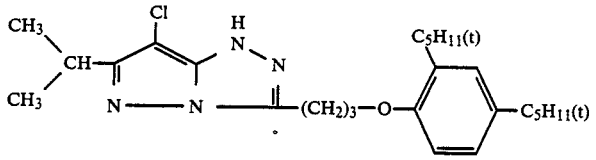
39
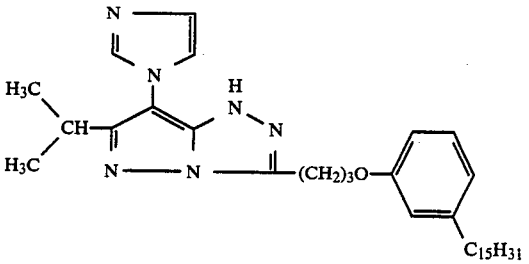
40
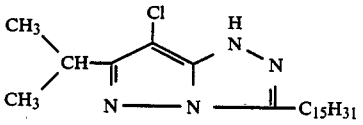
41
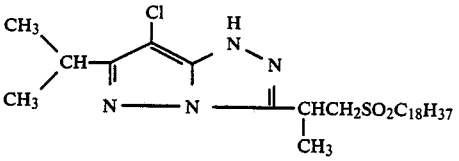
42
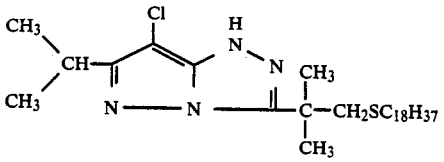
43
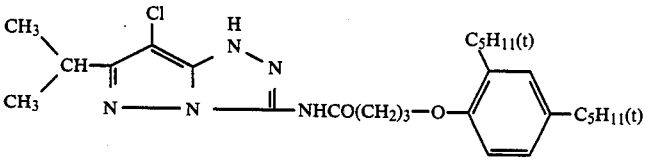
44
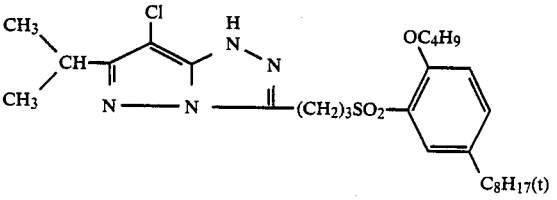

-continued
45
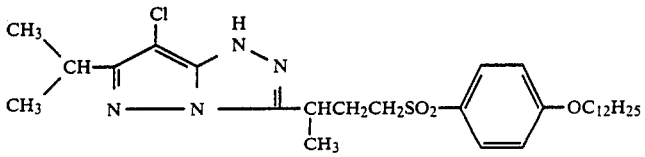
46
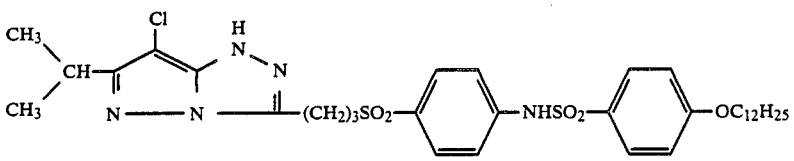
47
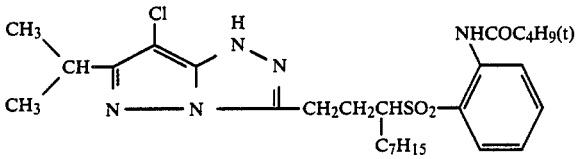
48
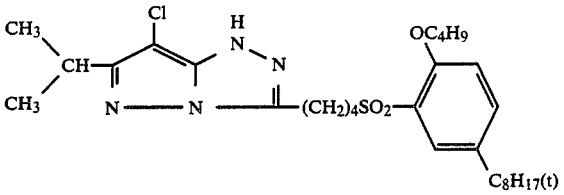
49
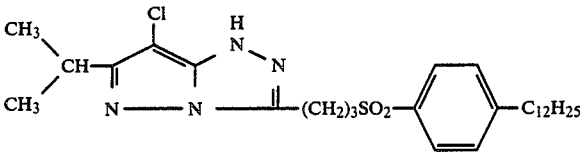
50
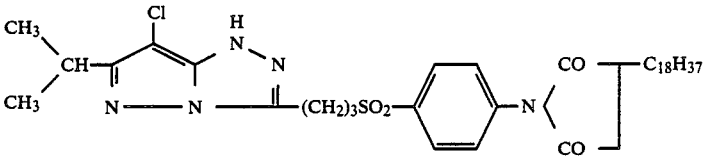
51
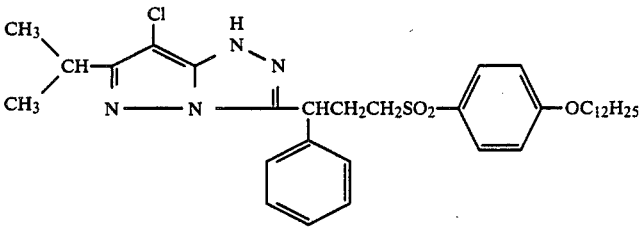
52
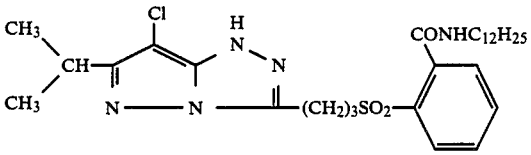
53
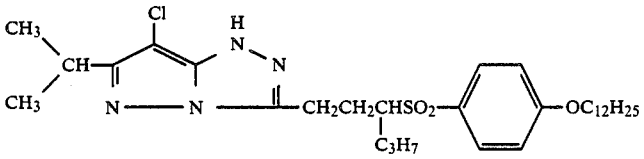

-continued
54
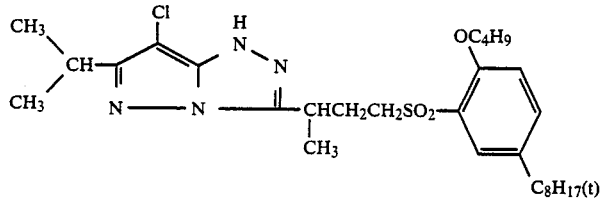
55
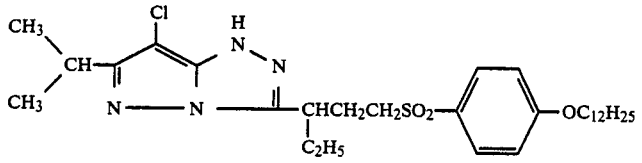
56
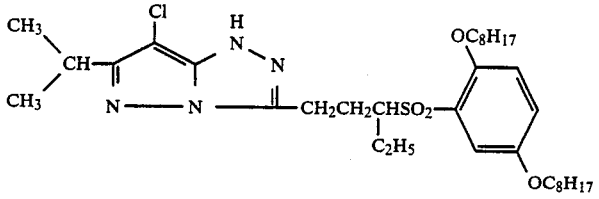
57
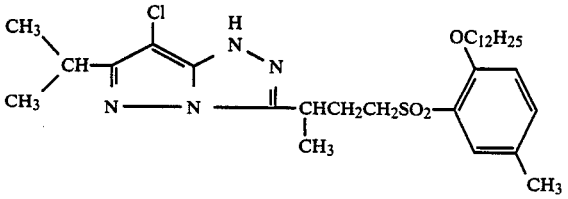
58
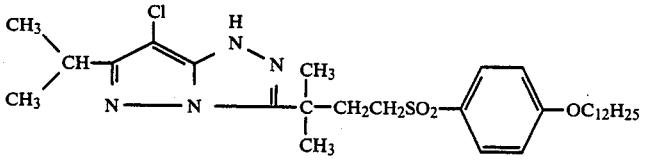
59
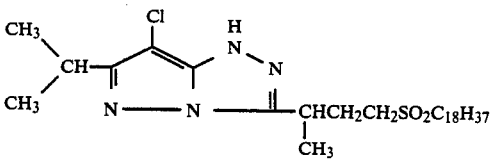
60
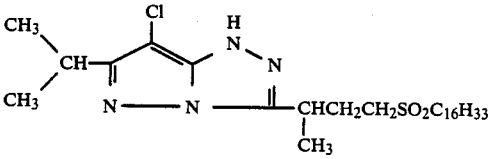
61
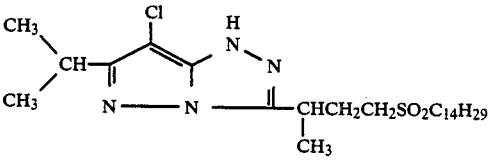
62
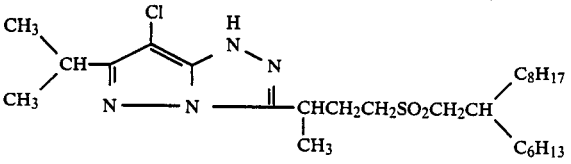

-continued
63
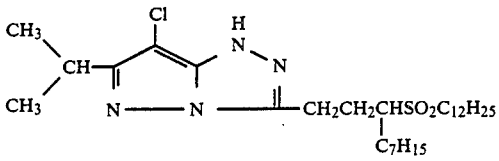
64
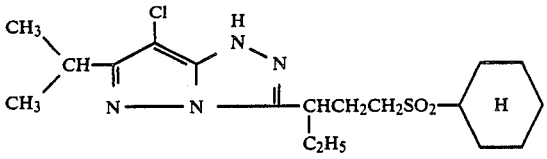
65
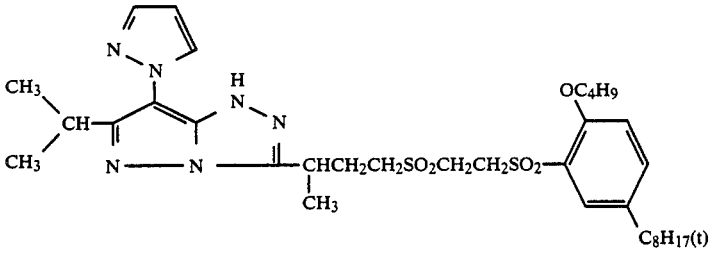
66
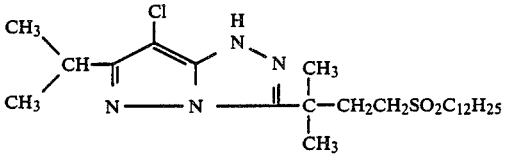
67
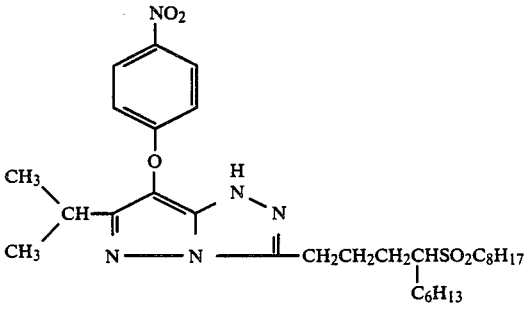
68
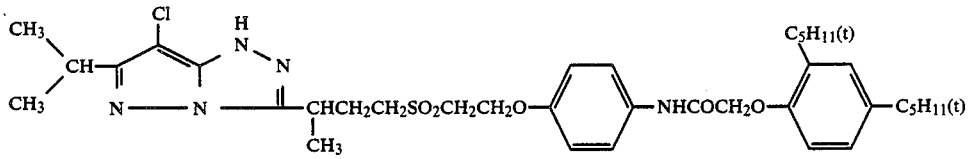
69
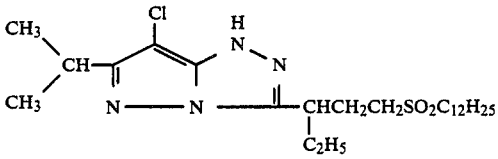
70
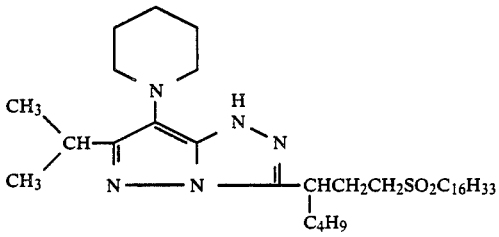

-continued
71
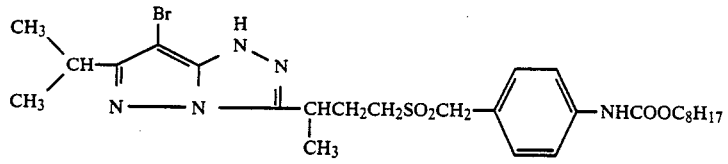
72
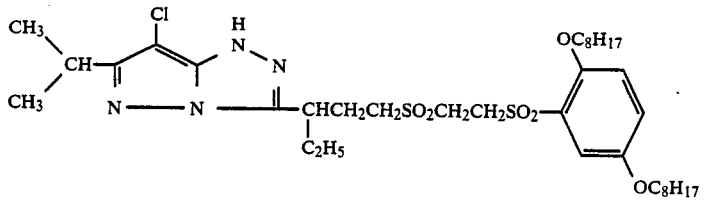
73
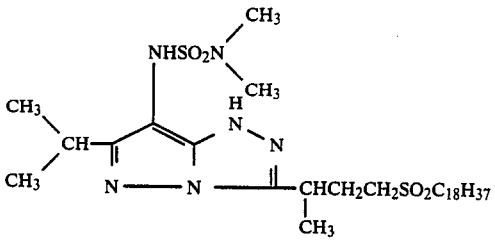
74
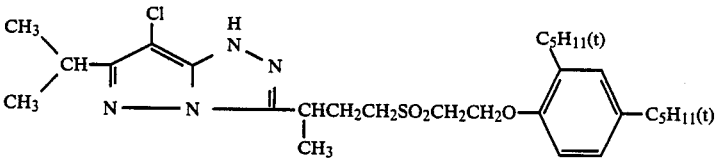
75
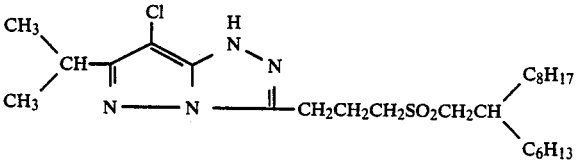
76
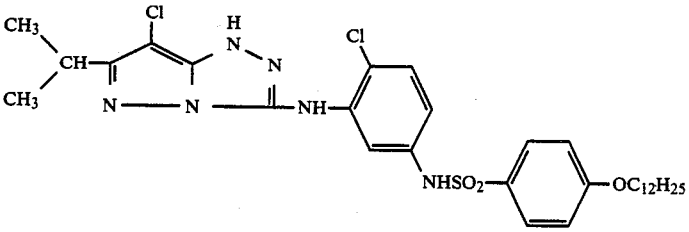
77
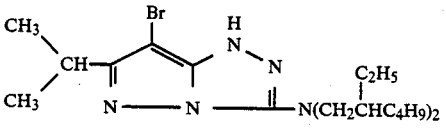
78
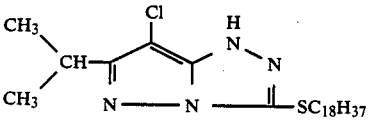
79
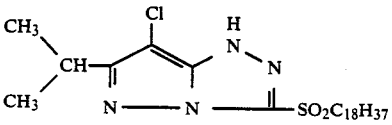

-continued
80
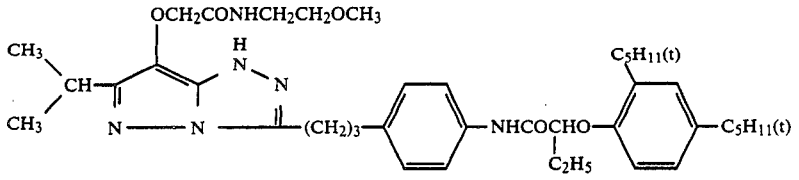
81
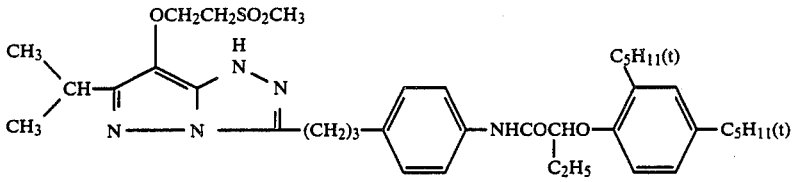
82
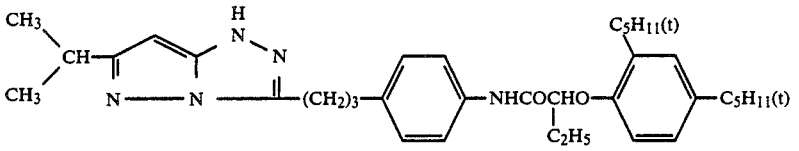
83
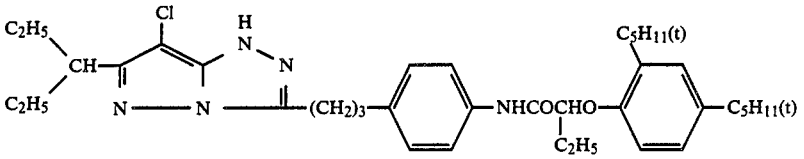
84
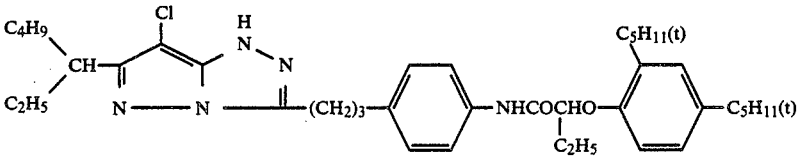
85
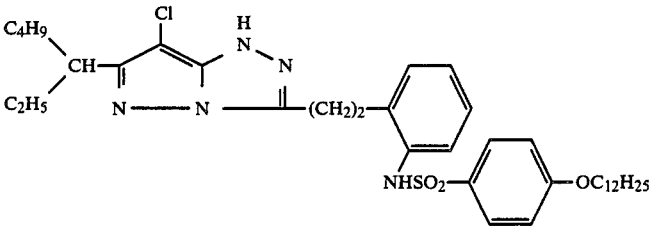
86
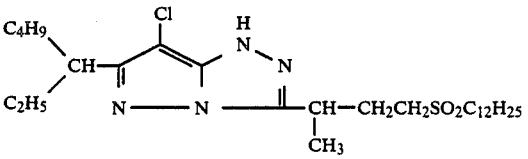
87
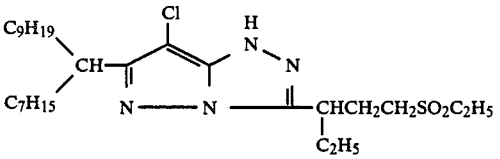
88
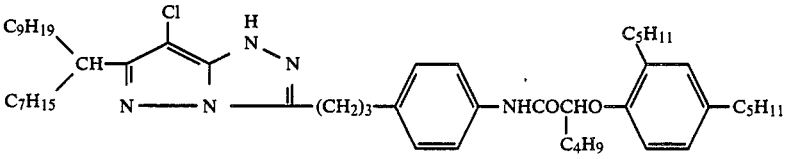

-continued
89
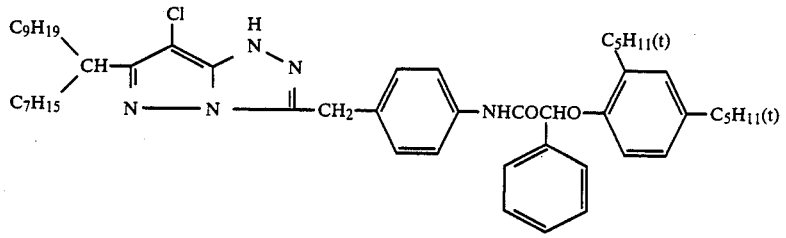
90
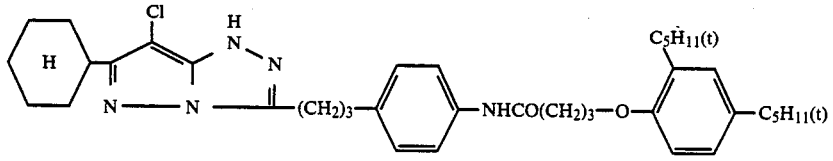
91
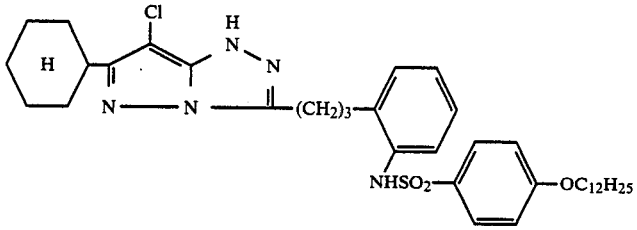
92
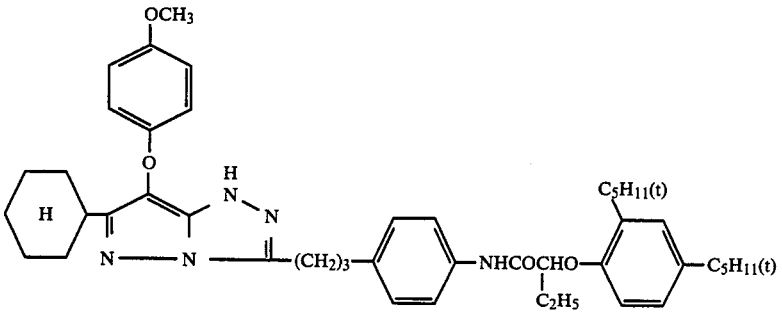
93
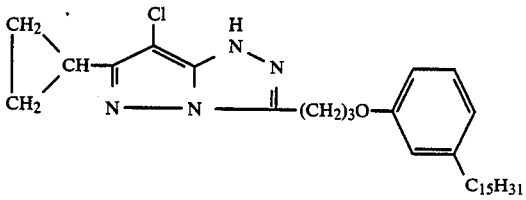
94
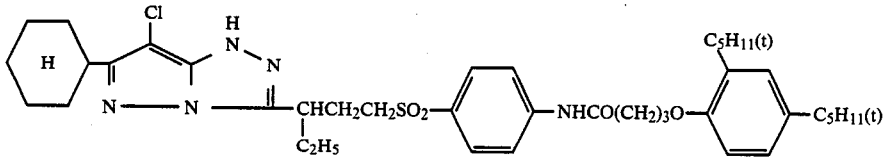
95
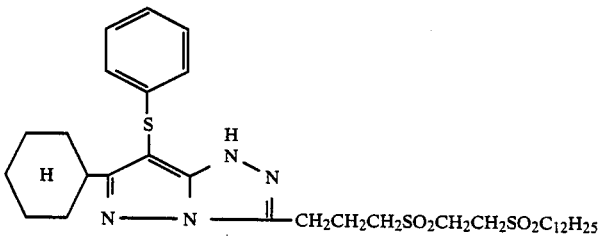

-continued
96
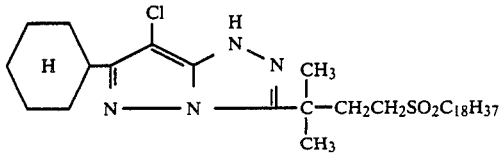
97
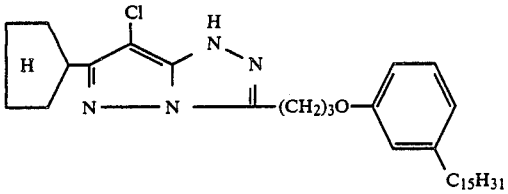
98
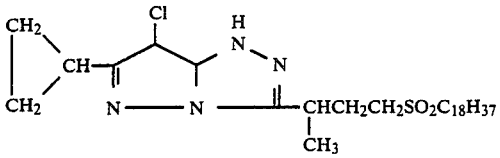
99
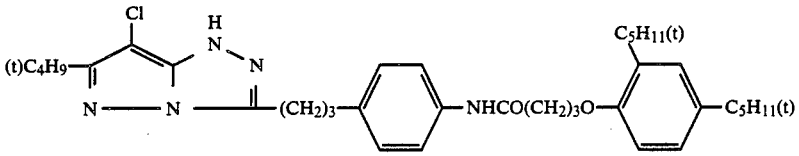
100
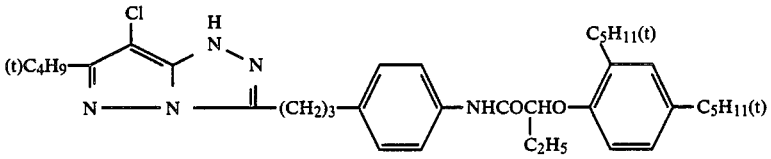
101
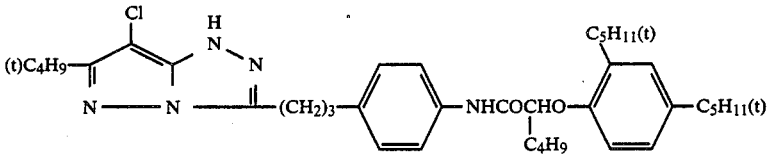
102
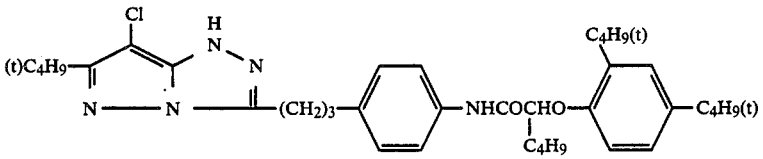
103
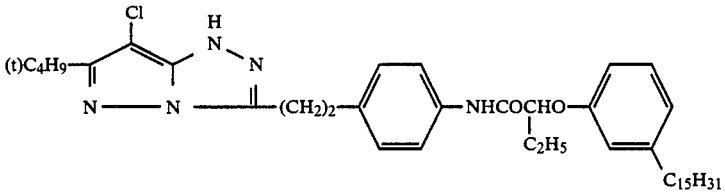
104
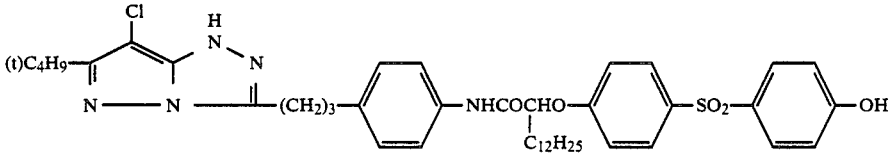

-continued
105
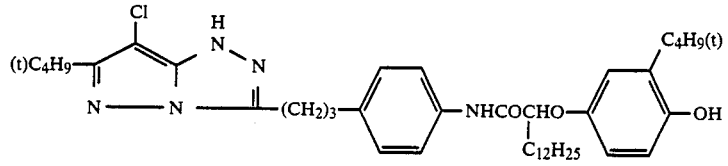
106
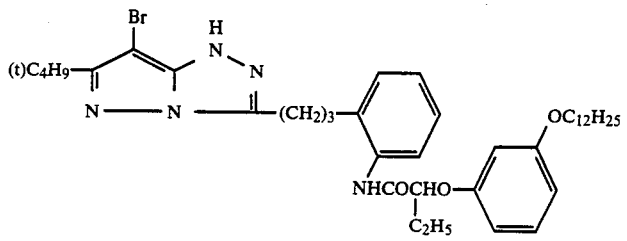
107
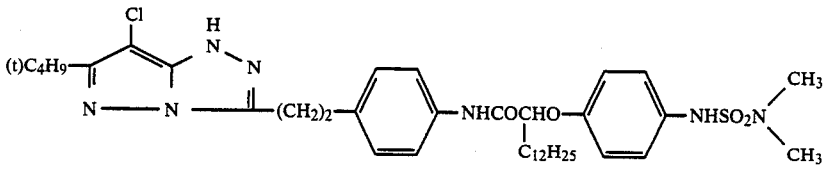
108
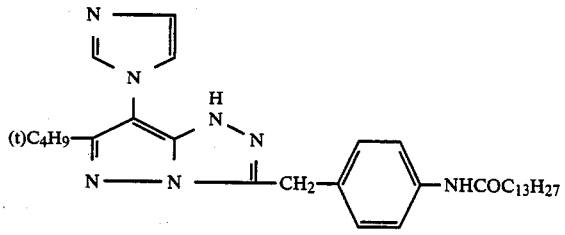
109
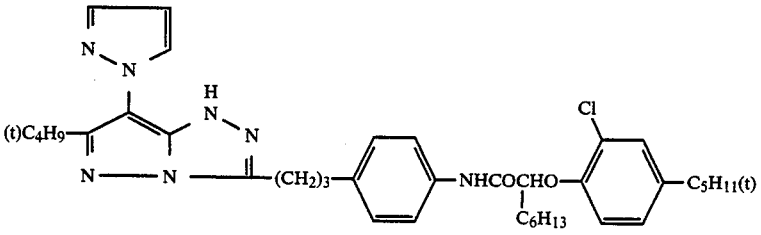
110
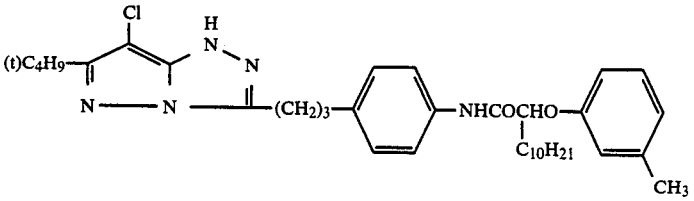
111
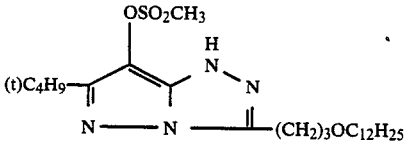
112
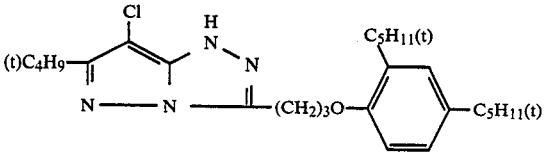

-continued
113
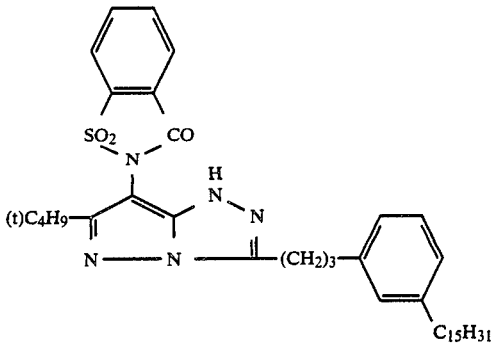
114
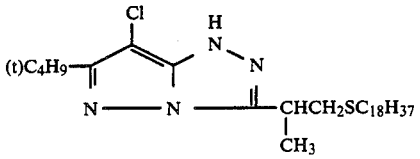
115
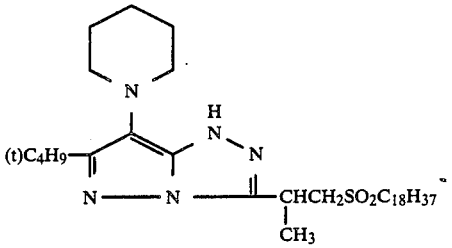
116
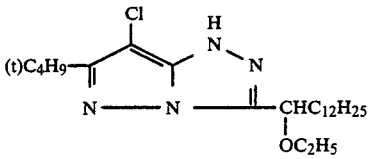
117
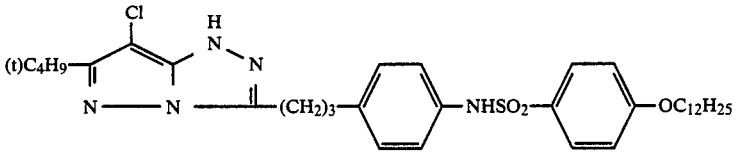
118
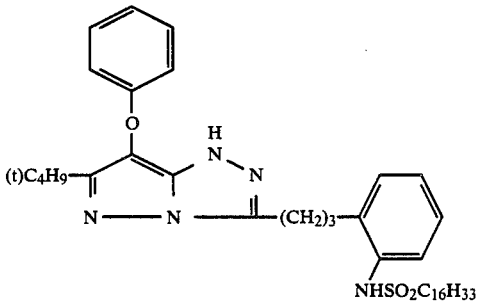
119
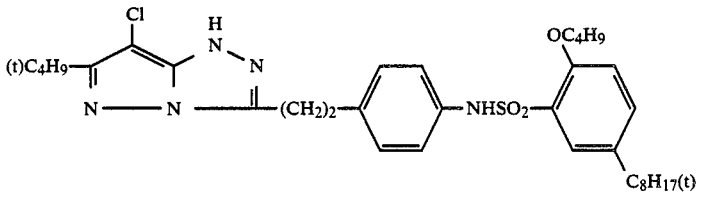

-continued
120
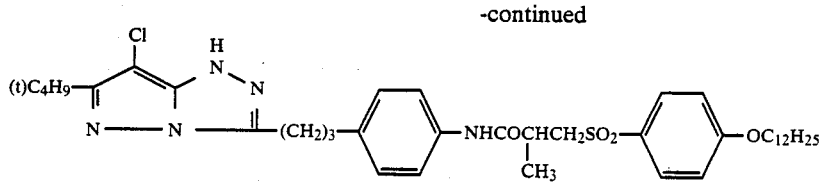
121
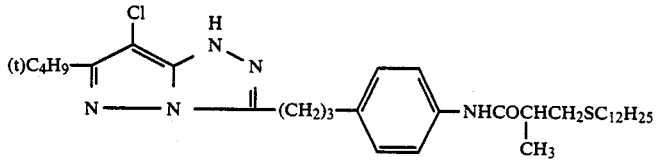
122
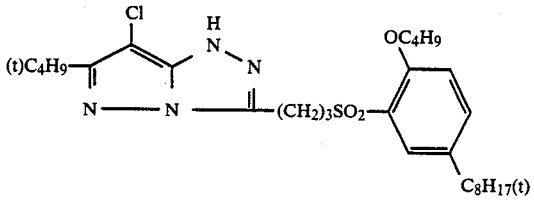
123
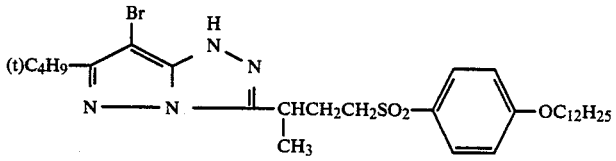
124
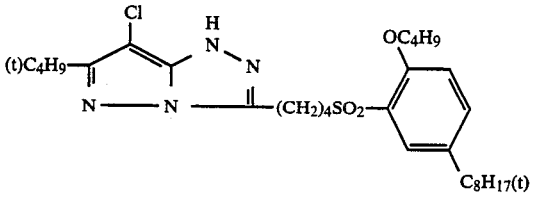
125
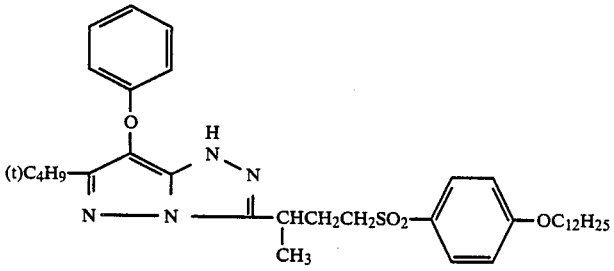
126
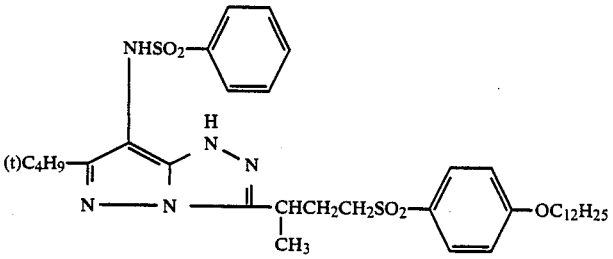
127
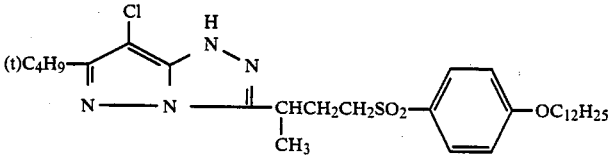

-continued
128
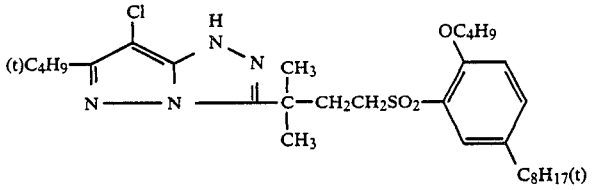
129
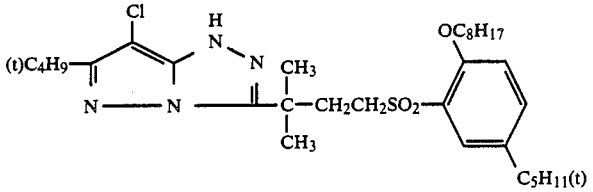
130
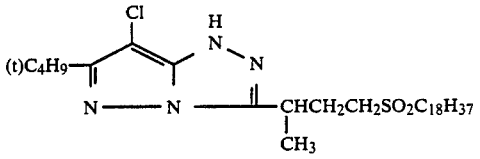
131
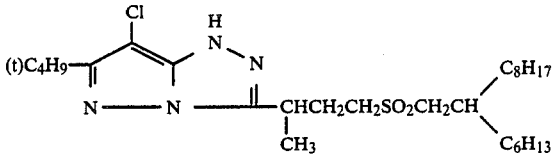
132
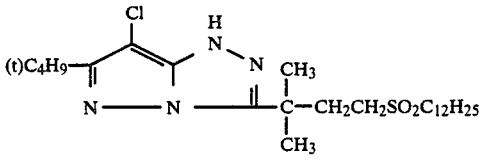
133
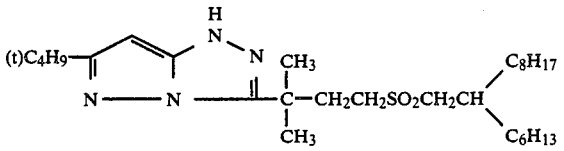
134
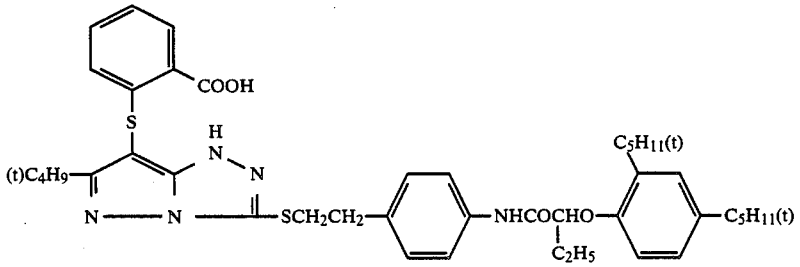
135
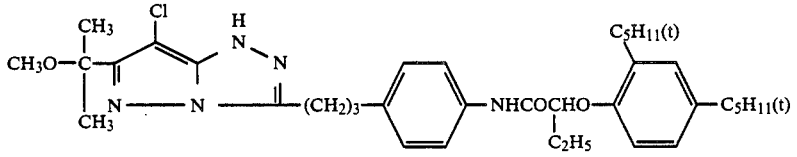

-continued
136
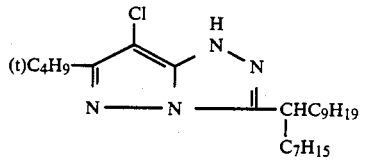
137
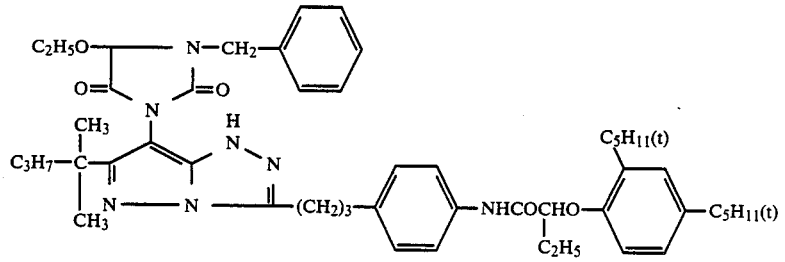
138
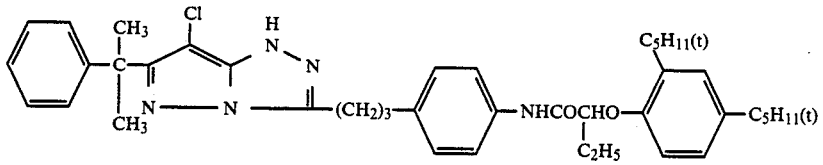
139
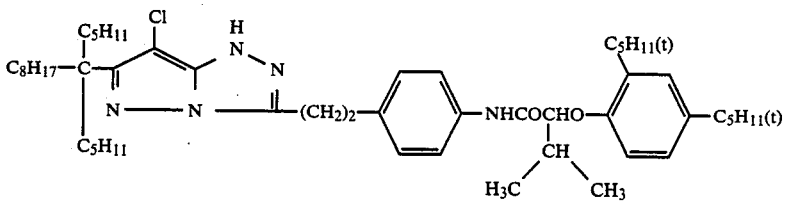
140
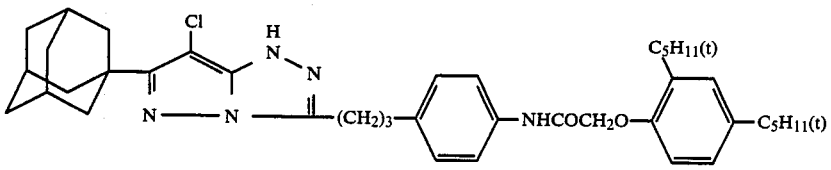
141
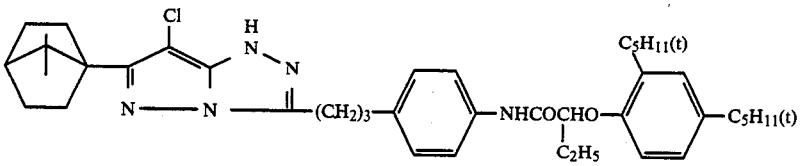
142
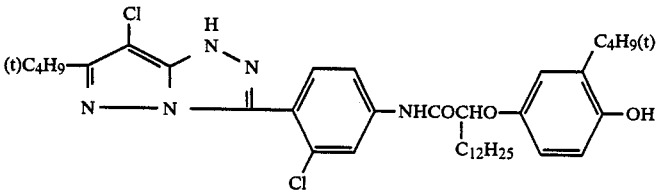
143
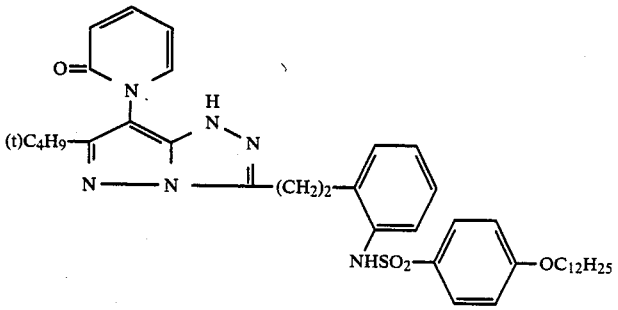

-continued
144
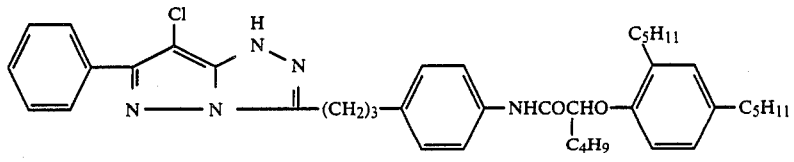
145
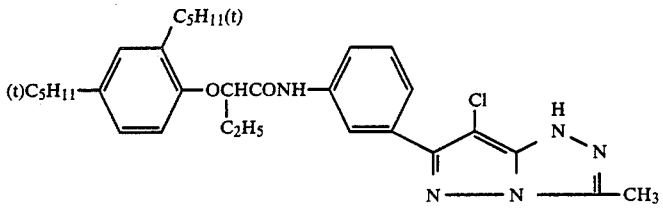
146
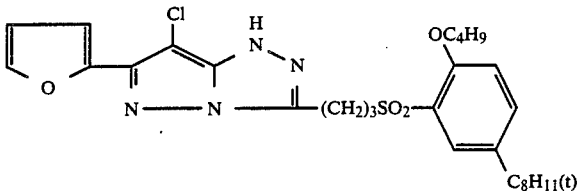
147
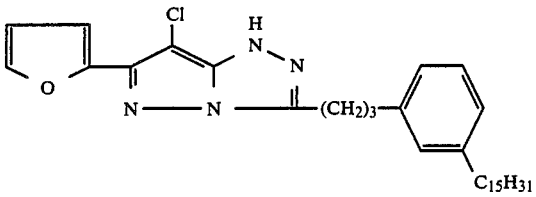
148
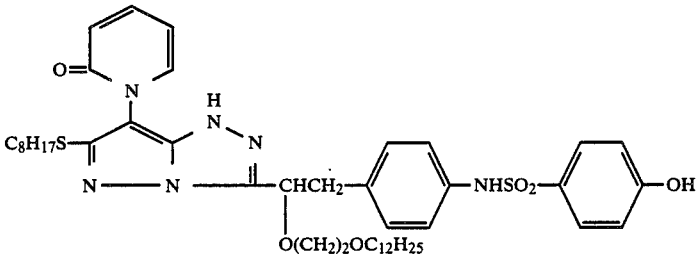
149
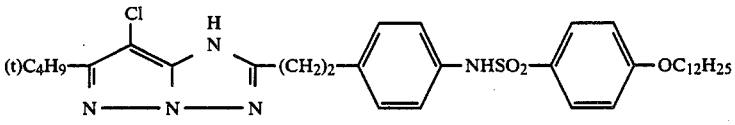
150
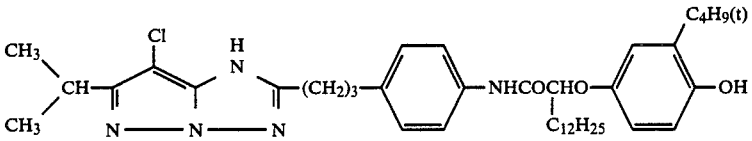
151
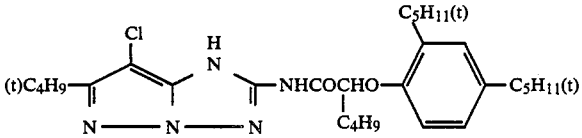
152
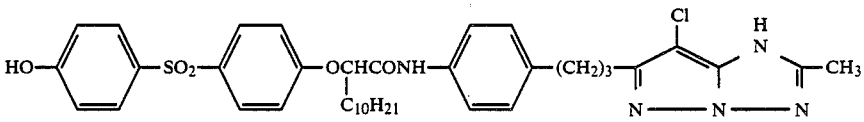

-continued
153
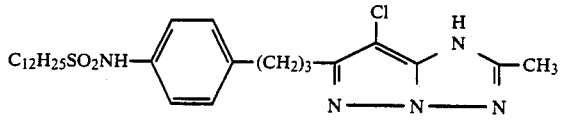
154
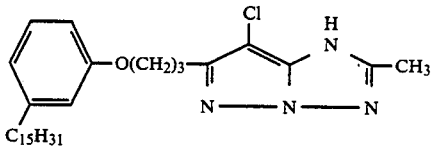
155
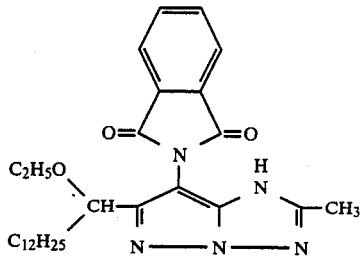
156
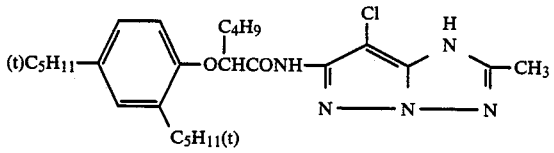
157
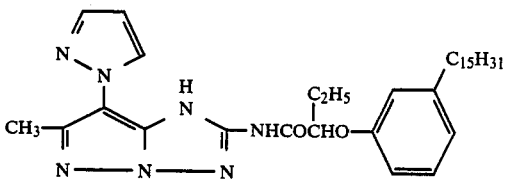
158
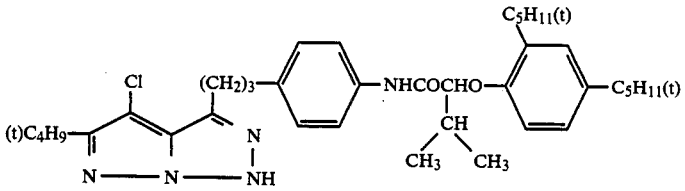
159
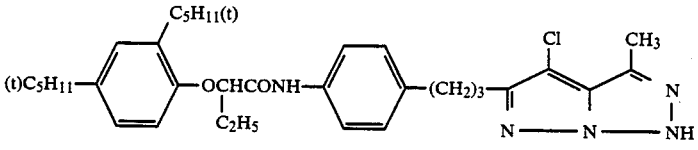
160
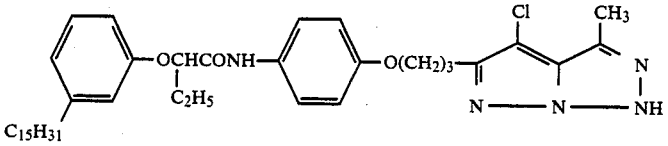

-continued
161
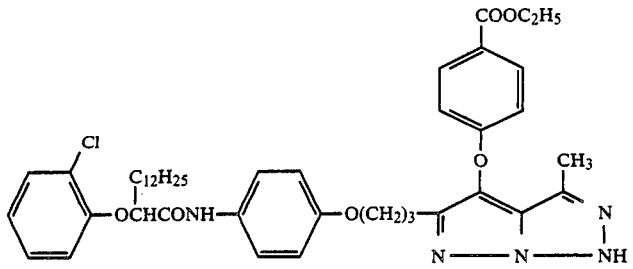
162
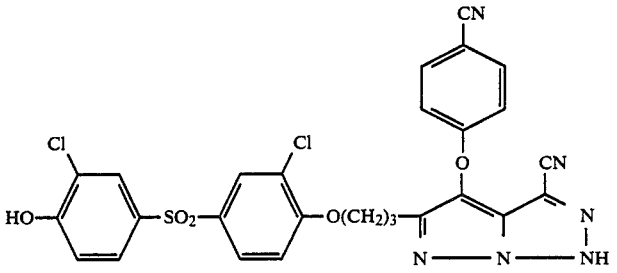
163
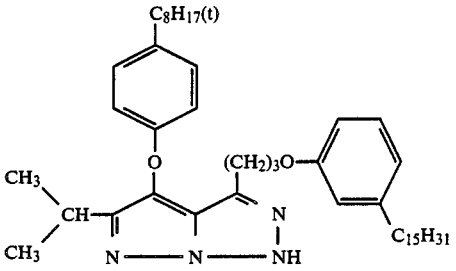
164
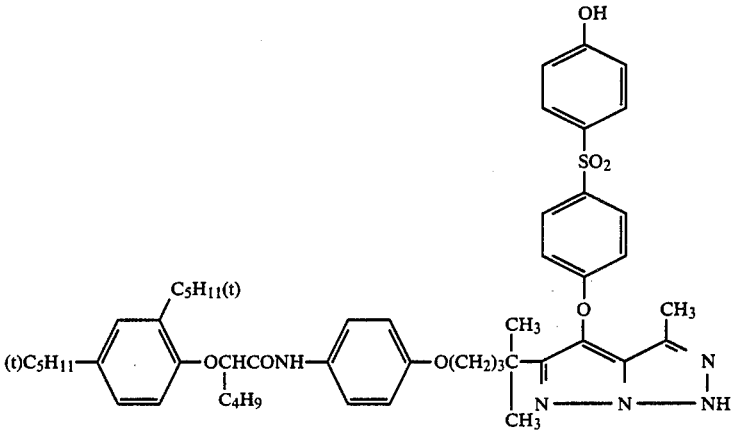
165
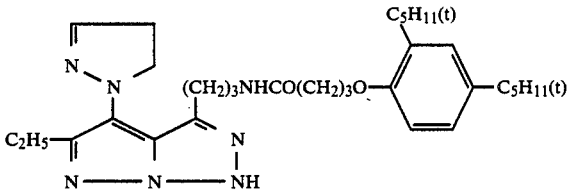
166
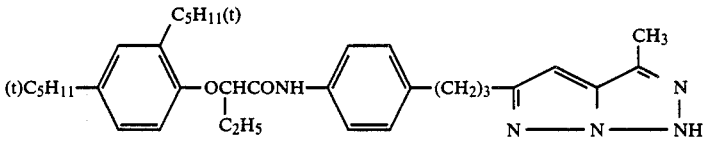

-continued
167
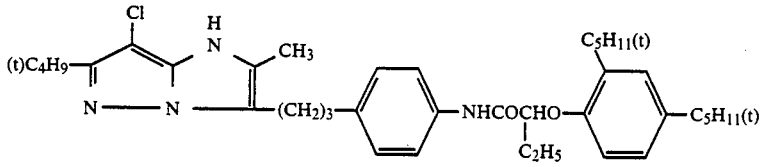
168
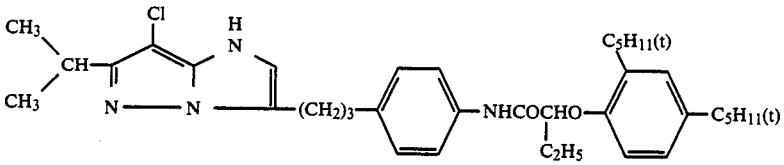
169
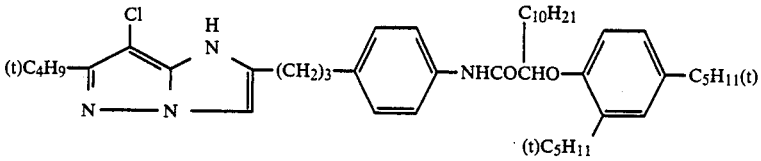
170
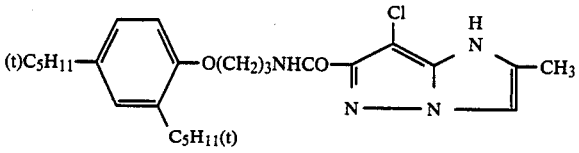
171
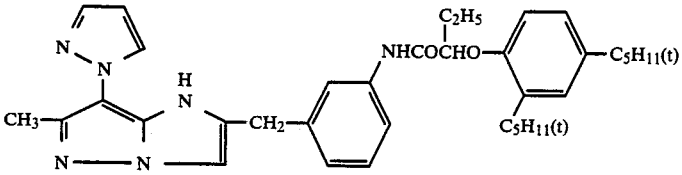
172
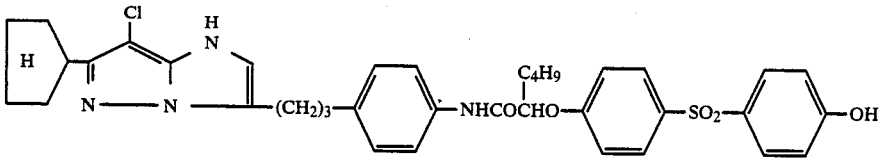
173
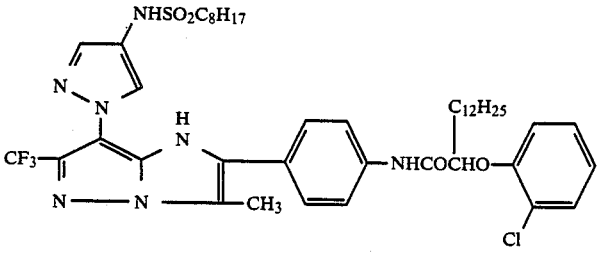
174
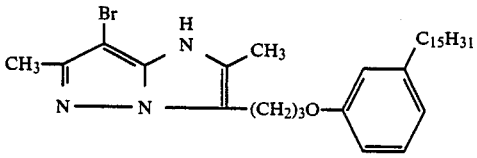
175
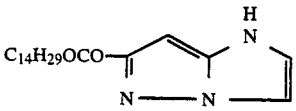

-continued
176
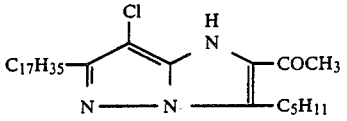
177
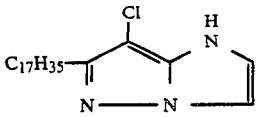
178
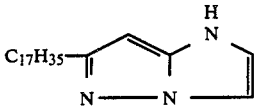
179
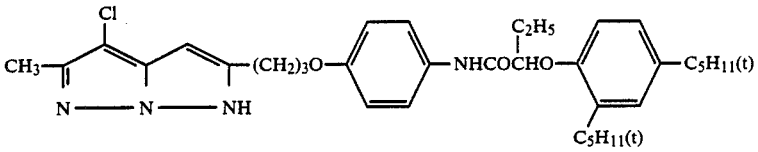
180
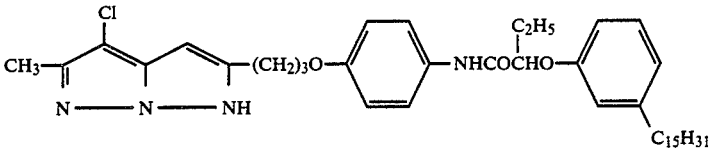
181
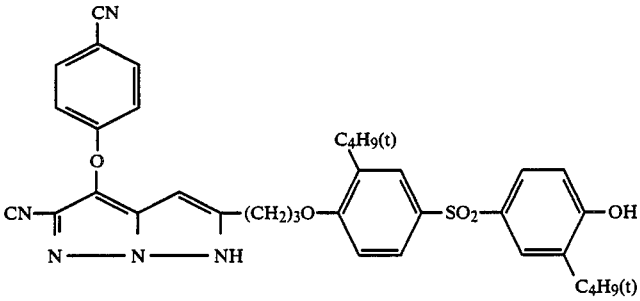
182
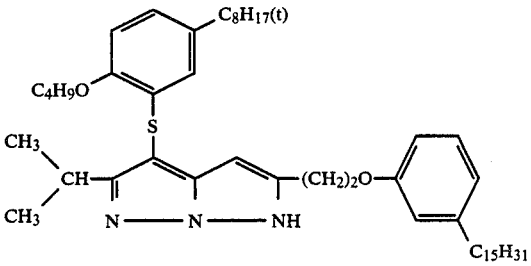
183
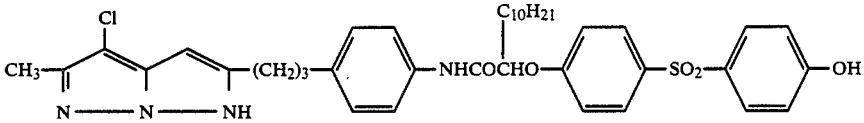
184
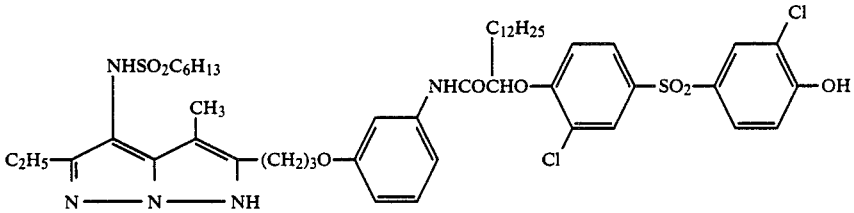

-continued
185
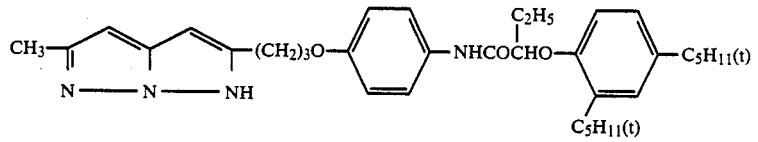
186
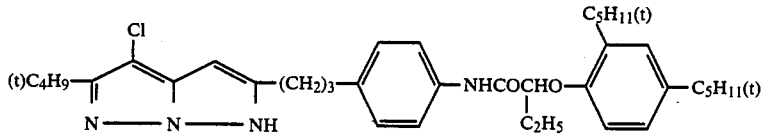
187
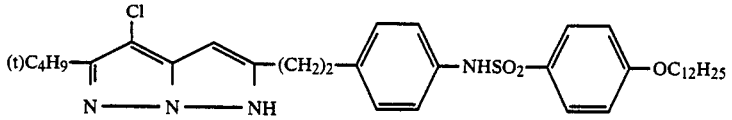
188
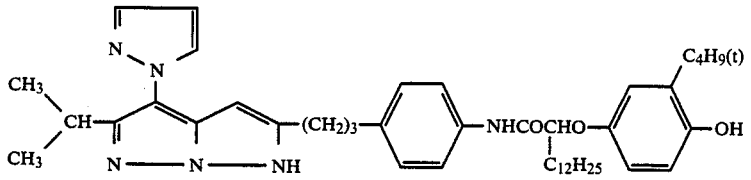
189
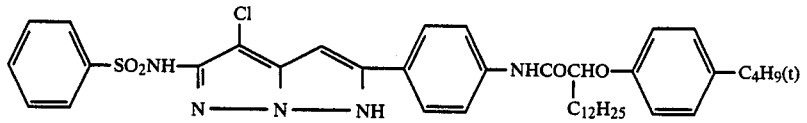
190
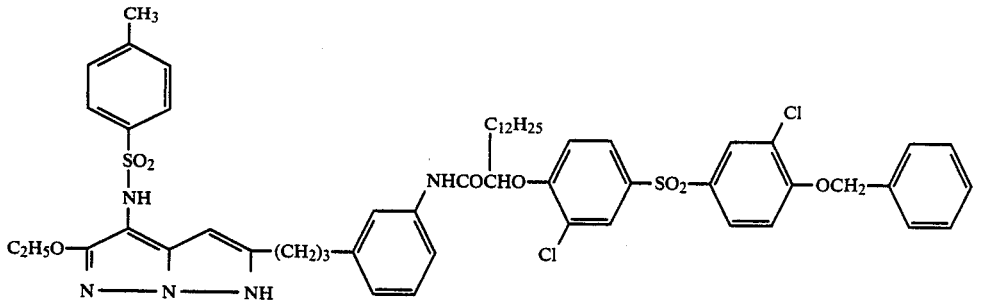
191
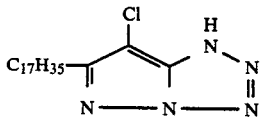
192
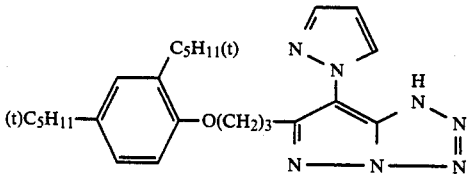
193
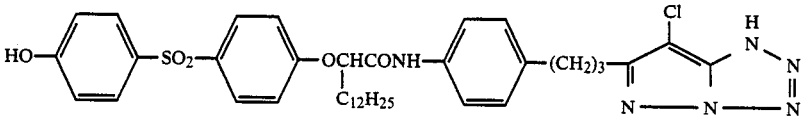

-continued

194

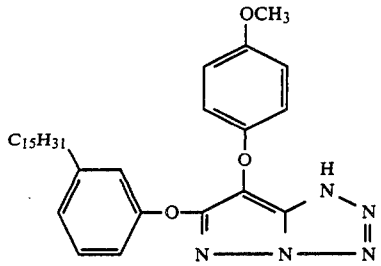

195

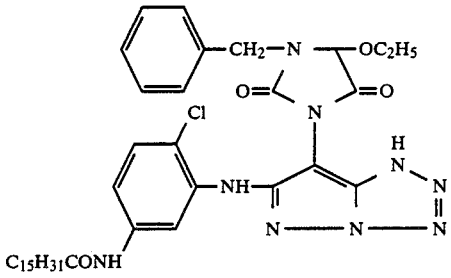

196

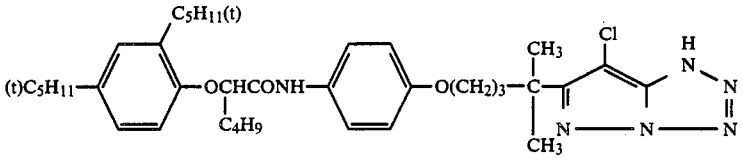

197

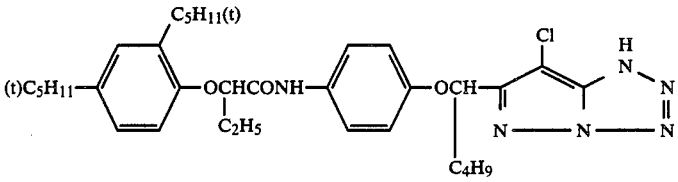

198

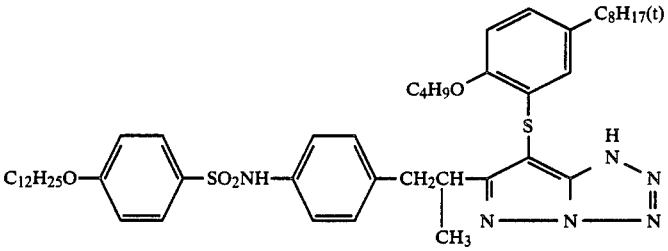

199

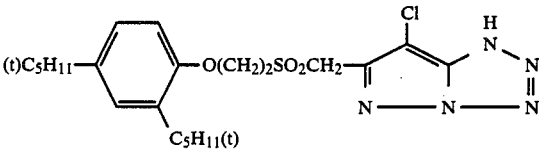

The above coupler was synthesized with reference to Journal of the Chemical Society, Perkin I, 1977, 2047 to 2052, U.S. Pat. No. 3,725,067, Japanese Unexamined Patent Publications Nos. 99437/1984 and 40245/1983.

The coupler of the present invention can be used in an amount within the range generally from $1\times10^{-1}$ mole to 1 mole, preferably $1\times10^{-2}$ mole to $8\times10^{-1}$ mole per 1 mole of silver halide.

The coupler of the present invention can also be used in combination with other kinds of magenta couplers or only other kinds of magenta couplers.

Also, in the case when the light-sensitive silver halide photographic material according to the present invention is used as a multi-color photographic material yellow couplers, cyan couplers conventionally used in this field of art can be used in usual manner in addition to the coupler of the present invention. If necessary, a colored coupler having the effect of color correction or a coupler capable of releasing a development inhibitor with the progress of development (DIR coupler) may also be used. Two or more kinds of the above coupler may be used in combination in the same layer in order to satisfy the characteristics demanded for the light-sensitive material, or alternatively the same compound may be added in two or more layers.

The cyan coupler and the yellow coupler usable in the present invention may include phenol type or naphtol type cyan couplers and acylacetoamide type or benzoylmethane type yellow couplers, respectively.

Examples of yellow couplers include those disclosed in U.S. Pat. No. 2,778,658, No. 2,875,057, No. 2,908,573, No. 3,227,155, No. 3,227,550, No. 3,253,924, No. 3,265,506, No. 3,277,155, No. 3,341,331, No. 3,369,895, No. 3,384,657, No. 3,408,194, No. 3,415,652, No. 3,447,928, No. 3,551,155, No. 3,582,322, No. 3,725,072, No. 3,984,875; West German Patents (OLS) No. 1,547,868, No. 2,057,941, No. 2,162,899, No. 2,163,812, No. 2,218,461, No. 2,219,917, No. 2,261,361, No. 2,263,875; Japanese Patent Publication No. 13576/1974; Japanese Provisional Patent Publication No. 29432/1973, No. 66834/1973, No. 10736/1974, No. 122335/1974, No. 28834/1975 and No. 132926/1975.

As cyan couplers and yellow couplers to be used in the present invention, phenol type or naphthol type cyan couplers and acylacetamide type or benzoylmethane type yellow couplers can be used, respectively.

Examples of the cyane coupler include those disclosed in U.S. Pat. No. 2,369,929, No. 2,423,730, No. 2,434,272, No. 2,474,293, No. 2,698,794, No. 2,706,684, No. 2,772,162, No. 2,801,171, No. 2,895,826, No. 2,908,537, No. 3,034,892, No. 3,046,129, No. 3,227,550, No. 3,253,294, No. 3,311,476, No. 3,386,301, No. 3,419,390, No. 3,458,315, No. 3,476,563, No. 3,516,831, No. 3,560,212, No. 3,582,322, No. 3,583,971, No. 3,591,383, No. 3,619,196, No. 3,632,347, No. 3,652,286, No. 3,737,326, No. 3,758,308, No. 3,779,763, No. 3,839,044, No. 3,880,661; West German Patents (OLS) No. 2,163,811, No. 2,207,468; Japanese Patent Publications No. 27563/1964 and No. 28836/1970; Japanese Provisional Patent Publications No. 37425/1972, No. 10135/1975, No. 25288/1975, No. 112038/1975, No. 117422/1975, No. 130441/1975, No. 109630/1978, No. 65134/1981, No. 99341/1981 and Research Disclosure No. 14,853 (1976).

As the examples of the couplers to be used in the present invention, there may include a yellow coupler represented by the following formula (XVI), a magenta coupler represented by the following formula (XVII) and a cyan coupler represented by the following formula (XVIII):

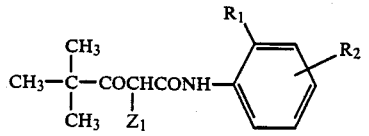

(XVI)

wherein $R_1$ represents a hydrogen atom, a halogen atom or an alkoxy group; $R_2$ represents a group represented by $-NHCOR_{21}$, $-NHSO_2R_{21}$, $-COOR_{21}$ or $$-SO_2\underset{R_{22}}{\underset{|}{N}}-R_{21}$$

(where $R_{21}$ and $R_{22}$ each represent an alkyl group which may have a substituent of substituents); and $Z_1$ represents an atom or a group eliminable through coupling,

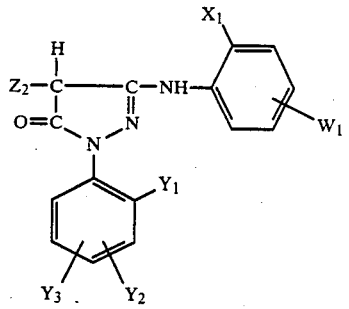

(XVII)

wherein $X_1$ represents a hydrogen atom, a halogen atom, analkyl group, an aryl group, an alkoxy group, an aryloxy group, an amide group, a hydroxy group, an amino group or a nitro group;

$Y_1$, $Y_2$ and $Y_3$ each represent a hydrogen atom, a halogen atom, an alkyl group, an alkoxy group, a carboxy group, an alkoxycarbonyl group, a nitro group, an aryloxy group, a cyano group or an acylamino group;

$W_1$ represents a hydrogen atom, a halogen atom or a monovalent organic group; and $Z_2$ represents an atom or a group eliminable through coupling,

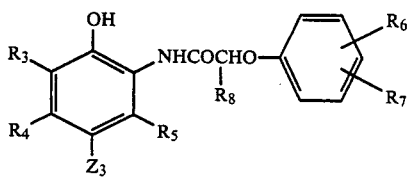

(XVIII)

wherein $R_3$, $R_4$ and $R_5$ each represent a hydrogen atom, a halogen atom, an alkyl group, an aryl group, an acylamino group or an alkoxy group;

$R_6$ and $R_7$ each represent a hydrogen atom, an alkyl group or an alkoxy group;

$R_8$ represents a hydrogen atom or an alkyl group; and $Z_3$ represents an atom or a group eliminable through coupling.

The compound of the above formula (XVI) will be explained in more detail. $R_2$ is a group represented by $-NHCOR_{21}$, $-NHSO_2R_{21}$, $-COOR_{21}$ or $$-SO_2\underset{R_{22}}{\underset{|}{N}}-R_{21},$$

each of $R_{21}$ and $R_{22}$ may be an unsubstituted alkyl group or may be an alkyl group substituted by a substituted aryloxy group, an alkoxycarbonyl group, an alkylsulfonyl group, a sulfonic acid group, an aryl group, a substituted alkylamide group or the like.

$Z_1$ may be any atom or group which is eliminable through known various coupling reactions. However, $Z_1$ may preferably be a nitrogen-containing type heterocyclic group having a bonding site to an N atom. In this case, extremely excellent light resistance can be obtained.

Next, the compound of the above formula (XVII) will be explained in more detail. $W_1$ represents a hydrogen atom, a halogen atom or a monovalent organic group, and as the monovalent organic group may preferably include a nitro group, an alkyl group, an alkoxy group, an acylamino group, a sulfonamide group; or an alkylcarbamoyl group, an arylcarbamoyl group, an alkylsulfamoyl group, an arylsulfamoyl group, an alkylsuccinicimide group, an alkoxycarboamide group, an alkoxycarboalkylamino group, an aralkoxycarboalkylamino group, an alkylaminocarboalkylamino group, an arylaminocarboalkylamino group and an aralkylaminocarboalkylamino group each of which may have a substituent or substituents.

Further, $Z_2$ may be an atom or a group which is eliminable through known various coupling reactions.

In the above formula (XVIII), $Z_3$ may be an atom or a group which is eliminable through known various coupling reactions.

Specific examples of the above couplers to be used in the present invention may include the following:

Exemplary cyan couplers:

CC-1

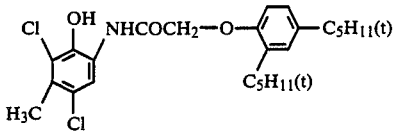

-continued

CC-2

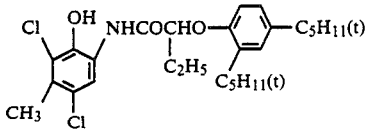

CC-3

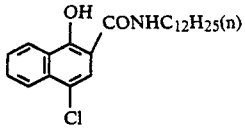

CC-4

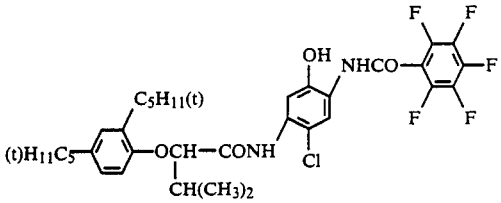

CC-5

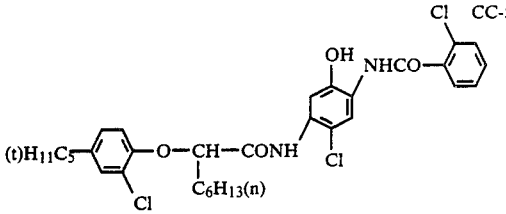

Exemplary magenta couplers:

MC-1

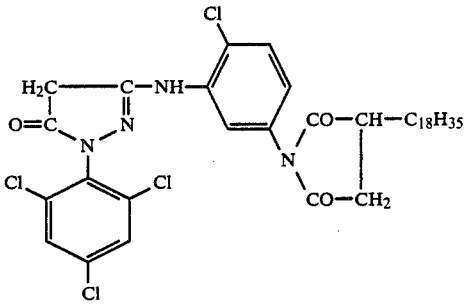

MC-2

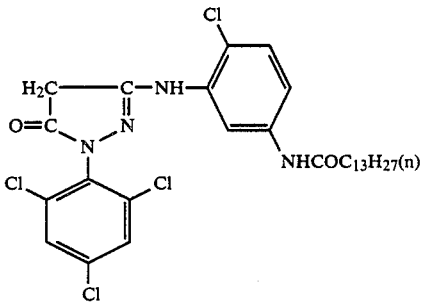

-continued
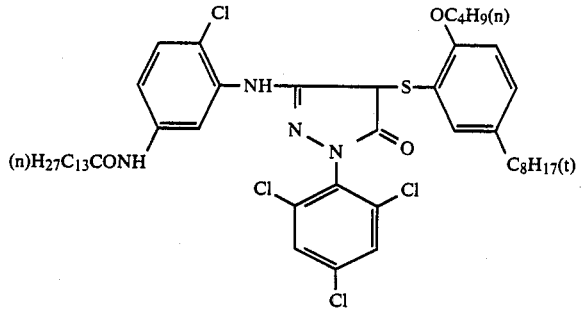
MC-3
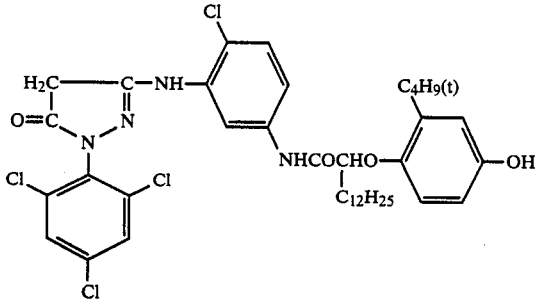
MC-4
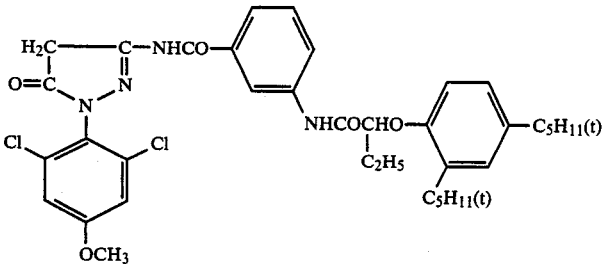
MC-5
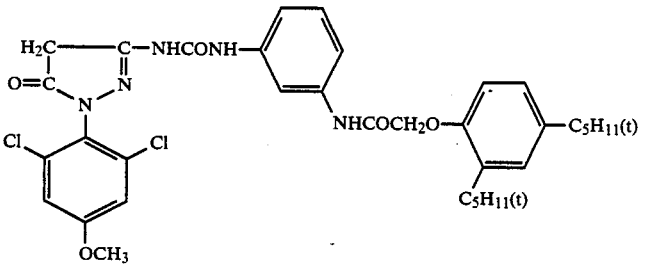
MC-6
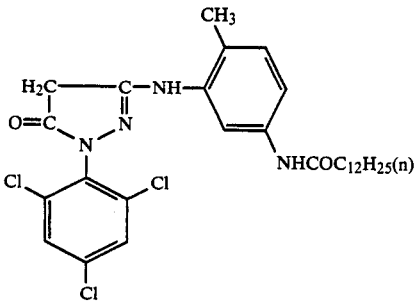
MC-7

-continued
MC-8
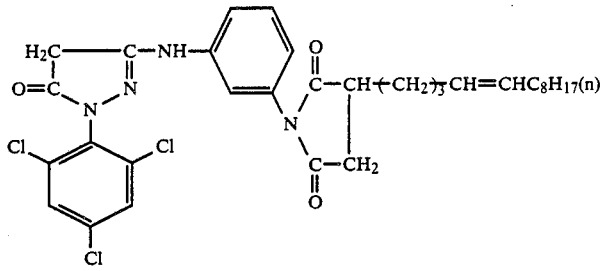
MC-9
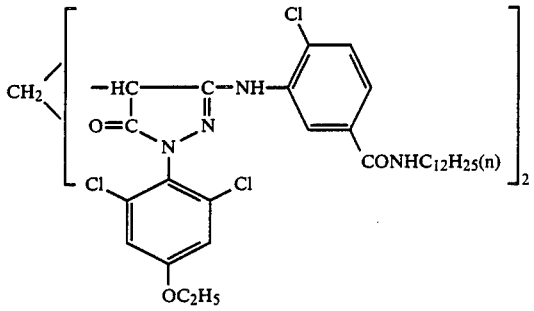
MC-10
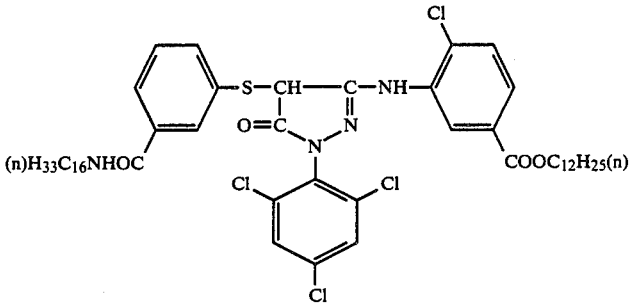
MC-11
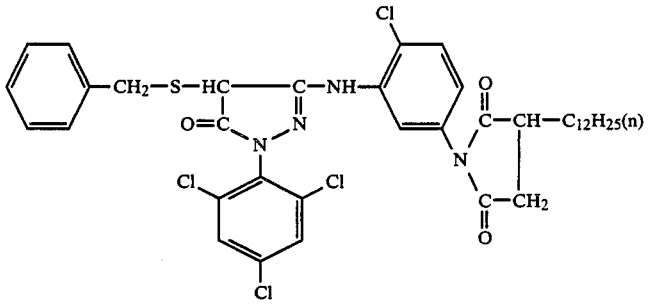
Exemplary yellow couplers:
YC-1
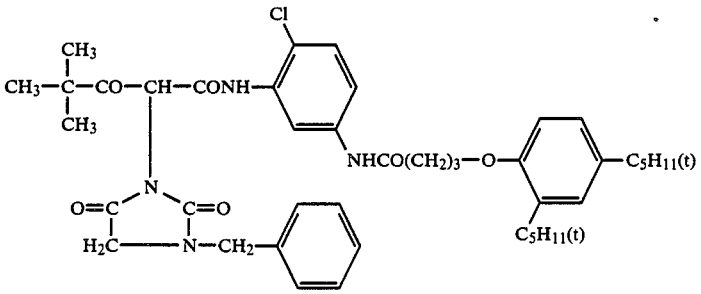

-continued

YC-2

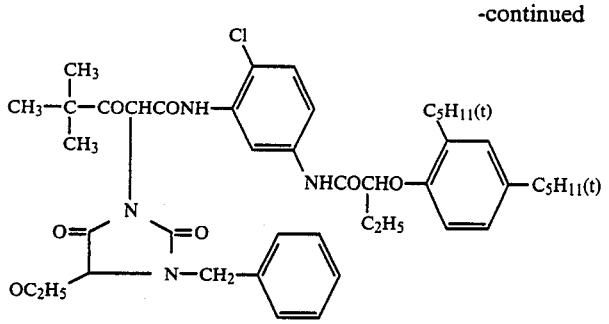

YC-3

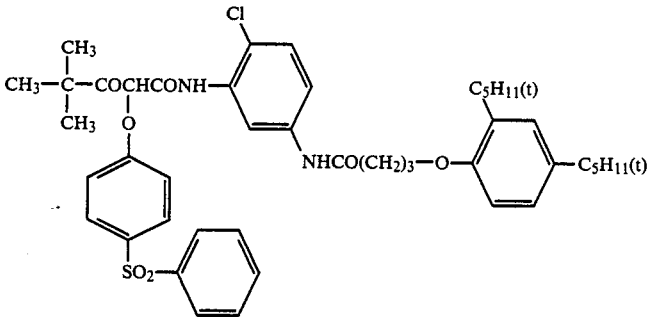

YC-4

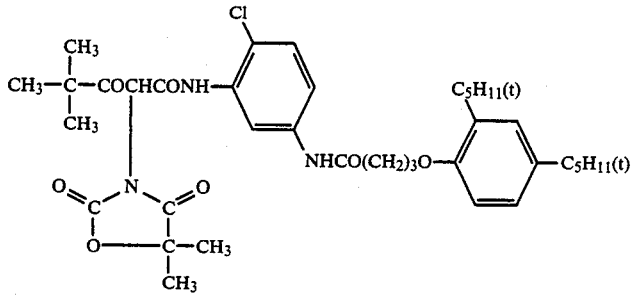

YC-5

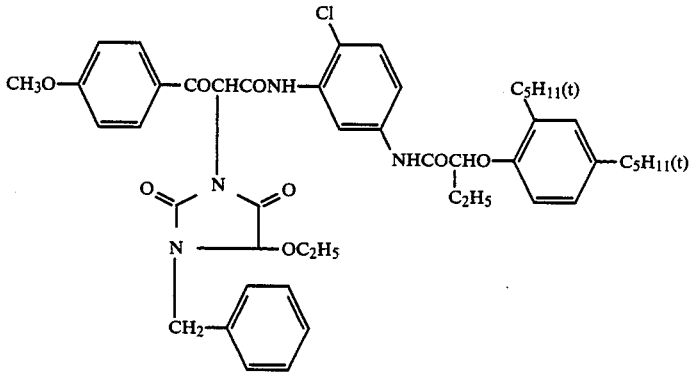

These couplers can be used also in an amount within the range generally from $1\times10^{-3}$ mole to 1 mole, preferably $1\times10^{-2}$ mole to $8\times10^{-1}$ mole per 1 mole of silver halide.

As the method for dispersing the coupler shown by the metal complex, the oil-soluble dye and the magenta coupler represented by the above formula (I), there may be employed various methods such as the so called alkali aqueous solution dispersing method, the solid dispersing method, the latex dispersing method, the oil-water droplet type emulsifying method and others, and these can be selected suitably depending on the chemical structures of the metal complex and the oil-soluble dye.

In the present invention, the latex dispersing method or the oil-in-water droplet type emulsifying method is particularly effective. These dispersing methods are well known in the prior art, and the latex dispersing method and its effects are described in Japanese Provisional Patent Publications No. 74538/1974, No. 59943/1976 and No. 32552/1979 or Reserch Disclosure, August, 1976, No. 14,850, pp. 77 to 79.

Suitable latices to be used in the latex dispersing method include, for example, homopolymers, copolymers and terpolymers of monomers such as styrene, ethyl acrylate, n-butyl acrylate, n-butyl methacrylate, 2-acetoacetoxyethyl methacrylate, 2-(methacryloyloxy)ethyltrimethylammoniummethosulfate, sodium 3-

(methacryloyloxy)propane-1-sulfonate, N-isopropylacrylamide, N-[2-(2-methyl-4-oxybenzyl)]acrylamide, 2-acrylamide-2-methylpropanesulfonic acid, etc. As the oil-in-water droplet type emulsifying method, it is possible to apply the known method of dispersing a hydrophobic additive such as a coupler, etc. Usually, in a high boiling organic solvent having a boiling point of about 150° C. or higher optionally together with a low boiling and/or an aqueous organic solvent, the above metal complex, oil-soluble dye and the coupler are dissolved and emulsified in a hydrophilic binder such as gelatin by use of a surfactant using a dispersing means such as stirrer, homogenizer, colloid mill, flow jet mixer, sonication device, etc., and thereafter added in the desired hydrophilic colloid layer. The step of removing the dispersion or the low boiling organic solvent simultaneously with dispersing may also be included.

The high boiling organic solvent preferably used in the present invention is a compound having a dielectric constant less than 6.0, and the lower limit is not particularly limited but the electric constant sould preferably be 1.9 or higher. For example, esters such as phthalic acid esters, phosphoric esters, etc., organic acid amines, ketones, hydrocarbon compounds, etc., having a dielectric constant less than 6.0 may be employed.

Also, in the present invention, it is preferable to use a high boiling organic solvent having a vapour pressure of 0.5 mmHg at 100° C. More preferably, of said high boiling organic solvent, phthalic acid esters or phosphoric acid esters are employed. The organic solvent may be a mixture of two or more kinds of organic solvents and, in this case, the mixture may have a dielectric constant less than 6.0. The dielectric constant herein mentioned refers to the dielectric constant at 30° C.

The phthalic acid ester advantageously used in the present invention may include those represented by the following formula (XIX).

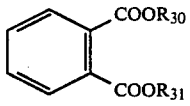

(XIX)

wherein $R_{30}$ and $R_{31}$ each represent an alkyl group, an alkenyl group or an aryl group, provided that the total carbon numbers of the groups represented by $R_{30}$ and $R_{31}$ are 9 to 32, more preferably 16 to 24.

In the present invention, the alkyl group represented by $R_{30}$ and $R_{31}$ in the above formula (XIX) may be either straight or branched, and its examples include a butyl group, a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group and the like. The aryl group represented by $R_{30}$ and $R_{31}$ may be, for example, a phenyl group, a naphthyl group and the like, and the alkenyl group may be, for example, a hexenyl group, a heptenyl group, an octadecenyl group and the like. These alkyl group, alkenyl group and aryl group may have single or plural substituents, and examples of the substituent for the alkyl and alkenyl groups include a halogen atom, an alkoxy group, an aryl group, an aryloxy group, an alkenyl group, an alkoxycarbonyl groups, and examples of the substituent for the aryl group include a halogen atom, an alkyl group, an alkoxy group, an aryl group, an aryloxy group, an alkenyl group, an alkoxycarbonyl group.

The phosphoric acid esters advantageously used in the present invention may include those represented by the following formula (XX).

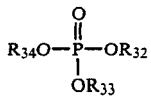

(XX)

wherein $R_{32}$, $R_{33}$ and $R_{34}$ each represents an alkyl group, an alkenyl group or an aryl group, provided that the total carbon numbers of the groups represented by $R_{32}$, $R_{33}$ and $R_{34}$ are 24 to 54.

Examples of the alkyl group represented by $R_{32}$, $R_{33}$ and $R_{34}$ in the formula (XX) include a butyl group, a pentyl group, a hexyl group, a heptyl group, an octyl group, a nonyl group, a dcyl group, an undecyl group, a dodecyl group, a tridecyl group, a tetradecyl group, a pentadecyl group, a hexadecyl group, a heptadecyl group, an octadecyl group, a nonadecyl group and the like.

These alkyl group, alkenyl group and aryl group may also have single or plural substituents. Preferably, $R_{32}$, $R_{33}$ and $R_{34}$ are alkyl groups including, for example, a 2-ethylhexyl group, an n-octyl group, a 3,5,5-trimethylhexyl group, an n-nonyl group, an n-decyl group, a sec-decyl group, a sec-dodecyl group, a t-octyl group and the like.

In the following, specific examples of the organic solvents preferably used in the present invention are shown.

Exemplary organic solvent

1

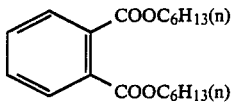

2

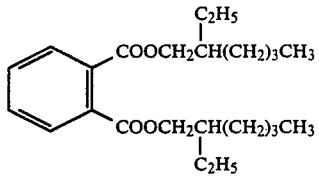

3

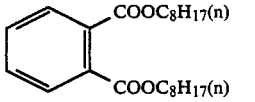

4

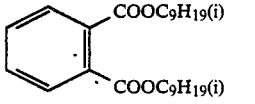

5

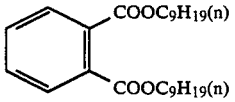

-continued

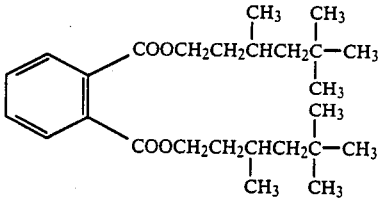

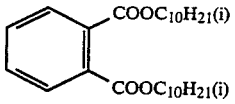

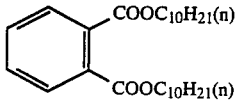

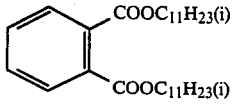

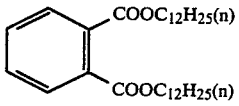

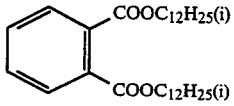

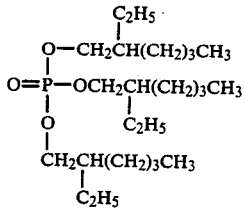

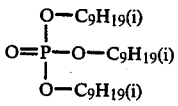

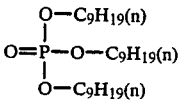

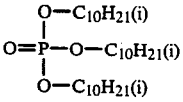

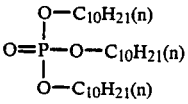

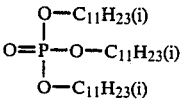

-continued

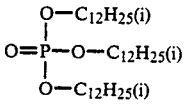

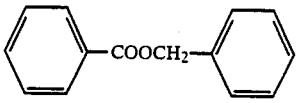

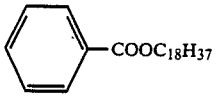

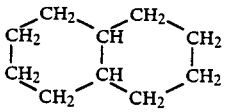

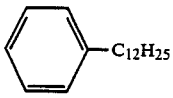

The light-sensitive silver halide color photographic material of the present invention can be, for example, nega and posi films of color as well as color printing paper, and particularly the effect of the method of the present invention can be effectively exhibited when a color printing paper to be provided directly for viewing is used.

The light-sensitive silver halide photographic material of the present invention including typically the color printing paper may be either for single color or for multi-color. In the case of a light-sensitive silver halide photographic material for multi-color, since detractive color reproduction is effected, it has generally a structure having silver halide emulsion layers containing respective couplers of magenta, yellow and cyan as the couplers for photography and non-light-sensitive layer laminated on a support in a suitable number of layers and order of layers, and said number of layers and layer order may be changed suitably depending on the critical performance and the purpose of use.

In the case when the light-sensitive silver halide photographic material of the present invention is a multi-color light-sensitive material, a specific layer constitution particularly preferred comprises a yellow dye image forming layer, an intermediate layer, a magenta dye image forming layer of the present invention, an intermediate layer containing a UV-absorber, a cyan dye image forming layer, an intermediate layer containing a UV-absorber and a protective layer arranged in this order from the support side on a support.

For the silver halide emulsion to be used in the light-sensitive silver halide photographic material of the present invention (hereinafter referred to as silver halide emulsion of the present invention), it is possible to use any of the silver halide conventionally used in silver halide emulsions such as silver bromide, silver iodobromide, silver iodochloride, silver chlorobromide and silver chlroide.

The silver halide emulsion grains to be used in the silver halide emulsion of the present invention may be obtained according to any of the acidic method, the neutral method and the ammonia method. Said grainds may be grown at once, or may be grown after preparation of seed grains. The method for preparation of seed grains and the method for growth may be either the same or different.

In preparation of the silver halide emulsion of the present invention, halide ions and silver ions may be mixted at the same time, or the other may be mixed into a system where either one of them exists. Also, while considering the critical growth rate of silver halide crystals, the crystal grains may be grown by adding succesively at the same time halide ions and silver ions while controlling pH, pAg in a mixing vessel. After growth, the halogen composition of the grains may be changed by use of the conversion method.

During preparation of the silver halide emulsion of the present invention, by using if necessary a solvent for silver halide emulsion, it is possible to control the grain size, grain shape, grain size distribution of the growth speed of the silver halide grains.

The silver halide grains to be used in the silver halide emulsion of the present invention can include metal ions internally of the grains and/or on the surface of the grains by addition with the use of cadmium salts, zinc salts, lead salts, thallium salts, iridium salts or complex, rhodium salts or complex, iron salts or complex in the process of formation of grains or in the process of growth, and it is also possible to impart a reducing sensitizing nucleus internally of the grains and/or on the surface of grains by palcing them in an appropriate reducing atmosphere.

In the silver halide emulsion of the present invention, unnecessary soluble salts may be removed or contained as such after completion of the growth of the silver halide grains. When said salts are to be removed, it can be practiced on the basis of the method disclosed in Research Disclosure No. 17,643.

The silver halide grains to be used in the silver halide emulsion of the present invention may consist of either a uniform layer from the inner portion to the surface or different layers.

The silver halide grains to be used in the silver halide emulsion of the present invention may be the grains in which latent image is formed primarily on the surface or the grains in which it is formed primarily internally of the grains.

The silver halide grains to be used in the silver halide emulsion of the present invention may have regular crystal forms or irregular crystal forms such as spheres or plates. In these grains, the ratio of {100} plane to {111} plane may be any desired value. Also, these crystal forms may also have a complex form, and grains with various crystal forms may be mixed.

The silver halide emulsion of the present invention can be prepared by mixing two or more kinds of silver halide emulsions formed separately.

The silver halide emulsion of the present invention is chemically sensitized in a conventional manner. That is, there may be employed the sulfur sensitization method in which a sulfur containing compound reactive with silver ions and active gelatin is employed, the selenium sensitization method by use of selenium compound, the reducing sensitization method in which a reducing substance is used, the noble metal sensitization method in which gold or other noble metal compounds are used either singly or in combination.

The silver halide emulsion of the present invention can be sensitized spectrally to a desired wavelength region by use of a dye known as the sensitizing dye in the field of photography. The sensitizing dye may be a single species, but two or more species may be used in combination. It is also possible to incorporate a color intesifying sensitizer which is a dye having itself no spectral sensitizing action or a compound absorbing substancially no visible light but can intensify the sensitizing action of the sensitizing dye together with the sensitizing dye in the emulsion.

In the silver halide emulsion of the present invention, for the purpose of preventing fog and/or maintaining stably photographic performance in the preparation steps, storage of the light-sensitive material or during photographic processing, it is possible to add a compound known in the art of photography as antifoggant or stabilizer during chemical aging and/or on completion of chemical aging, and/or after completion of chemical aging until coating of the silver halide emulsion.

For the binder (or protective colloid) of the silver halide emulsion of the present invention, gelatin is advantageously used, or otherwise it is possible to use gelatin derivatives, graft polymers of gelatin with other polymers, proteins, sugar derivatives, cellulose derivatives, hydrophilic colloids of synthetic hydrophilic polymers such as homopolymers or copolymers.

The photographic emulsion layer and other hydrophilic colloid layers in the light-sensitive material using the silver halide emulsion of the present invention is subjected to film hardening by crosslinking the binder (or protective colloid) molecules and using film hardening agents for enhancement of film strength individually or in combination. The film hardening agent should desirably be added in an amount which can harden the light-sensitive material to the extent that no film hardening agent is added in the processing liquors, but it is also possible to add a film hardening agent in the processing liquors.

For the purpose of enhancing flexibility of the silver halide emulsion layer and/or other hydrophilic colloid layers in the light-sensitive material using the silver halide emulsion of the present invention, a plasticizer can be added.

For the purpose of improvement of dimensional stability of the photographic emulsion layer and other hydrophilic colloid layers in the light-sensitive material using the silver halide emulsion of the present invention, a dispersion of a synthetic polymer insoluble or difficultly soluble in water (latex) can be contained therein.

As the dispersing aid when dissolving a hydrophobic compound in a solvent of a low boiling solvent alone or in combination with a high boiling solvent and dispersing the solution in water mechanically or by sonication, it is possible to use an anionic, nonionic, or cationic surfactant.

A color antifoggant may be used for preventing generation of color turbidity, deterioration of sharpness and marked graininess through migration of the oxidized product of a developing agent or an electron transfer agent between the emulsion layers (between the layers of the same color-sensitive layers and/or between the layers with different color sensitivities) in the light-sensitive color photographic material of the present invention.

Said color antifoggant may be used in the emulsion layer itself or alternatively in the intermediate layer provided between the adjacent emulsion layers. In the color light-sensitive material using the silver halide emulsion of the present invention, an image stabilizer for preventing deterioration of dye image can be used.

The image stabilizer preferably used in the present invention may include those of the formulae [A] to [H] and [J], [K] shown below.

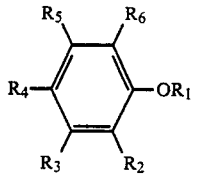

[A]

In the formula, $R_1$ represents a hydrogen atom, an alkyl group, an alkenyl group, an aryl group or a heterocyclic group, $R_2$, $R_3$, $R_5$, $R_6$ each represent a hydrogen atom, a halogen atom, a hydroxy group, an alkyl group, an alkenyl group, an aryl group, an alkoxy group or an acylamino group, $R_4$ represents an alkyl group, a hydroxy group, an aryl group or an alkoxy group. Also, $R_1$ and $R_2$ may be mutually subjected to ring closure to form a 5- to 6-membered ring, and in that case $R_4$ represents a hydroxy group or an alkoxy group. Also, $R_3$ and $R_4$ may be subjected to ring closure to form a 5-membered hydrocarbon ring and in that case $R_1$ represents an alkyl group, an aryl group or a heterocyclic group. However, the case when $R_1$ is a hydrogen atom and $R_4$ is a hydroxy group is excluded.

In the above formula [A], $R_1$ represents a hydrogen atom, an alkyl group, an alkenyl group, an aryl group or a heterocyclic group. Among them, examples of the alkyl group include straight or branched alkyl groups such as a methyl group, an ethyl group, an n-octyl group, a tertoctyl group, a hexadecyl group and the like. Examples of the alkenyl group represented by $R_1$ include an allyl group, a hexenyl group, an octenyl group and the like. Further, the aryl group of $R_1$ may include a phenyl group, a naphthyl group and the like. Further, the heterocyclic group represented by $R_1$ include specifically a tetrahydropyranyl group, a pyrimidyl group and the like. These respective groups can have substituents. For example, the alkyl group having substituents include a benzyl group, an ethoxymethyl group, while the aryl group having substituents include a methoxyphenyl group, a chlorophenyl group, a 4-hydroxy-3,5-dibutylphenyl group and the like.

In the formula [A], $R_2$, $R_3$, $R_5$ and $R_6$ represent a hydrogen atom, a halogen atom, a hydroxy group, an alkyl group, an alkenyl group, an aryl group, an alkoxy group or an acylamino group. Among them, the alkyl group, alkenyl group and aryl group include the same alkyl group, alkenyl group and aryl group mentioned above for $R_1$. The above halogen atom may include fluorine, chlorine, bromine. Further, the above alkoxy group may include methoxy, ethoxy group and the like. Further, the above acylamino group is represented by R'CONH—, wherein R' includes an alkyl group (e.g. each groups of a methyl group, an ethyl group, an n-propyl group, an n-butyl group, an n-octyl group, a tert-octyl group, a benzyl group, etc.), an alkenyl group (e.g. an allyl group, an octynyl group, an oleyl group and the like), an aryl group (e.g. a phenyl group, a methoxyphenyl group, a naphthyl group and the like), or a heterocyclic group (e.g. a pyridyl group, a pyrimidyl group).

In the above formula [A], $R_4$ represents an alkyl group, a hydroxy group, an aryl group or an alkoxy group. Among them, the alkyl group and aryl group may include specifically the same alkyl and aryl groups as mentioned above for $R_1$. Also, the alkenyl group of $R_4$ may include the same alkoxy group mentioned above for $R_2$, $R_3$, $R_5$ and $R_6$.

The ring formed together with benzene ring by mutual ring closure of $R_1$ and $R_2$ may include, for example, chroman, coumaran, methylenedioxybenzene, etc.

The ring formed together with benzene ring by ring closure of $R_3$ and $R_4$ may be, for example, indane. These rings may also have substituents (e.g. an alkyl group, an alkoxy group, an aryl group).

Also, a spiro compound may be formed by making the atom in the ring formed by ring closure of $R_1$ and $R_2$ or $R_3$ and $R_4$ a spiro atom, or a bis-derivative may be formed with $R_2$, $R_4$ as the linking group.

Of the phenol type compounds or phenylether type compounds represented by the above formula [A], preferable compounds are biindane compounds having 4 RO-groups (R represents an alkyl group, an alkenyl group, an aryl group or a heterocyclic group), particularly preferably represented by the following formula [A-1].

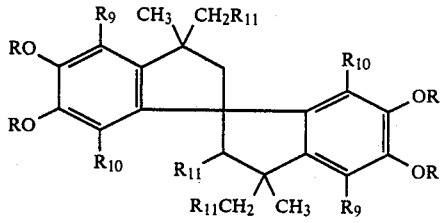

[A-1]

In the formula R represents an alkyl group (e.g. a methyl group, an ethyl group, a propyl group, an n-octyl group, a tert-octyl group, a benzyl group, an hexadecyl group), an alkenyl group (e.g. an allyl group, an octenyl group, an oleyl group), an aryl group (e.g. a phenyl group, a naphthyl group) or a heterocyclic group (e.g. a tetrahydropyranyl group, a pyrimidyl group). $R_9$ and $R_{10}$ each represent a hydrogen atom, a halogen atom (e.g. fluorine, chlorine, bromine), an alkyl group (e.g. a methyl group, an ethyl group, an n-butyl group, a benzyl group), an alkoxy group (e.g. an allyl group, a hexenyl group, an octenyl group), or an alkoxy group (e.g. a methoxy group, an ethoxy group, a benzyloxy group), and $R_{11}$ represents a hydrogen atom, an alkyl group (e.g. a methyl group, an ethyl group, an n-butyl group, a benzyl group), an alkenyl group (e.g. a 2-propenyl group, a hexenyl group, an octenyl group), or an aryl group (e.g. a phenyl group, a methoxyphenyl group, a chlorophenyl group, a naphthyl group). The compounds represented by the above formula [A] also include the compounds as disclosed in U.S. Pat. No. 3,935,016, No. 3,982,944 and No. 4,254,216; Japanese Provisional Patent Publications No. 21004/1980 and No. 145530/1979; U.K. Patent Publications No. 2,077,455 and No. 2,062,888; U.S. Pat. No. 3,764,337, No. 3,432,300, No. 3,574,627 and No. 3,573,050; Japanese Provisional Patent Publications No. 152225/1977, No. 20327/1978, No. 17729/1978 and No. 6321/1980; U.K. Pat. No. 1,347,556; U.K. Patent Publication No. 2,066,975; Japanese Patent Publications No. 12337/1979 and No. 31625/1973; and U.S. Pat. No. 3,700,455.

The compound represented by the above formula may be used in an amount preferably of 5 to 300 mol %, more preferably 10 to 200 mol % based on the magenta coupler.

In the following, typical examples of the compound represented by the above formula [A] are shown.

Type (1)

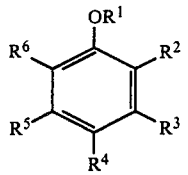

Type (2)

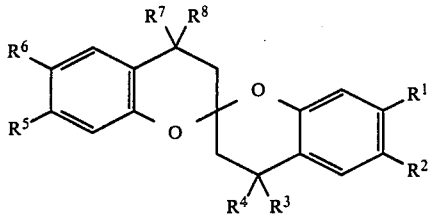

Type (3)

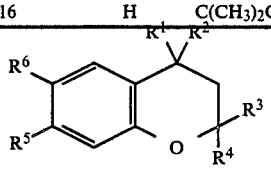

Type (4)

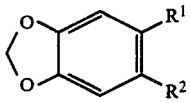

Type (5)

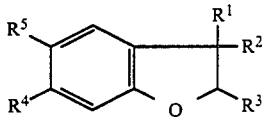

Type (6)

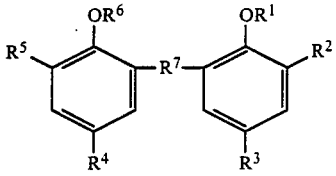

Type (7)

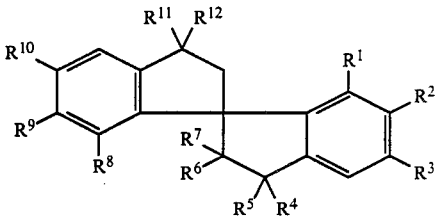

| Compound No. | $R^1$ | $R^2$ | $R^3$ | Type (1) $R^4$ | $R^5$ | $R^6$ |
|---|---|---|---|---|---|---|
| A-1 | H | OH | $-C(CH_3)_2CH_2C(CH_3)_3$ | $CH_3O$ | H | $-C(CH_3)_2CH_2C(CH_3)_3$ |
| A-8 | $C_8H_{17}$ | $C(CH_3)_2C_2H_5$ | H | $C_8H_{17}O$ | $C(CH_3)_2C_2H_5$ | H |
| A-14 | H | H | OH | $C(CH_3)_2CH_2C(CH_3)_3$ | H | H |
| A-16 | H | $C(CH_3)_2C_3H_7$ | H | $CH_3O$ | $C(CH_3)_2C_3H_7$ | H |

| Compound No. | $R^1$ | $R^2$ | $R^3$ | Type (2) $R^4$ | $R^5$ | $R^6$ | $R^7$ | $R^8$ |
|---|---|---|---|---|---|---|---|---|
| A-2 | $CH_3$ | OH | $CH_3$ | $CH_3$ | $CH_3$ | OH | $CH_3$ | $CH_3$ |
| A-10 | $CH_3$ | $OCH_3$ | $CH_3$ | $CH_3$ | $CH_3$ | $CH_3O$ | $CH_3$ | $CH_3$ |

| Compound No. | $R^1$ | $R^2$ | $R^3$ | Type (3) $R^4$ | $R^5$ | $R^6$ |
|---|---|---|---|---|---|---|
| A-3 | $CH_3$ | $CH_3$ | H | $CH_3$ | $(t)C_8H_{17}$ | OH |
| A-11 | $CH_3$ | $CH_3$ | H | $CH_3$ | $(t)C_8H_{17}$ | $C_8H_{17}O$ |
| A-12 | $CH_3$ | $CH_3$ | H | $CH_3$ | $CH_3$ | $O(CH_2)_2OC_{10}H_{21}$ |
| A-17 | H | $CH_3$ | $CH_3$ | $CH_3$ | $(t)C_8H_{17}$ | OH |
| A-18 | $CH_3$ | $CH_3$ | $CH_3$ | OH 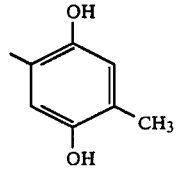 | $CH_3$ | OH |

Type (4)

| Compound No. | $R^1$ | $R^2$ |
|---|---|---|
| A-4 | $C_3H_7$ | 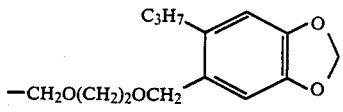 |
| A-9 | $C_3H_7$ | $-CH_2O(CH_2)_2OC_4H_9$ |

Type (5)

| Compound No. | $R^1$ | $R^2$ | $R^3$ | $R^4$ | $R^5$ |
|---|---|---|---|---|---|
| A-5 | $CH_3$ | $CH_3$ | $C_2H_5O$ | (t)$C_8H_{17}$ | OH |

Type (6)

| Compound No. | $R^1$ | $R^2$ | $R^3$ | $R^4$ | $R^5$ | $R^6$ | $R^7$ |
|---|---|---|---|---|---|---|---|
| A-6 | H | (t)$C_4H_9$ | $CH_3$ | $CH_3$ | (t)$C_4H_9$ | H | $CH_2$ |
| A-15 | $CH_3$ | (t)$C_4H_9$ | $CH_3$ | $CH_3$ | (t)$C_4H_9$ | $CH_3$ | $CH_2$ |

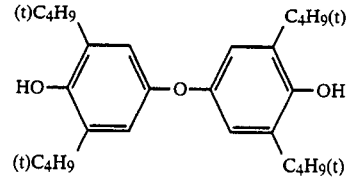
A-7

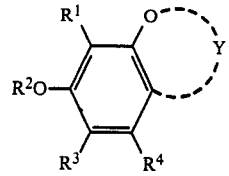
[B]

(wherein $R_1$ and $R_4$ each represent a hydrogen atom, a halogen atom, an alkyl group, an alkenyl group, an alkoxy group, an alkenyloxy group, a hydroxy group, an aryl group, an aryloxy group, an acyl group, an acylamino group, an acyloxy group, a sulfonamide group, a cycloalkyl group or an alkoxycarbonyl group, $R_2$ represents a hydrogen atom, an alkyl group, an alkenyl group, an aryl group, an acyl group, a cycloalkyl group or a heterocyclic group, $R_3$ represents a hydrogen atom, a halogen atom, an alkyl group, an alkenyl group, an aryl group, an aryloxy group, an acyl group, an acyloxy group, an sulfonamide group, a cycloalkyl group or an alkoxycarbonyl group).

The groups as mentioned above may also be substituted with other substituents, respectively. For example, there may be included an alkyl group, an alkenyl group, an alkoxy group, an aryl group, an aryloxy group, a hydroxy group, an alkoxycarbonyl group, an Type (7)

| Compound No. | $R^1$ | $R^2$ | $R^3$ | $R^4$ | $R^5$ | $R^6$ | $R^7$ |
|---|---|---|---|---|---|---|---|
| A-13 | H | $C_3H_7O$ | $C_3H_7O$ | $CH_3$ | $CH_3$ | H | H |
| A-19 | H | $CH_3O$ | $CH_3O$ | $CH_3$ | $CH_3$ | H | H |
| A-20 | $CH_3$ | $C_4H_9O$ | $C_4H_9O$ | $CH_3$ | $CH_3$ | H | H |
| A-21 | H | $C_2H_5O$ | $C_2H_5O$ | $CH_3$ | $CH_3$ | H | H |
| A-22 | H | $CH_3O$ | $CH_3O$ | $C_2H_5$ | $CH_3$ | H | $CH_3$ |
| A-23 | H | $C_7H_{15}COO$ | $C_7H_{15}COO$ | $CH_3$ | $CH_3$ | H | H |
| A-24 | H | $C_4H_9O$ | $C_4H_9O$ | $CH_3$ | $CH_3$ | H | H |
| A-25 | H | $CH_3O(CH_2)_2O$ | $CH_3O(CH_2)_2O$ | $CH_3$ | $CH_3$ | H | H |
| A-26 | H | $CH_2{=}CHCH_2O$ | $CH_2{=}CHCH_2O$ | $CH_3$ | $CH_3$ | H | H |
| A-27 | H | $C_3H_7O$ | $C_3H_7O$ | $C_6H_5CH_2$ | $CH_3$ | $C_6H_5$ | H |
| A-28 | $CH_3O$ | $C_4H_9O$ | $C_4H_9O$ | $CH_3$ | $CH_3$ | H | H |
| A-29 | H | (s)$C_5H_{11}O$ | (s)$C_5H_{11}O$ | $CH_3$ | $CH_3$ | H | H |
| A-30 | H | $C_4H_9O$ | $C_4H_9O$ | (i)$C_3H_7$ | $CH_3$ | $CH_3$ | $CH_3$ |
| A-31 | H | $C_{18}H_{37}O$ | $C_{18}H_{37}O$ | $CH_3$ | $CH_3$ | H | H |
| A-32 | H | $C_6H_5CH_2O$ | $C_6H_5CH_2O$ | $CH_3$ | $CH_3$ | H | H |

| Compound No. | $R^8$ | $R^9$ | $R^{10}$ | $R^{11}$ | $R^{12}$ |
|---|---|---|---|---|---|
| A-13 | H | $C_3H_7O$ | $C_3H_7O$ | $CH_3$ | $CH_3$ |
| A-19 | H | $CH_3O$ | $CH_3O$ | $CH_3$ | $CH_3$ |
| A-20 | $CH_3$ | $C_4H_9O$ | $C_4H_9O$ | $CH_3$ | $CH_3$ |
| A-21 | H | $C_2H_5O$ | $C_2H_5O$ | $CH_3$ | $CH_3$ |
| A-22 | H | $CH_3O$ | $CH_3O$ | $CH_3$ | $C_2H_5$ |
| A-23 | H | $C_7H_{15}COO$ | $C_7H_{15}COO$ | $CH_3$ | $CH_3$ |
| A-24 | H | $C_4H_9O$ | $C_4H_9O$ | $CH_3$ | $CH_3$ |
| A-25 | H | $CH_3O(CH_2)_2O$ | $CH_3O(CH_2)_2O$ | $CH_3$ | $CH_3$ |
| A-26 | H | $CH_2{=}CHCH_2O$ | $CH_2{=}CHCH_2O$ | $CH_3$ | $CH_3$ |
| A-27 | H | $C_3H_7O$ | $C_3H_7O$ | $C_6H_5O$ | $CH_3$ |
| A-28 | $CH_3$ | $C_4H_9O$ | $C_4H_9O$ | $CH_3$ | $CH_3$ |
| A-29 | H | (s)$C_5H_{11}O$ | (s)$C_5H_{11}O$ | $CH_3$ | $CH_3$ |
| A-30 | H | $C_4H_9O$ | $C_4H_9O$ | (i)$C_3H_7$ | $CH_3$ |
| A-31 | H | $C_{18}H_{37}O$ | $C_{18}H_{37}O$ | $CH_3$ | $CH_3$ |
| A-32 | H | $C_6H_5CH_2O$ | $C_6H_5CH_2O$ | $CH_3$ | $CH_3$ |

aryloxycarbonyl group, an acylamino group, an acyloxy group, a carbamoyl group, a sulfonamide group, a sulfamoyl group and the like.

Also, $R_2$ and $R_3$ may be mutually subjected to ring closure to form a 5- or 6-membered ring. As the ring formed by ring closure of $R_2$ and $R_3$ together with benzene ring, there may be included, for example, a chroman ring, a methylenedioxybenzene ring.

Y represents a group of atoms necessary for formation of a chroman ring or a coumarin ring.

The chroman ring or coumaran ring may also be substituted with a halogen atom, an alkyl group, a cycloalkyl group, an alkoxy group, an alkenyl group, an alkenyloxy group, a hydroxy group, an aryl group, an aryloxy group or a heterocyclic group, or may further form a spiro ring.

Of the compounds shown by the formula [B] compounds particularly useful in the present invention include the compounds represented by the formulae [B-1], [B-2], [B-3], [B-4], [B-5].

[B-1]

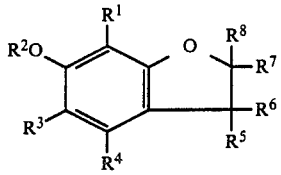

[B-2]

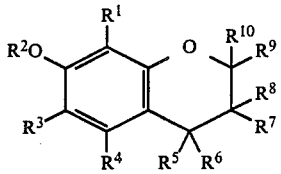

[B-3]

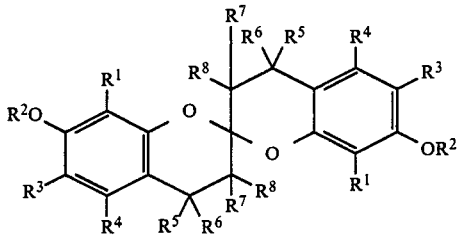

-continued

[B-4]

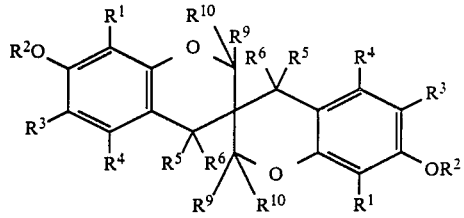

[B-5]

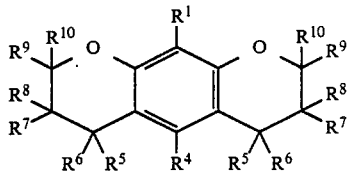

$R_1$, $R_2$, $R_3$ and $R_4$ in the formulae [B-1], [B-2], [B-3], [B-4] and [B-5] have the same meanings as in the above formula [B], $R_5$, $R_6$, $R_7$, $R_8$, $R_9$ and $R_{10}$ represent a hydrogen atom, a halogen atom, an alkyl group, an alkoxy group, a hydroxy group, an alkenyl group, an alkenyloxy group, an aryl group, an aryloxy group or a heterocyclic group.

Further, $R_5$ and $R_6$, $R_6$ and $R_7$, $R_7$ and $R_8$, $R_8$ and $R_9$ and $R_9$ and $R_{10}$ may be mutually cyclized to form a carbon ring, and further said carbon ring may be substituted with alkyl groups. In the above formulae [B-1], [B-2], [B-3], [B-4] and [B-5], the compounds in which $R_1$ and $R_4$ are a hydrogen atom, an alkyl group, an alkoxy group, a hydroxy group, a cycloalkyl group; $R_5$, $R_6$, $R_7$, $R_8$, $R_9$ and $R_{10}$ are a hydrogen atom, an alkyl group or a cycloalkyl group are particularly useful.

The compounds represented by the formula [B] represent and include the compounds described in Tetrahedron, 1970, Vol. 26, pp. 4743–4751; Journal of Chemical Society of Japan, 1972, No. 10, pp. 0987–1990; Chem. Lett., 1972 (4), pp. 315–316; and Japanese Provisional Patent Publication No. 139383/1980, and they can be synthesized according to the methods described in these literatures.

The compound represented by the above formula [B] may be used in an amount preferably of 5 to 300 mole %, more preferably 10 to 200 mole % based on the above magenta coupler according to the emulsion of the present invention.

Typical examples of these compounds are shown below.

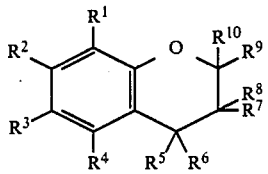

| Compound No. | $R^1$ | $R^2$ | $R^3$ | $R^4$ | $R^5$ | $R^6$ | $R^7$ | $R^8$ | $R^9$ | $R^{10}$ |
|---|---|---|---|---|---|---|---|---|---|---|
| B-1 | H | H | H | H | H | $CH_3$ | H | H | $CH_3$ | $CH_3$ |
| B-2 | H | H | $CH_3$ | H | H | $CH_3$ | H | H | $CH_3$ | $CH_3$ |
| B-3 | H | H | $C_{12}H_{25}$ | H | H | $CH_3$ | H | H | $CH_3$ | $CH_3$ |
| B-4 | H | H | 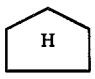 | H | H | $CH_3$ | H | H | $CH_3$ | $CH_3$ |

-continued

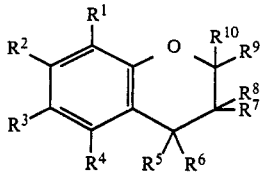

| Compound No. | $R^1$ | $R^2$ | $R^3$ | $R^4$ | $R^5$ | $R^6$ | $R^7$ | $R^8$ | $R^9$ | $R^{10}$ |
|---|---|---|---|---|---|---|---|---|---|---|
| B-5 | H | $CH_3$ | H | H | H | $CH_3$ | H | H | $CH_3$ | $CH_3$ |
| B-9 | $CH_3$ | H | $CH_3$ | H | H | H | H | 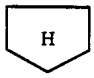 | (condensed) | H |
| B-10 | H | $CH_3CO$ | H | H | H | (i)$C_3H_7$ | H | H | $CH_3$ | $CH_3$ |
| B-11 | H | $C_3H_7$ | (t)$C_8H_{17}$ | H | H | $CH_3$ | H | $CH_3$ | $CH_3$ | $CH_3$ |
| B-12 | Br | H | Br | H | H | H | H | $CH_3$ | $CH_3$ | $CH_3$ |
| B-13 | H | 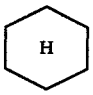 | H | H | $CH_3$ | $CH_3$ | H | H | $CH_2OH$ | $CH_3$ |
| B-14 | H | 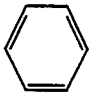 | H | H | $CH_3$ | $CH_3$ | H | H | $CH_3$ | $CH_3$ |
| B-15 | H | H | $CH_2{=}CHCH_2CO$ | | $CH_3$ | $CH_3$ | H | H | 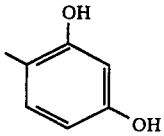 | $CH_3$ |
| B-16 | H | H | H | $CH_3SO_2NH$ | $CH_3$ | $CH_3$ | H | H | 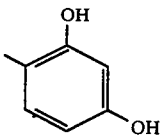 | $CH_3$ |
| B-17 | H | 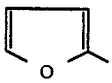 | $CH_3$ | H | Cl | H | Cl | H | $CH_3$ | $CH_3$ |
| B-18 | H | 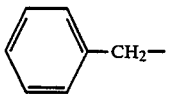 | $CH_3CONH$ | H | H | H | H | H | 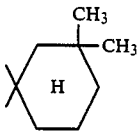 | (spiro) |
| B-54 | $CH_3O$ | $CH_3O$ | H | H | H | H | H | H | $CH_3$ | $CH_3$ |
| B-55 | H | 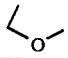 (methylenedioxy) | | H | H | H | H | H | $CH_3$ | $CH_3$ |

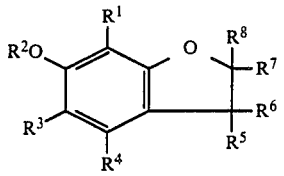

| Compound No. | $R^1$ | $R^2$ | $R^3$ | $R^4$ | $R^5$ | $R^6$ | $R^7$ | $R^8$ |
|---|---|---|---|---|---|---|---|---|
| B-6 | H | H | H | H | H | 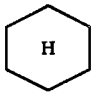 | (condensed) | H |
| B-7 | H | H | (i)$C_3H_7$ | H | H | H | $CH_3$ | $CH_3$ |
| B-8 | H | $CH_3$ | Cl | H | H | H | $CH_3$ | $CH_3$ |
| B-19 | H | H | 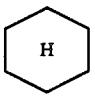 | H | $CH_3$ | $CH_3$ | $CH_3$ | $CH_3$ |
| B-20 | H | $CH_2{=}CHCH_2$ | $CH_3$ | H | $CH_3$ | $CH_3$ | $CH_3$ | H |
| B-21 | H | $C_3H_7$ | $C_3H_7$ | H | $CH_3$ | $CH_3$ | 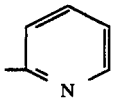 | H |
| B-22 | $CH_3$ | H | $CH_3$ | H | 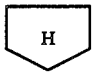 | (spiro) | H | H |
| B-23 | $CH_3$ | H | 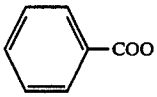 | H | $CH_3$ | $CH_3$ | $CH_3$ | $CH_3$ |

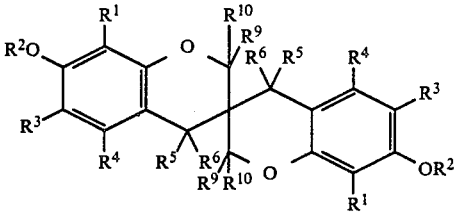

| Compound No. | $R^1$ | $R^2$ | $R^3$ | $R^4$ | $R^5$ | $R^6$ | $R^9$ | $R^{10}$ |
|---|---|---|---|---|---|---|---|---|
| B-24 | H | H | H | H | $CH_3$ | $CH_3$ | H | H |
| B-25 | H | H | $CH_3$ | H | $CH_3$ | $CH_3$ | H | H |
| B-26 | H | H | (t)$C_4H_9$ | H | H | H | H | H |
| B-27 | H | $CH_3$ | H | H | $CH_3$ | $CH_3$ | H | H |
| B-28 | H | H | 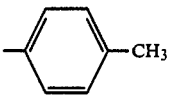 | H | $CH_3$ | $CH_3$ | H | H |
| B-29 | H | H | $C_2H_5COOCH_2$ | H | $CH_3$ | $CH_3$ | H | H |
| B-30 | $CH_3$ | 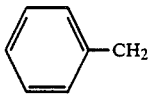 | H | $CH_3$ | $CH_3$ | $CH_3$ | H | H |

-continued
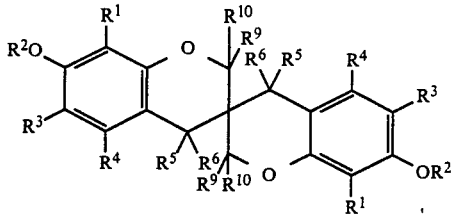
Compound
| No. | $R^1$ | $R^2$ | $R^3$ | $R^4$ | $R^5$ | $R^6$ | $R^9$ | $R^{10}$ |
|---|---|---|---|---|---|---|---|---|
| B-31 | Cl | H | H | H | 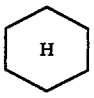 | (spiro) | H | H |
| B-32 | H | H | $CH_3CONH$ | H | $CH_3$ | $CH_3$ | H | H |
| B-33 | $CH_3$ | 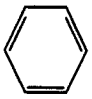 | $(t)C_8H_{17}$ | H | $CH_3$ | $CH_3$ | H | H |
| B-34 | H | H | 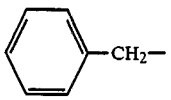 | H | $CH_3$ | $CH_3$ | H | H |

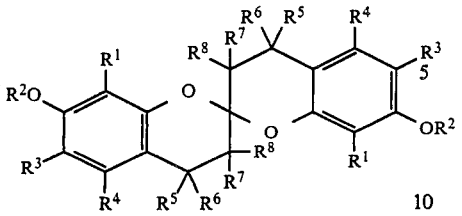

| Compound No. | $R^1$ | $R^2$ | $R^3$ | $R^4$ | $R^5$ | $R^6$ | $R^7$ | $R^8$ |
|---|---|---|---|---|---|---|---|---|
| B-35 | H | H | H | H | $CH_3$ | $CH_3$ | H | H |
| B-36 | H | $C_3H_7$ | H | H | $CH_3$ | $CH_3$ | H | H |
| B-37 | H | $CH_3$ | $CH_3$ | H | $CH_3$ | $CH_3$ | H | H |
| B-38 | H | H | (t)$C_4H_9$ | H | $CH_3$ | $CH_3$ | H | H |
| B-39 | H | H | 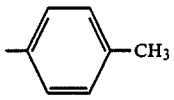 | H | $CH_3$ | $CH_3$ | H | H |
| B-40 | H | H | $CH_3SO_2NH$ | H | H | H | H | H |
| B-41 | $CH_3$ | 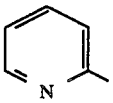 | H | $CH_3$ | $CH_3$ | $CH_3$ | H | H |
| B-42 | Cl | (t)$C_4H_9$ | H | H | 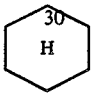 | (spiro) | H | H |
| B-43 | H | $C_{12}H_{25}$ | $CH_3CONH$ | H | $CH_3$ | $CH_3$ | H | H |
| B-44 | H | H | (t)$C_8H_{17}$ | H | $CH_3$ | $CH_3$ | H | H |
| B-45 | H | H | 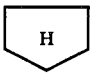 | H | $CH_3$ | $CH_3$ | H | H |

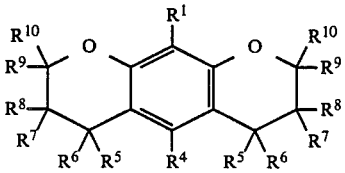

| Compound No. | $R^1$ | $R^4$ | $R^5$ | $R^6$ | $R^7$ | $R^8$ | $R^9$ | $R^{10}$ |
|---|---|---|---|---|---|---|---|---|
| B-46 | H | H | H | H | H | H | $CH_3$ | $CH_3$ |
| B-47 | OH | H | H | H | H | H | $CH_3$ | $CH_3$ |
| B-48 | H | H | H | H | H | H | $CH_3$ | $C_2H_5$ |
| B-49 | H | H | H | H | H | H | 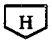 | (spiro) |
| B-50 | $C_3H_7O$ | H | $CH_3$ | H | H | H | $CH_3$ | $CH_3$ |
| B-51 | H | H | H | H | $C_3H_7$ | H | $C_3H_7$ | H |
| B-52 | H | OH | H | H | H | H | $CH_3$ | $CH_3$ |
| B-53 | H | $C_3H_7O$ | H | H | H | H | $CH_3$ | $CH_3$ |

[C]

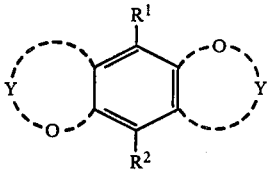

[D]

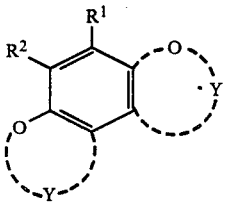

In the formulae, $R_1$ and $R_2$ represent a hydrogen atom, a halogen atom, an alkyl group, an alkenyl group, an alkoxy group, an alkenyloxy group, a hydroxy group, an aryl group, an aryloxy group, an acyl group, an acylamino group, an acyloxy group, a sulfonamide group or an alkoxycarbonyl group.

The groups as mentioned above may be also substituted with other substituents, respectively. For example, there may be included a halogen atom, an alkyl group, an alkenyl group, an alkoxy group, an aryloxy group, a hydroxy group, an alkoxycarbonyl group, an aryloxycarbonyl group, an acylamino group, a carbamoyl group, a sulfonamide group, a sulfamonyl group and others.

Y represents a group of atoms necessary for formation of dichroman ring or dicoumaran ring together with benzene ring.

The chroman ring or coumaran ring may be substituted with a halogen atom, an alkyl group, a cycloalkyl group, an alkoxy group, an alkenyl group, an alkenyloxy group, a hydroxy group, an aryl group, an aryloxy group or a heterocyclic group, or may further form a spiro ring.

Of the compounds represented by the formulae [C] and [D], particularly useful compounds in the present invention are included in the compounds represented by the formulae [C-1], [C-2], [D-1] and [D-2].

[C-1]

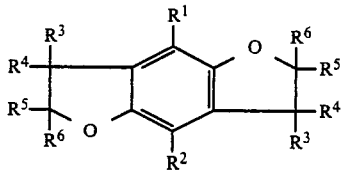

[C-2]

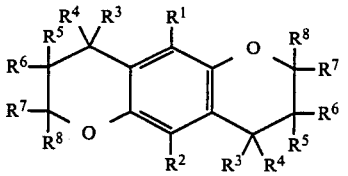

[D-1]

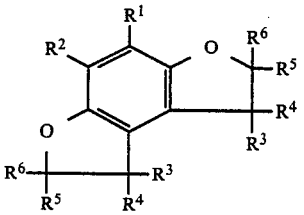

[D-2]

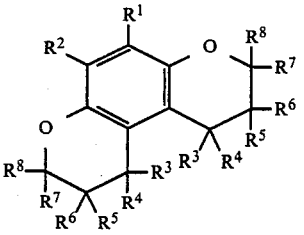

$R_1$ and $R_2$ in the formulae [C-1], [C-2], [D-1] and [D-2] have the same meanings as in the above formulae [C] and [D], $R_3$, $R_4$, $R_5$, $R_6$, $R_7$ and $R_8$ represent a hydrogen atom, a halogen atom, an alkyl group, an alkoxy group, a hydroxy group, an alkenyl group, an alkneyloxy group, an aryl group, an aryloxy group or a heterocyclic group. Further, $R_3$ and $R_4$, $R_4$ and $R_5$, $R_5$ and $R_6$, $R_6$ and $R_7$, $R_7$ and $R_8$ may be mutually cyclized to form a carbon ring, and said carbon ring may be further substituted with alkyl groups.

In the above formulae [C-1], [C-2], [D-1] and [D-2], the compounds wherein $R_1$ and $R_2$ are a hydrogen atom, an alkyl group, an alkoxy group, a hydroxy group or a cycloalkyl group, $R_3$, $R_4$, $R_5$, $R_6$, $R_7$ and $R_8$ are a hydrogen atom, an alkyl group or a cycloalkyl group are particularly useful.

The compounds represented by formulae [C] and [D] include the compounds described in Journal of Chemical Society of Japan (J. Chem. Soc. part C) 1968. (14), pp. 1937–1938; Journal of Organic Synthetic Chemistry, 1970, 28 (1), pp. 60–65; Tetrahedron Letters, 1973. (29), pp. 2707–2710, and they can be synthesized according to the method described in these literatures.

The amount of the compound represented by the above formulae [C] and [D] used may be preferably 5 to 300 mole %, more preferably 10 to 200 mole % based on the magenta coupler according to the present invention.

Typical examples of these compounds are shown below.

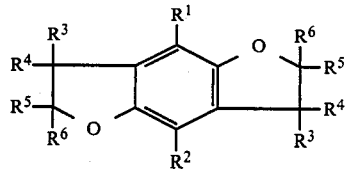

| Compound No. | $R^1$ | $R^2$ | $R^3$ | $R^4$ | $R^5$ | $R^6$ |
|---|---|---|---|---|---|---|
| C-11 | H | H | H | H | $CH_3$ | $CH_3$ |
| C-12 | H | H | H | H | 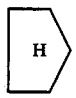 | (spiro) |
| C-13 | H | H | H | 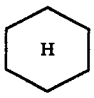 | (condensed) | H |

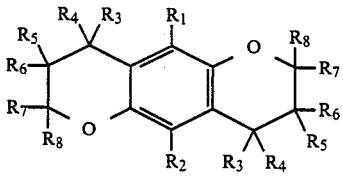

| Compound No. | $R_1$ | $R_2$ | $R_3$ | $R_4$ | $R_5$ | $R_6$ | $R_7$ | $R_8$ |
|---|---|---|---|---|---|---|---|---|
| C-1 | H | H | H | H | H | H | H | H |
| C-2 | H | H | H | H | H | H | $CH_3$ | $CH_3$ |
| C-3 | H | H | $CH_3$ | H | H | H | $CH_3$ | $CH_3$ |
| C-4 | $CH_3$ | H | $CH_3$ | $CH_3$ | H | H | $CH_3$ | $CH_3$ |

-continued

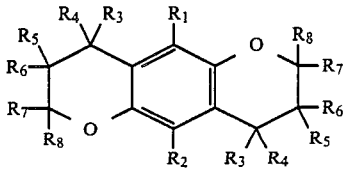

| Compound No. | $R_1$ | $R_2$ | $R_3$ | $R_4$ | $R_5$ | $R_6$ | $R_7$ | $R_8$ |
|---|---|---|---|---|---|---|---|---|
| C-5 | OH | H | H | H | H | H | $C_2H_5$ | $CH_3$ |
| C-6 | $OCH_3$ | H | H | H | H | H | H | H |
| c-7 | $OC_3H_7$ | H | H | H | H | H | H | H |
| C-8 | $OC_{12}H_{25}$ | H | H | H | H | H | H | H |
| C-9 | $CH_3COO$ | H | H | H | H | H | $CH_3$ | $CH_3$ |
| C-10 | $CH_3CONH$ | H | H | H | H | H | 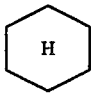 | (spiro) |
| C-14 | $(CH_3)_2CCHCH_2$ (Cl) | $(CH_3)_2CCH_2CH_2$ (Cl) | H | H | H | H | $CH_3$ | $CH_3$ |
| C-15 | $CH_3$ | $CH_3$ | H | H | H | H | $CH_3$ | $CH_3$ |
| C-16 | $(CH_3)_2C{=}CHCH_2$ | $(CH_3)_2C{=}CCH_2$ | H | H | H | H | $CH_3$ | $CH_3$ |
| C-17 | Cl | H | H | H | H | H | H | H |

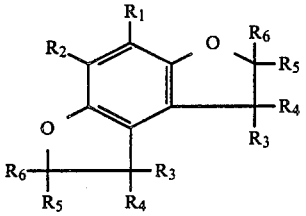

| Compound No. | $R_1$ | $R_2$ | $R_3$ | $R_4$ | $R_5$ | $R_6$ |
|---|---|---|---|---|---|---|
| D-1 | $CH_3$ | $CH_3$ | H | H | H | H |

-continued

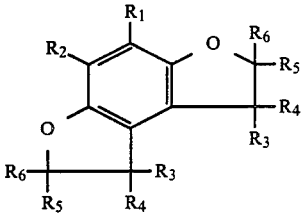

| Compound No. | $R_1$ | $R_2$ | $R_3$ | $R_4$ | $R_5$ | $R_6$ |
|---|---|---|---|---|---|---|
| D-2 | H | H | H | H | $CH_3$ | $CH_3$ |

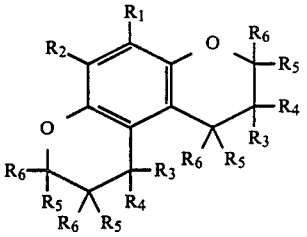

| Compound No. | $R_1$ | $R_2$ | $R_3$ | $R_4$ | $R_5$ | $R_6$ | $R_7$ | $R_8$ |
|---|---|---|---|---|---|---|---|---|
| D-3 | H | H | H | H | H | H | H | H |
| D-4 | H | H | H | H | H | H | $CH_3$ | $CH_3$ |
| D-5 | $CH_3$ | $CH_3$ | H | H | H | H | $CH_3$ | $CH_3$ |
| D-6 | $(CH_3)_2CCH_2CH_2$ (Cl) | $(CH_3)_2CCH_2CH_2$ (Cl) | H | H | H | H | $CH_3$ | $CH_3$ |
| D-7 | H | H | Cl | H | Cl | H | H | H |
| D-8 | H | H | H | H | H | H | 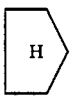 | (spiro) |

-continued

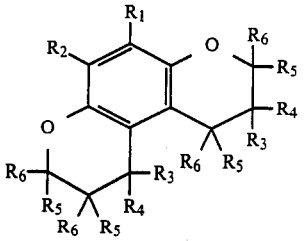

| Compound No. | $R_1$ | $R_2$ | $R_3$ | $R_4$ | $R_5$ | $R_6$ | $R_7$ | $R_8$ |
|---|---|---|---|---|---|---|---|---|
| D-9 | $CH_3O$ | H | H | H | H | H | 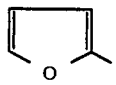 | H |
| D-10 | H | H | H | H | H | H | $CH_2OH$ | $CH_3$ |
| D-11 | 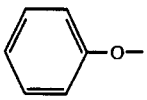 | H | H | H | H | H | $CH_3$ | $CH_3$ |

[E]

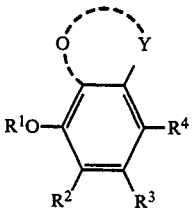

In the formula, $R^1$ represents a hydrogen atom, an alkyl group, an alkenyl group, an aryl group, an acyl group, a cycloalkyl group or a heterocyclic group, $R^3$ represents a hydrogen atom, a halogen atom, an alkyl group, an alkenyl group, an aryl group, an aryloxy group, an acyl group, an acylamino group, an acyloxy group, a sulfonamide group, a cycloalkyl group or an alkoxycarbonyl group.

$R^2$ and $R^4$ each represent a hydrogen atom, a halogen atom, an alkyl group, an alkenyl group, an aryl group, an acyl group, an acylamino group, a sulfonamide group, a cycloalkyl group or an alkoxycarbonyl group.

The groups as mentioned above may also be substituted with other substituents, respectively. For example, there may be included an alkyl group, an alkenyl group, an alkoxy group, an aryl group, an aryloxy group, a hydroxyl group, an alkoxycarbonyl group, an aryloxycarbonyl group, an acylamino group, a carbamoyl group, a sulfonamide group, a sulfamoyl group.

Also, $R^1$ and $R^2$ may be mutually subjected to ring closure to form a 5- or 6-membered ring.

In that case, $R^3$ and $R^4$ represent a hydrogen atom, a halogen atom, an alkyl group, an alkenyl group, an alkoxy group, an alkenyloxy group, a hydroxy group, an aryl group, an aryloxy group, an acyl group, an acylamino group, an acyloxy group, a sulfonamide group or an alkoxycarbonyl groups.

Y represents are group of atoms necessary for formation of a chroman ring or a coumaran ring. The chroman ring or coumaran ring may also be substituted with a halogen atom, an alkyl group, a cycloalkyl group, an alkoxy group, an alkenyl group, an alkenyloxy group, a hydroxy group, an aryl group, an aryloxy group or a heterocyclic group, and may further form a spiro ring.

Of the compounds represented by the formula [E], particularly useful compounds in the present invention are included in the compounds represented by the formulae [E-1], [E-2], [E-3], [E-4] and [E-5].

[E-1]

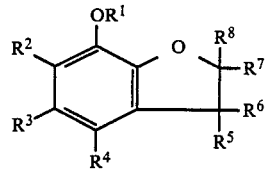

[E-2]

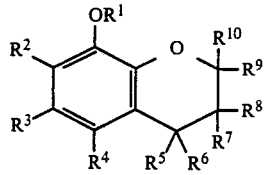

[E-3]

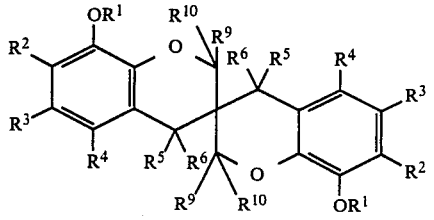

[E-4]

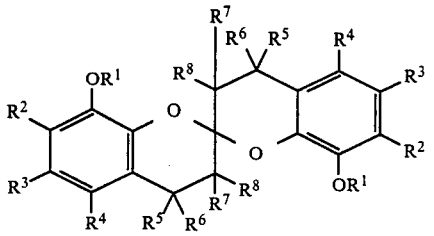

-continued

[E-5]

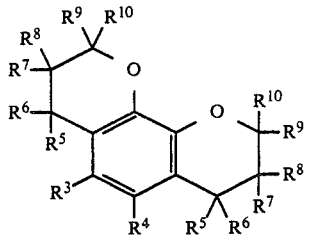

In the formulae [E-1] to [E-5], $R^1$, $R^2$, $R^3$ and $R^4$ have the same meanings in the above formula [E], $R^5$, $R^6$, $R^7$, $R^8$, $R^9$ and $R^{10}$ represent a hydrogen atom, a halogen atom, an alkyl group, an alkoxy group, a hydroxy group, an alkenyl group, an alkenyloxy group, an aryl group, an aryloxy group or a heterocyclic group. Further, $R^5$ and $R^6$, $R^6$ and $R^7$, $R^7$ and $R^8$, $R^8$ and $R^9$, and $R^9$ and $R^{10}$ may be mutually cyclized to form a carbon ring, and said carbon ring may be further substituted with alkyl groups.

In the above formulae [E-1] to [E-5], the compounds wherein $R^1$, $R^2$, $R^3$ and $R^4$ are a hydrogen atom, an alkyl group or a cycloalkyl group; in the above formula [E-5], the compounds in which $R^3$ and $R^4$ are a hydrogen atom, an alkyl group, an alkoxy group, a hydroxy group or a cycloalkyl group; and further, in the above formulae [E-1] to [E-5], the compound in which $R^5$, $R^6$, $R^7$, $R^8$, $R^9$ and $R^{10}$ are a hydrogen atom, an alkyl group or a cycloalkyl group are particularly useful.

The compounds represented by the formula [E] include the compounds described in Tetrahedron Letters, 1965. (8), pp. 457–460; Journal of Chemical Society of Japan (J. Chem. Soc. part C) 1966. (22), pp. 2013–2016; (Zh. Org. Khim) 1970, (6), pp. 1230–1237, and they can be synthesized according to the methods described in these literatures.

The amount of the compound represented by the above formula [E-1] used may be preferably 5 to 300 mole %, more preferably 10 to 200 mole % based on the magenta coupler according to the present invention as described above.

Typical examples of these compounds are shown below.

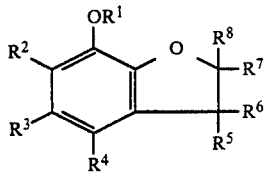

| Compound No. | $R_1$ | $R_2$ | $R_3$ | $R_4$ | $R_5$ | $R_6$ | $R_7$ | $R_8$ |
|---|---|---|---|---|---|---|---|---|
| E-19 | H | H | H | H | H | 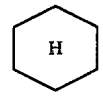 (condensed) | | H |
| E-20 | $C_3H_7$ | H | H | H | H | 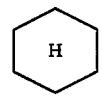 (condensed) | | H |
| E-21 | H | H | H | H | H | H | 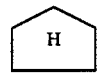 | (spiro) |
| E-22 | $CH_3$ | H | H | H | H | H | 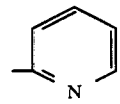 | H |
| E-23 | H | H | H | H | H | H | $CH_3$ | $CH_3$ |
| E-24 | $CH_3$ | H | 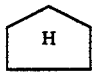 | H | H | H | $CH_3$ | $CH_3$ |
| E-25 | 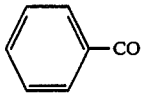 | H | H | H | H | H | $CH_3$ | $CH_3$ |
| E-26 | $C_{12}H_{25}$ | H | H | H | $CH_3$ | $CH_3$ | $CH_3$ | $CH_2OH$ |

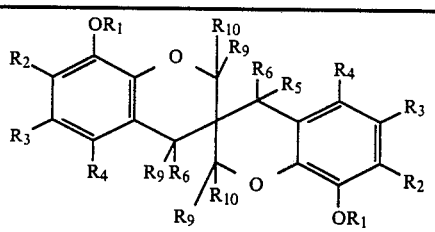

| Compound No. | $R_1$ | $R_2$ | $R_3$ | $R_4$ | $R_5$ | $R_6$ | $R_9$ | $R_{10}$ |
|---|---|---|---|---|---|---|---|---|
| E-27 | H | H | H | H | H | H | H | H |
| E-28 | $CH_3$ | H | H | H | H | H | H | H |
| E-29 | 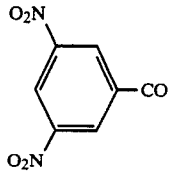 | H | H | H | H | H | H | H |
| E-30 | H | H | $CH_3$ | H | H | H | $CH_3$ | $CH_3$ |
| E-31 | $C_3H_7$ | H | H | H | H | H | H | H |
| E-32 | $C_3H_7$ | H | H | H | $CH_3$ | $CH_3$ | H | H |
| E-37 | H | H | H | $CH_3CONH$ | H | H | H | H |
| E-38 | CO | H | H | H | H | H | H | H |

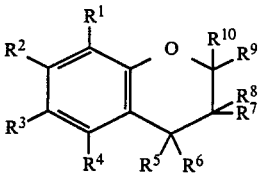

| Compound No. | $R_1$ | $R_2$ | $R_3$ | $R_4$ | $R_5$ | $R_6$ | $R_7$ | $R_8$ | $R_9$ | $R_{10}$ |
|---|---|---|---|---|---|---|---|---|---|---|
| E-1 | H | H | H | H | H | H | H | H | H | H |
| E-2 | H | H | H | H | H | H | H | H | $CH_3$ | $CH_3$ |
| E-3 | H | H | H | H | $CH_3$ | H | H | H | $CH_3$ | $CH_3$ |
| E-4 | H | H | $CH_2{=}CHCH_2$ | H | H | H | H | H | $CH_3$ | $CH_3$ |
| E-5 | $CH_3$ | H | H | H | H | H | H | H | $CH_3$ | $CH_3$ |
| E-6 | $C_3H_7$ | H | H | H | H | H | H | H | $CH_3$ | $CH_3$ |
| E-7 | $C_{12}H_{25}$ | H | H | H | $CH_3$ | H | H | H | $CH_3$ | $CH_3$ |
| E-8 | 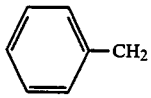 | H | H | H | H | H | H | H | H | H |
| E-9 | 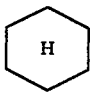 | H | H | H | H | H | H | H | $CH_3$ | $CH_3$ |
| E-10 | 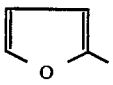 | H | H | H | H | H | H | H | $CH_3$ | $CH_3$ |
| E-11 | H | H | H | H | H | H | H | H | $CH_3$ | $C_{16}H_{33}$ |
| E-12 | H | H | 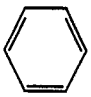 | H | H | H | H | H | $CH_3$ | $CH_3$ |
| E-13 | $CH_3$ | H | $CH_3CO$ | H | H | H | H | H | $CH_3$ | $CH_3$ |
| E-14 | $CH_3$ | H | H | H | H | Br | Br | H | H | H |
| E-15 | $CH_3$ | H | H | H | H | Cl | Cl | H | H | H |

-continued

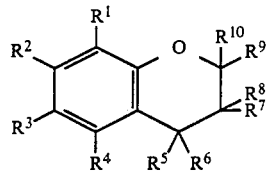

| Compound No. | $R_1$ | $R_2$ | $R_3$ | $R_4$ | $R_5$ | $R_6$ | $R_7$ | $R_8$ | $R_9$ | $R_{10}$ |
|---|---|---|---|---|---|---|---|---|---|---|
| E-16 | $CH_3$ | H | H | H | H | $CH_3O$ | Br | H | H | H |
| E-17 | $CH_3$ | H | H | H | H | OH | Br | H | $CH_3$ | $CH_3$ |
| E-18 | $CH_3$ | H | H | H | H | $C_2H_5O$ | OH | H | $CH_3$ | $CH_3$ |

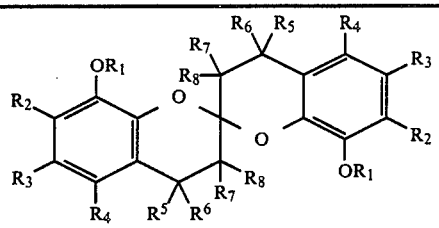

| Compound No. | $R_1$ | $R_2$ | $R_3$ | $R_4$ | $R_5$ | $R_6$ | $R_7$ | $R_8$ |
|---|---|---|---|---|---|---|---|---|
| E-33 | H | H | H | H | H | H | H | H |
| E-34 | H | H | H | H | $CH_3$ | $CH_3$ | H | H |
| E-35 | $C_{12}H_{25}$ | H | H | H | $CH_3$ | $CH_3$ | H | H |
| E-36 | $CH_3$ | H | $CH_3$ | H | $CH_3$ | $CH_3$ | H | H |

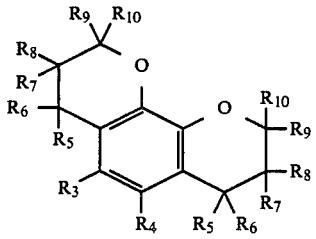

| Compound No. | $R_3$ | $R_4$ | $R_5$ | $R_6$ | $R_7$ | $R_8$ | $R_9$ | $R_{10}$ |
|---|---|---|---|---|---|---|---|---|
| E-39 | H | H | H | H | H | H | H | H |
| E-40 | H | H | H | H | H | H | $CH_3$ | $CH_3$ |
| E-41 | OH | H | H | H | H | H | $CH_3$ | $CH_3$ |
| E-42 | $C_3H_7O$ | H | $CH_3$ | $CH_3$ | H | H | H | H |

[F]

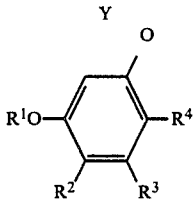

In the formula, $R_1$ represents a hydrogen atom, an alkyl group, an alkenyl group, an aryl group, an acyl group, a cycloalkyl group or a heterocyclic group, $R_2$ represents a hydrogen atom, a halogen atom, an alkyl group, an alkenyl group, an aryl group, an aryloxy group, an acyl group, an acylamino group, an acyloxy group, a sulfonamide group, a cycloalkyl group or an alkoxycarbonyl group.

$R_3$ represents a hydrogen atom, a halogen atom, an alkyl group, an alkenyl group, an aryl group, an acyl group, an acylamino group, a sulfonamide group, a cycloalkyl group or an alkoxycarbonyl group.

$R_4$ represents a hydrogen atom, a halogen atom, an alkyl group, an alkenyl group, an alkoxy group, an alkenyloxy group, a hydroxy group, an aryl group, an aryloxy group, an acyl group, an acylamino group, an acyloxy group, a sulfonamide group or an alkoxycarbonyl group.

The groups as mentioned above may also be substituted with other substituents, respectively. For example, there may be included an alkyl group, an alkenyl group, an alkoxy group, an aryl group, an aryloxy group, a hydroxy group, an alkoxycarbonyl group, an aryloxycarbonyl group, an acylamino group, a carbamoyl group, a sulfonamide group, a sulfamoyl group and the like.

Also, $R_1$ and $R_2$ may be mutually subjected to ring closure to form a 5- or 6-membered ring. In that case, $R_3$ and $R_4$ represent a hydrogen atom, a halogen atom, an alkyl group, an alkenyl group, an alkoxy group, an alkenyloxy group, a hydroxy group, an aryl group, an aryloxy group, an acyl group, an acylamino group, an acyloxy group, a sulfonamide group or an alkoxycarbonyl group.

Y represents a group of atoms necessary for formation of a chroman ring or a coumaran ring.

The chroman ring or coumaran ring may be also substituted with a halogen atom, an alkyl group, a cycloalkyl group, an alkoxy group, an alkenyl group, an alkenyloxy group, a hydroxy group, an aryl group, an aryloxy group or a heterocyclic group, or may further form a spiro ring.

Of the compounds represented by the formula [F], particularly useful compounds in the present invention are included in the compounds represented by the formulae [F-1], [F-2], [F-3], [F-4] and [F-5].

[F-1]

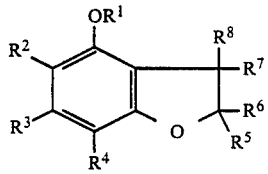

-continued

[F-2]

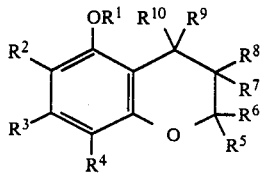

[F-3]

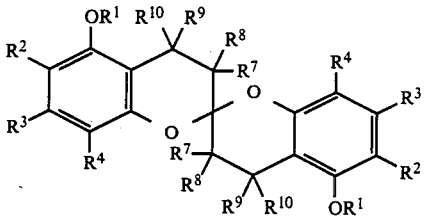

[F-4]

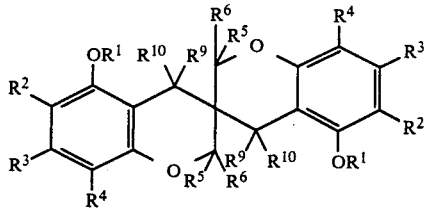

[F-5]

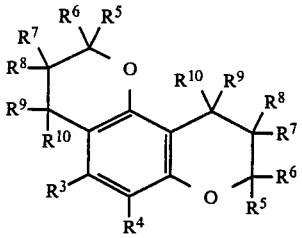

In the formulae [F-1] and [F-5], $R_1$, $R_2$, $R_3$ and $R_4$ have the same meanings as in the above formula [F], $R_5$, $R_6$, $R_7$, $R_8$, $R_9$ and $R_{10}$ represent a hydrogen atom, a halogen atom, an alkyl group, an alkoxy group, a hydroxy group, an alkenyl group, an alkenyloxy group, an aryl group, an aryloxy group or a heterocyclic group.

Further, $R_5$ and $R_6$, $R_6$ and $R_7$, $R_7$ and $R_8$, $R_8$ and $R_9$, and $R_9$ and $R_{10}$ may be mutually cyclized to form a carbon ring, and said carbon ring may be further substituted with alkyl groups.

Also, in the formulae [F-3], [F-4] and [F-5], respective two groups of $R_1$–$R_{10}$ may be either the same or different.

In the above formulae [F-1], [F-2], [F-3], [F-4] and [F-5], the compounds in which $R_1$, $R_2$ and $R_3$ are a hydrogen atom, an alkyl group, a cycloalkyl group, $R_4$ is a hydrogen atom, an alkyl group, an alkoxy group, a hydroxy group or a cycloalkyl group and further $R_5$, $R_6$, $R_7$, $R_8$, $R_9$ and $R_{10}$ are a hydrogen atom, an alkyl group or a cycloalkyl group are particularly useful.

The compounds represented by the formula [F] include the compounds described in Tetrahedron Letters 1970, Vol. 26, pp. 4743–4751; Journal of Chemical Society of Japan 1972, No. 10, pp. 1987–1990; Synthesis 1975, Vol. 6, pp. 392–393, (Bul Soc, Chim, Belg) 1975, Vol. 84 (7), pp. 747–759, and they can be synthesized according to the methods described in the literatures.

The amount of the compounds represented by the above formula [F] used may be preferably 5 to 300 mole %, more preferably 10 to 200 mole % based on the magenta coupler according to the present invention as described above.

Typical examples of the compounds represented by the formula [F] are shown below.

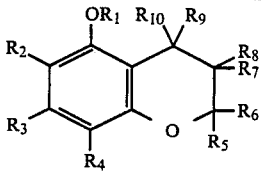

| Compound No. | $R_1$ | $R_2$ | $R_3$ | $R_4$ | $R_5$ | $R_6$ | $R_7$ | $R_8$ | $R_9$ | $R_{10}$ |
|---|---|---|---|---|---|---|---|---|---|---|
| F-1 | H | H | H | H | H | H | H | H | H | H |
| F-2 | H | H | H | H | $CH_3$ | $CH_3$ | H | H | $CH_3$ | H |
| F-3 | H | H | H | H | $CH_3$ | $CH_3$ | H | H | H | H |
| F-4 | H | $(CH_3)_2C{=}CCHCH_2$ | H | H | $CH_3$ | $CH_3$ | H | H | H | H |
| F-5 | $CH_3$ | H | H | H | $CH_3$ | $CH_3$ | H | H | H | H |
| F-6 | $C_3H_7$ | H | H | H | $CH_3$ | $CH_3$ | H | H | H | H |
| F-7 | $C_{12}H_{25}$ | H | H | H | $CH_3$ | $CH_3$ | H | H | H | H |
| F-8 | 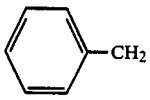 | H | H | H | $CH_3$ | $CH_3$ | H | H | H | H |
| F-9 | 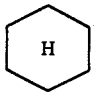 | H | H | H | $CH_3$ | $CH_3$ | H | H | H | H |
| F-10 | 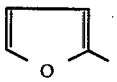 | H | H | H | $CH_3$ | $CH_3$ | H | H | H | H |

-continued

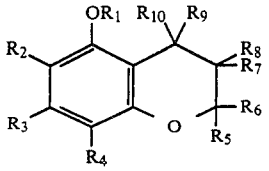

| Compound No. | $R_1$ | $R_2$ | $R_3$ | $R_4$ | $R_5$ | $R_6$ | $R_7$ | $R_8$ | $R_9$ | $R_{10}$ |
|---|---|---|---|---|---|---|---|---|---|---|
| F-20 | H | Cl | H | H | H | 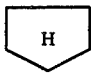 | (condensed) | H | H | H |
| F-21 | H | H | H | H | $CH_3$ | $CH_2OH$ | H | H | $CH_3$ | $CH_3$ |
| F-22 | $C_3H_7$ | (t)$C_8H_{17}$ | H | H | $C_2H_5$ | $CH_3$ | H | H | H | H |
| F-23 | $CH_3CO$ | H | H | H | $CH_3$ | $CH_3$ | H | H | $CH_3$ | H |

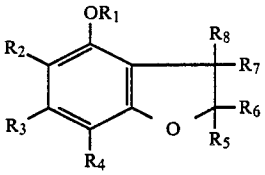

| Compound No. | $R_1$ | $R_2$ | $R_3$ | $R_4$ | $R_5$ | $R_6$ | $R_7$ | $R_8$ |
|---|---|---|---|---|---|---|---|---|
| F-11 | H | H | H | H | H | 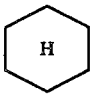 (condensed) | | H |
| F-12 | $C_3H_7$ | H | H | H | H | 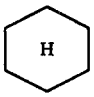 (condensed) | | H |
| F-13 | H | H | H | H | H | H | H | H |
| F-14 | H | H | H | H | H | H | $CH_3$ | H |
| F-15 | H | H | $CH_3$ | H | H | H | $CH_3$ | H |
| F-16 | H | H | 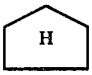 | H | H | H | $CH_3$ | H |
| F-17 | H | H | 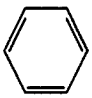 | H | H | H | $CH_3$ | H |
| F-18 | $C_3H_7$ | H | $CH_3$ | H | H | H | $CH_3$ | H |
| F-19 | 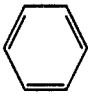 | H | H | H | 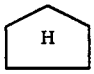 | (spiro) | H | H |
| F-24 | $CH_2{=}CHCH_2$ | $CH_3$ | $CH_3$ | H | H | $C_2H_5O$ | $CH_3$ | $CH_3$ |
| F-25 | $C_3H_7$ | H | H | H | H | 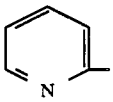 | $CH_3$ | $CH_3$ |

-continued

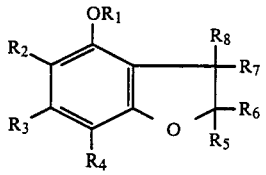

| Compound No. | $R_1$ | $R_2$ | $R_3$ | $R_4$ | $R_5$ | $R_6$ | $R_7$ | $R_8$ |
|---|---|---|---|---|---|---|---|---|
| F-26 | H | $CH_3$ | $CH_3$ | H | H | H | 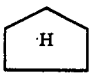 | (spiro) |

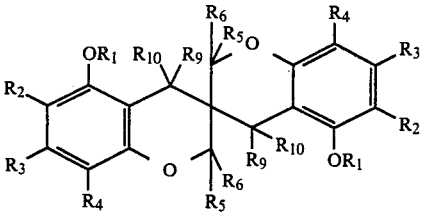

| Compound No. | $R_1$ | $R_2$ | $R_3$ | $R_4$ | $R_5$ | $R_6$ | $R_9$ | $R_{10}$ |
|---|---|---|---|---|---|---|---|---|
| F-27 | H | H | H | H | H | H | $CH_3$ | $CH_3$ |
| F-28 | $C_3H_7$ | H | H | H | H | H | $CH_3$ | $CH_3$ |
| F-29 | H | H | H | $(t)C_8H_{17}$ | H | H | H | H |
| F-30 | H | Cl | H | H | H | H | 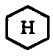 | (spiro) |

-continued

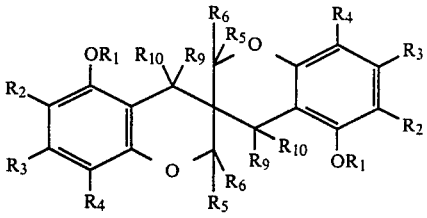

| Compound No. | $R_1$ | $R_2$ | $R_3$ | $R_4$ | $R_5$ | $R_6$ | $R_9$ | $R_{10}$ |
|---|---|---|---|---|---|---|---|---|
| F-31 | 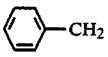 | H | H | H | H | H | $CH_3$ | $CH_3$ |

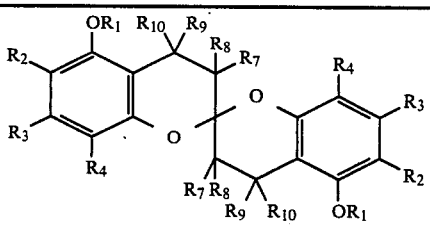

| Compound No. | $R_1$ | $R_2$ | $R_3$ | $R_4$ | $R_7$ | $R_8$ | $R_9$ | $R_{10}$ |
|---|---|---|---|---|---|---|---|---|
| F-32 | H | H | H | H | H | H | $CH_3$ | $CH_3$ |
| F-33 | $CH_3$ | H | H | H | H | H | $CH_3$ | $CH_3$ |
| F-34 | H | $CH_3$ | H | H | H | H | H | H |
| F-35 | H | H | H | $(t)C_4H_9$ | H | H | $CH_3$ | $CH_3$ |
| F-36 | H | 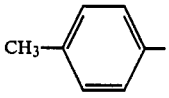 | H | H | H | H | $CH_3$ | $CH_3$ |
| F-37 | H | H | H | $CH_3SO_2NH$ | H | H | H | H |
| F-38 | 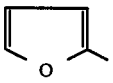 | H | H | H | H | H | $CH_3$ | $CH_3$ |
| F-39 | $C_{12}H_{25}$ | H | H | H | H | H | $CH_3$ | $CH_3$ |
| F-40 | 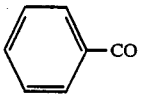 | H | H | H | H | H | 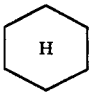 | (spiro) |

-continued

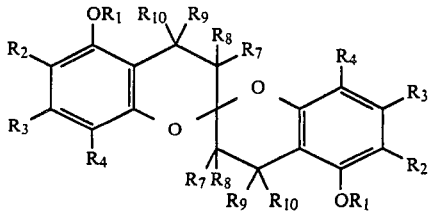

| Compound No. | $R_1$ | $R_2$ | $R_3$ | $R_4$ | $R_7$ | $R_8$ | $R_9$ | $R_{10}$ |
|---|---|---|---|---|---|---|---|---|
| F-41 | H | H | H | H | H | H | $CH_3$ | $CH_3$ |

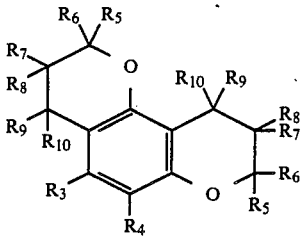

| Compound No. | $R_3$ | $R_4$ | $R_5$ | $R_6$ | $R_7$ | $R_8$ | $R_9$ | $R_{10}$ |
|---|---|---|---|---|---|---|---|---|
| F-42 | H | H | $CH_3$ | $CH_3$ | H | H | H | H |
| F-43 | H | H | H | (spiro) | H | H | H | H |
| F-44 | H | OH | $CH_3$ | $CH_3$ | H | H | $CH_3$ | H |
| F-45 | H | $C_3H_7O$ | H | H | H | H | $CH_3$ | $CH_2OH$ |
| F-46 | OH | H | $CH_3$ | $CH_3$ | H | H | H | H |
| F-47 | $C_3H_7O$ | H | $CH_3$ | $CH_3$ | H | H | H | H |

[G]

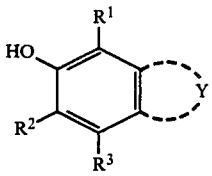

In the formula, $R^1$ and $R^3$ each represent a hydrogen atom, a halogen atom, an alkyl group, an alkenyl group, an alkoxy group, a hydroxy group, an aryl group, an aryloxy group, an acyl group, an acylamino group, an acyloxy group, a sulfonamide group, a cycloalkyl group or an alkoxycarbonyl group.

$R^2$ represents a hydrogen atom, a halogen atom, an alkyl group, an alkenyl group, a hydroxy group, an aryl group, an acyl group, an acylamino group, an acyloxy group, a sulfonamide group, a cycloalkyl group or an alkoxycarbonyl group.

The groups as mentioned above may also be substituted with other substituents. Examples of the substituent may include an alkyl group, an alkenyl group, an alkoxy group, an aryl group, an aryloxy group, a hydroxy group, an alkoxycarbonyl group, an aryloxycarbonyl group, an acylamino group, a carbamoyl group, a sulfonamide group, a sulfamoyl group and the like.

Also, $R^2$ and $R^3$ may be mutually subjected to ring closure to form a 5- or 6-membered hydrocarbon ring, the 5- or 6-membered hydrocarbon ring may be also substituted with a halogen atom, an alkyl group, a cycloalkyl group, an alkoxy group, an alkenyl group, a hydroxy group, an aryl group, an aryloxy group or a heterocyclic group.

Y represents a group of atoms necessary for formation of indane ring. The indane ring may be also substituted with a halogen atom, an alkyl group, an alkenyl group, an alkoxy group, a cycloalkyl group, a hydroxy group, an aryl group, an aryloxy group or a heterocyclic group, and may further form a spiro ring.

Of the compounds represented by the formula [G], particularly useful compounds in the present invention are included in the compounds represented by the formulae [G-1]-[G-3].

[G-1]

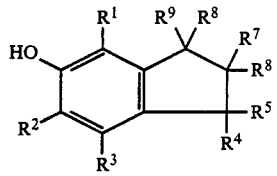

[G-2]

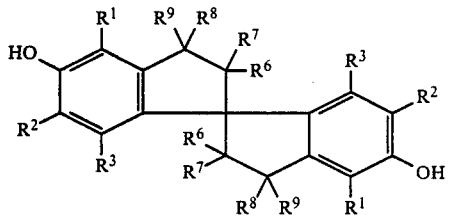

[G-3]

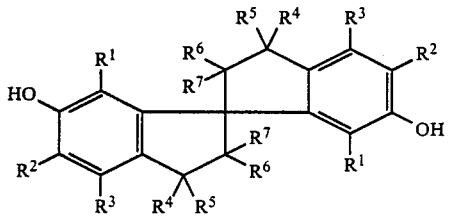

In the formulae [G-1]-[G-3], $R^1$, $R^2$ and $R^3$ have the same meanings as in the formula [G], $R^4$, $R^5$, $R^6$, $R^7$, $R^8$ and $R^9$ each represent a hydrogen atom, a halogen atom, an alkyl group, an alkoxy group, an alkenyl group, a hydroxy group, an aryl group, an aryloxy group or a heterocyclic group. $R^4$ and $R^5$, $R^5$ and $R^6$, $R^6$ and $R^7$, $R^7$ and $R^8$ and $R^8$ and $R^9$ may be mutually be subjected to ring closure to form a hydrocarbon ring, and said hydrocarbon ring may be further substituted with an alkyl group.

In the above formulae [G-1]-[G-3], the compounds in which $R^1$ and $R^3$ are a hydrogen atom, an alkyl group, an alkoxy group, a hydroxy group or a cycloalkyl group, $R^2$ is a hydrogen atom, an alkyl group, a hydroxy group or a cycloalkyl group, $R^4$, $R^5$, $R^6$, $R^7$, $R^8$ and $R^9$ are a hydrogen atom, an alkyl group or a cycloalkyl group are particularly useful.

The amount of the compound represented by the formula [G] may preferably 5 to 300 mole %, more preferably 10 to 200 mole % base on the magenta coupler.

Typical examples of the formula [G] are shown below.

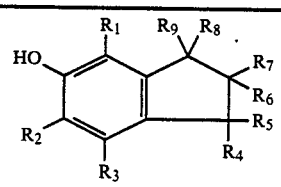

| Compound No. | $R^1$ | $R^2$ | $R^3$ | $R^4$ | $R^5$ | $R^6$ | $R^7$ | $R^8$ | $R^9$ |
|---|---|---|---|---|---|---|---|---|---|
| G-1 | H | H | H | H | H | H | H | H | H |
| G-2 | H | H | H | H | H | H | H | $CH_3$ | $CH_3$ |
| G-3 | H | H | H | H | H | H | H | $CH_3$ | $C_{16}H_{33}$ |
| G-4 | H | OH | H | H | H | H | H | $CH_3$ | $C_{16}H_{33}$ |
| G-5 | H | H | H | $CH_3$ | $CH_3$ | H | H | $CH_3$ | $CH_3$ |
| G-6 | H | Cl | H | $CH_3$ | $CH_3$ | H | H | $CH_3$ | $CH_3$ |
| G-7 | Cl | Cl | H | $CH_3$ | $CH_3$ | H | H | $CH_3$ | $CH_3$ |
| G-8 | H | H | $CH_3$ | $CH_3$ | $CH_3$ | H | H | $CH_3$ | $CH_3$ |
| G-9 | H | H | H | H | 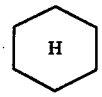 | (condensed) | H | H | H |
| G-10 | H | H | H | H | H | H | H | 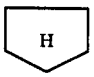 | (spiro) |
| G-11 | H | $C_3H_7$ | H | $CH_3$ | $CH_3$ | H | H | $CH_3$ | $CH_3$ |
| G-12 | H | (t)$C_8H_{17}$ | H | $CH_3$ | $CH_3$ | H | H | $CH_3$ | $CH_3$ |
| G-13 | H | 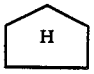 | H | $CH_3$ | $CH_3$ | H | H | $CH_3$ | $CH_3$ |
| G-14 | H | H | H | 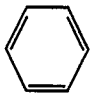 | $CH_3$ | H | H | $CH_3$ | $CH_3$ |
| G-15 | H | H | $CH_3O$ | $CH_3$ | $CH_3$ | H | H | $CH_3$ | $CH_3$ |
| G-16 | $CH_3H$ | H | H | H | 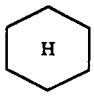 | (condensed) | H | H | H |
| G-17 | H | $CH_3SO_2NH$ | H | $CH_3$ | $CH_3$ | H | H | $CH_3$ | $CH_3$ |
| G-18 | H | $CH_3CO$ | H | $CH_3$ | $CH_3$ | H | H | $CH_3$ | $CH_3$ |
| G-19 | H | 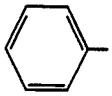 | H | $CH_3$ | $CH_3$ | H | H | $CH_3$ | $CH_3$ |
| G-20 | H | 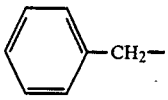 | H | $CH_3$ | $CH_3$ | H | H | $CH_3$ | $CH_3$ |

-continued

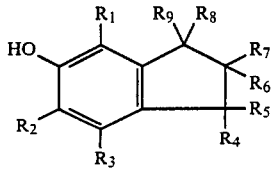

| Compound No. | $R^1$ | $R^2$ | $R^3$ | $R^4$ | $R^5$ | $R^6$ | $R^7$ | $R^8$ | $R^9$ |
|---|---|---|---|---|---|---|---|---|---|
| G-21 | H | 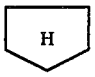 | (condensed) | H | H | H | H | H | H |
| G-22 | H | 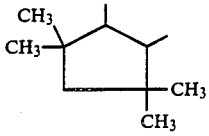 | (condensed) | $CH_3$ | $CH_3$ | H | H | $CH_3$ | $CH_3$ |
| G-23 | H | 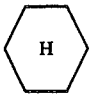 | (condensed) | $CH_3$ | $CH_3$ | H | H | $CH_3$ | $CH_3$ |
| G-24 | $CH_3$ | 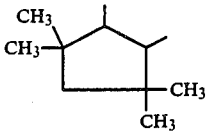 | (condensed) | $CH_3$ | $CH_3$ | H | H | $CH_3$ | $CH_3$ |

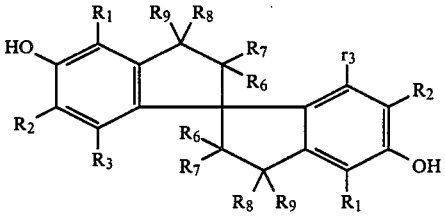

| Compound No. | $R^1$ | $R^2$ | $R^3$ | $R^6$ | $R^7$ | $R^8$ | $R^9$ |
|---|---|---|---|---|---|---|---|
| G-29 | H | H | H | H | H | $CH_3$ | $CH_3$ |

-continued

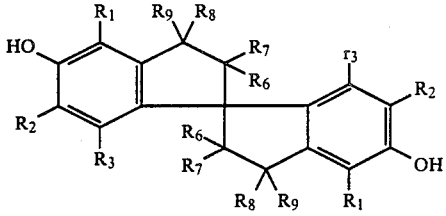

| Compound No. | $R^1$ | $R^2$ | $R^3$ | $R^6$ | $R^7$ | $R^8$ | $R^9$ |
|---|---|---|---|---|---|---|---|
| G-32 | $CH_3$ | H | H | H | H | $CH_3$ | $CH_3$ |

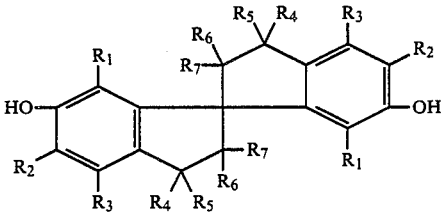

| Compound No. | $R_1$ | $R_2$ | $R_3$ | $R_4$ | $R_5$ | $R_6$ | $R_7$ |
|---|---|---|---|---|---|---|---|
| G-25 | H | $CH_3$ | H | $CH_3$ | $C_6H_5$ | H | H |
| G-26 | Cl | Cl | H | $CH_3$ | $CH_3$ | H | H |
| G-27 | H | OH | H | $CH_3$ | $CH_3$ | H | H |
| G-28 | H | $C_3H_7$ | H | $CH_3$ | $CH_3$ | H | H |
| G-30 | H | Cl | H | $CH_3$ | $CH_3$ | H | H |
| G-31 | H | $C_2H_5$ | H | $CH_3$ | $CH_3$ | H | H |
| G-33 | $CH_3$ | $CH_3$ | H | $CH_3$ | $CH_3$ | H | H |

-continued

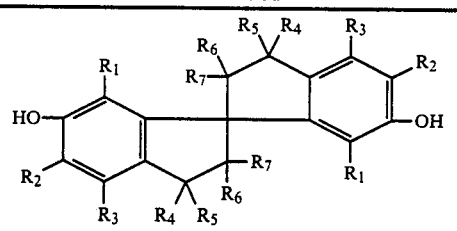

| Compound No. | $R_1$ | $R_2$ | $R_3$ | $R_4$ | $R_5$ | $R_6$ | $R_7$ |
|---|---|---|---|---|---|---|---|
| G-34 | H | 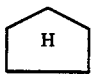 | H | $CH_3$ | $CH_3$ | H | H |
| G-35 | H | $CH_3$ | H | H | H | H | H |
| G-36 | H | H | H | 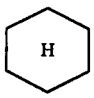 | (spiro) | H | H |
| G-37 | $CH_3$ | H | H | $CH_3$ | $CH_3$ | H | H |
| G-38 | H | $CH_3$ | H | $CH_3$ | $C_6H_5$ | H | H |
| G-39 | 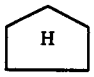 | H | H | $CH_3$ | $CH_3$ | H | H |
| G-40 | $CH_3$ | $CH_3$ | H | $C_2H_5$ | $C_2H_5$ | H | H |
| G-41 | H | H | H | H | H | $CH_3$ | $CH_3$ |
| G-42 | H | OH | H | 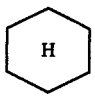 | (spiro) | H | H |
| G-43 | H | 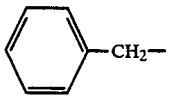 | H | H | H | H | H |
| G-44 | H | (t)$C_4H_9$ | H | $CH_3$ | $CH_3$ | H | H |
| G-45 | H | (t)$C_8H_{17}$ | H | $CH_3$ | $CH_3$ | H | H |

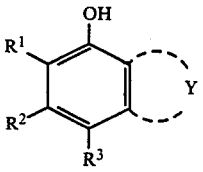

[H]

In the formula, $R^1$ and $R^2$ each represent a hydrogen atom, a halogen atom, an alkyl group, an alkenyl group, an aryl group, an acyl group, an acylamino group, an acyloxy group, a sulfonamide group, a cycloalkyl group or an alkoxycarbonyl group.

$R^3$ represents a hydrogen atom, a halogen atom, an alkyl group, an alkenyl group, an alkoxy group, a hydroxy group, an aryl group, an aryloxy group, an acyl group, an acylamino group, an acyloxy group, a sulfonamide group, a cycloalkyl group or an alkoxycarbonyl group.

Each of the above groups may be substituted with other substituents, such as an alkyl group, an alkenyl group, an alkoxy group, an aryl group, an aryloxy group, a hydroxy group, an alkoxycarbonyl group, an aryloxycarbonyl group, an acylamino group, a carbamoyl group, a sulfonamide group, a sufamoyl group and others.

Also, $R^1$ and $R^2$, $R^2$ and $R^3$ may be mutually subjected to a ring closure to form a 5- or 6-membered hydrocarbon ring, and said hydrocarbon ring may also be substituted with a halogen atom, an alkyl group, a cycloalkyl group, an alkoxy group, an alkenyl group, a hydroxy group, an aryl group, an aryloxy group, a heterocyclic group and others.

Y represents a group of atoms necessary for formation of indane ring and said indane ring may be substituted with substituents which may substitute the above hydrocarbon ring, or it may further form a spiro ring. Of the compounds represented by the formula [H], particularly useful compounds in the present are included in the compounds represented by the formulae [H-1] to [H-3].

[H-1]

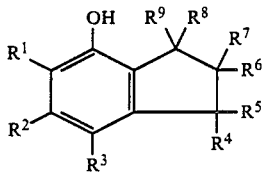

[H-2]

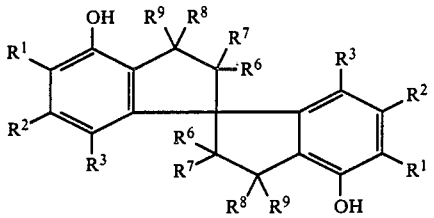

[H-3]

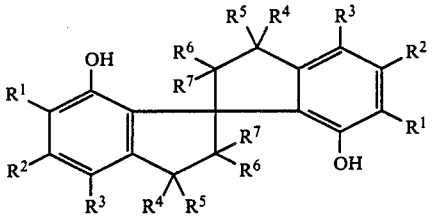

In the formulae [H-1] to [H-3], $R^1$, $R^2$ and $R^3$ have the same meanings as in the formula [H], $R^4$, $R^5$, $R^6$, $R^7$, $R^8$ and $R^9$ each represent a hydrogen atom, a halogen atom, an alkyl group, an alkoxy group, a hydroxy group, an alkenyl group, an aryl group, and aryloxy group or a heterocyclic group. Also, $R^4$ and $R^5$, $R^5$ and $R^6$, $R^6$ and $R^7$, $R^7$ and $R^8$, and $R^8$ and $R^9$ may be mutually subjected to ring closure to form a hydrocarbon ring, and said hydrocarbon ring may be further substituted with alkyl groups.

In the above formulae [H-1] to [H-3], the compounds in which $R^1$ and $R^2$ are each a hydrogen atom, an alkyl group or a cycloalkyl group, $R^3$ is a hydrogen atom, an alkyl group, an alkoxy group, an hydroxy group or a cycloalkyl group, $R^4$, $R^5$, $R^6$, $R^7$, $R^8$ and $R^9$ are each a hydrogen atom, an alkyl group or a cycloalkyl group are particularly useful.

The method for synthesizing the compounds represented by the above formula [H] is already known, and they can be produced according to U.S. Pat. No. 3,057,929; Chem. Ber. 1972, 95(5), pp. 1673–1674; Chemistry Letters, 1980, pp. 739–742.

The amount of the compound represented by the above formula [H] used may be preferably 5 to 300 mole %, more preferably 10 to 200 mole %.

Typical examples of the compound represented by the formula [H] are shown below.

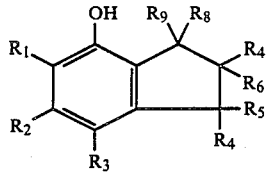

| Compound No. | $R^1$ | $R^2$ | $R^3$ | $R^4$ | $R^5$ | $R^6$ | $R^7$ | $R^8$ | $R^9$ |
|---|---|---|---|---|---|---|---|---|---|
| H-1 | H | H | H | H | H | H | H | H | H |
| H-2 | $CH_3$ | H | H | H | H | H | H | H | H |
| H-3 | H | H | H | H | H | H | H | $CH_3$ | $C_{16}H_{33}$ |
| H-4 | H | H | OH | H | H | H | H | H | H |
| H-5 | $CH_2{=}CHCH_2$ | H | Cl | H | H | H | H | H | H |
| H-6 | H | H | H | H | H | H | H | $CH_3$ | $CH_3$ |
| H-7 | H | H | H | $CH_3$ | $CH_3$ | H | H | H | H |
| H-8 | H | H | H | $CH_3$ | $CH_3$ | $CH_3$ | H | H | H |
| H-9 | $CH_2{=}CHCH_2$ | H | $CH_3O$ | H | H | H | H | H | H |
| H-10 | H | H | H | $CH_3$ | $CH_3$ | H | H | $CH_3$ | $CH_3$ |
| H-11 | H | $C_3H_7$ | H | $CH_3$ | $CH_3$ | H | H | $CH_3$ | $CH_3$ |
| H-12 | Cl | H | Cl | H | H | H | H | $CH_3$ | $CH_3$ |
| H-13 | H | H | H | H | 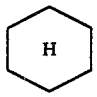 | (condensed) | H | H | H |
| H-14 | H | H | H | H | H | H | H | 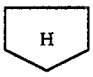 | (spiro) |
| H-15 | H | 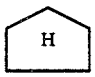 | H | $CH_3$ | $CH_3$ | H | H | $CH_3$ | $CH_3$ |
| H-16 | H | $CH_3SO_2NH$ | H | $CH_3$ | $CH_3$ | H | H | $CH_3$ | $CH_3$ |
| H-17 | H | $CH_3CO$ | H | H | H | H | H | $CH_3$ | $CH_3$ |
| H-18 | H | 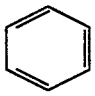 | H | $CH_3$ | $CH_3$ | H | H | $CH_3$ | $CH_3$ |

-continued

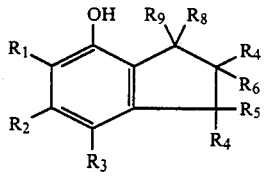

| Compound No. | $R^1$ | $R^2$ | $R^3$ | $R^4$ | $R^5$ | $R^6$ | $R^7$ | $R^8$ | $R^9$ |
|---|---|---|---|---|---|---|---|---|---|
| H-19 | H | 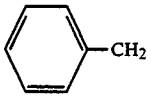 | H | $CH_3$ | $CH_3$ | H | H | $CH_3$ | $CH_3$ |
| H-21 | 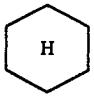 | (condensed) | $CH_3$ | H | H | H | H | $CH_3$ | $CH_3$ |
| H-22 | H | H | H | $CH_3$ | 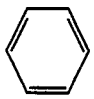 | H | H | $CH_3$ | $CH_3$ |

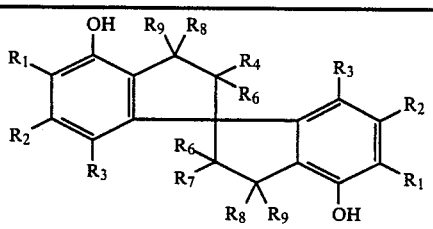

| Compound No. | $R_1$ | $R_2$ | $R_3$ | $R_6$ | $R_7$ | $R_8$ | $R_9$ |
|---|---|---|---|---|---|---|---|
| H-23 | H | H | H | H | H | H | H |
| H-24 | H | H | OH | H | H | H | H |
| H-25 | $CH_3$ | H | $CH_3$ | H | H | H | H |
| H-26 | H | H | $CH_3$ | H | H | H | H |
| H-27 | Cl | H | Cl | H | H | $CH_3$ | $CH_3$ |
| H-28 | H | H | H | H | H | H | 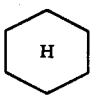 (spiro) |
| H-29 | H | H | H | H | H | $CH_3$ | 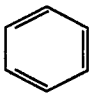 |
| H-30 | H | H | 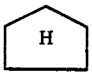 | H | H | H | H |
| H-31 | H | H | 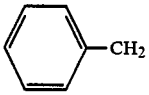 | H | H | $CH_3$ | $CH_3$ |
| H-36 | H | H | $(t)C_4H_9$ | H | H | $CH_3$ | $CH_3$ |

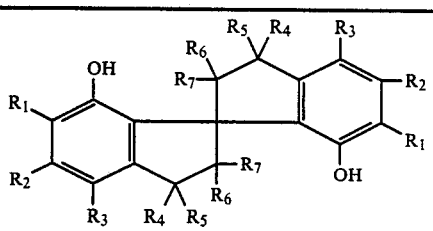

| Compound No. | $R_1$ | $R_2$ | $R_3$ | $R_4$ | $R_5$ | $R_6$ | $R_7$ |
|---|---|---|---|---|---|---|---|
| H-32 | H | H | H | H | H | H | H |
| H-33 | H | H | H | $CH_3$ | $CH_3$ | H | H |
| H-34 | H | H | $(t)C_4H_9$ | $CH_3$ | $CH_3$ | H | H |
| H-35 | H | H | $(t)C_8H_{17}$ | $CH_3$ | $CH_3$ | H | H |

Others

H-20

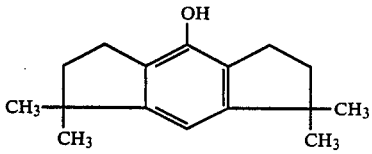

[J]

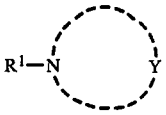

wherein $R^1$ represents an aliphatic group, a cycloalkyl or an aryl group,

Y represents a group of non-metal atoms necessary for formation of a 5- to 7-membered ring together with a nitrogen atom, provided that, when there are two or more hetero atoms among the non-metal atoms including a nitrogen atom forming said heterocyclic ring, at least two hetero atoms are hetero atoms which are not adjacent to each other.

The aliphatic group represented by $R^1$ may include saturated alkyl groups which may have substituents and unsaturated alkyl groups which may have substituents. Examples of the saturated alkyl group may include a methyl group, an ethyl group, a butyl group, and octyl group, a dodecyl group, a tetradecyl group, a hexadecyl group and the like, and examples of the unsaturated alkyl group may include an ethenyl group, a propenyl group and the like.

The cycloalkyl group represented by $R^1$ may include 5- to 7-membered cycloalkyl group which may have substituents, such as a cyclopentyl group, a cyclohexyl group and the like.

The aryl group represented by $R^1$ may include a phenyl group, a naphthyl group which may have substituents, respectively.

Examples of the substituents on the aliphatic group, cycloalkyl group and aryl group represented by $R^1$ may include an alkyl group, an aryl group, an alkoxy group, a carbonyl group, a carbamoyl group, an acylamino group, a sulfamoyl group, a sulfonamide group, a carbonyloxy group, an alkylsulfonyl group, an arylsulfonyl group, a hydroxy group, a heterocyclic group, an alkylthio group, and an arylthio group, and these substituents may further have subtituents.

In the above formula [J], Y represents a group of non-metal atoms necessary for formation of 5- to 7-membered heterocyclic ring, and at least two of the non-metal atom group including nitrogen atom forming said heterocyclic ring must be hetero atoms, and at least two of the hetero atoms must not be adjacent to each other. In the hererocyclic ring in the compound represented by the formula [J], it is not preferable that all the hetero atoms are adjacent to each other, because the function as the magenta dye image stabilizer cannot be exhibited.

The 5- to 7-membered heterocyclic ring in the compound represented by the formula by the above formula [J] may have substituents, including an alkyl group, an aryl group, an acyl group, a carbamoyl group, an alkoxycarbonyl group, a sulfonyl group, a sulfamoyl group, etc., and these substituents may further have substituents. Also, said 5- to 7-membered heterocyclic ring may be saturated but preferably an unsaturated heterocyclic ring. Said heterocyclic ring may be further fused with benzene ring, etc., and may further form a spiro ring.

The amount of the compounds represented by the above formula [J] of the present invention used may preferably 5 to 300 mole %, more preferably 10 to 200 mole % based on the magenta coupler represented by the above formula (I) of the present invention.

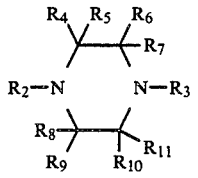

| | $R^2$ | $R^3$ | $R^4$ | $R^5$ | $R^6$ | $R^7$ | $R^8$ | $R^9$ | $R^{10}$ | $R^{11}$ |
|---|---|---|---|---|---|---|---|---|---|---|
| J-1 | $C_{12}H_{25}$ | $C_{12}H_{25}$ | H | H | H | H | H | H | H | H |
| J-2 | $C_{14}H_{29}$ | $C_{14}H_{29}$ | H | H | H | H | H | H | H | H |
| J-3 | $C_{14}H_{29}$ | H | H | H | H | H | H | H | H | H |
| J-4 | $C_{14}H_{29}$ | $CH_3CO$ | H | H | H | H | H | H | H | H |
| J-5 | $C_{16}H_{33}$ | $C_{16}H_{33}$ | H | H | H | H | H | H | H | H |
| J-6 | $C_{14}H_{29}$ | $CH_3$ | H | H | H | H | H | H | H | H |
| J-7 | 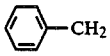 | 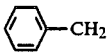 | H | H | H | H | H | H | H | H |
| J-8 | 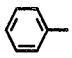 | 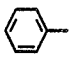 | H | H | H | H | H | H | H | H |
| J-11 | $CH_3$ | 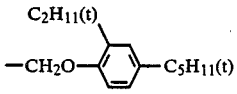 | H | H | H | H | H | H | H | H |
| J-13 | $C_{14}H_{29}$ | $C_4H_9NHCO$ | H | H | H | H | H | H | H | H |
| J-14 | $(t)C_8H_{17}$ | 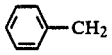 | H | H | H | H | H | H | H | H |
| J-15 | $C_{14}H_{29}$ | $CF_3CO$ | H | H | H | H | H | H | H | H |
| J-16 | $C_{14}H_{29}$ | $C_2H_5OCO$ | H | H | H | H | H | H | H | H |
| J-17 | $CH_3$ | 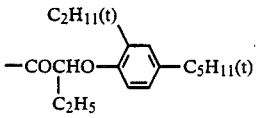 | H | H | H | H | H | H | H | H |
| J-18 | $C_{14}H_{29}$ | $C_{14}H_{29}$ | $CH_3$ | H | H | H | H | H | H | H |
| J-19 | $C_{14}H_{29}$ | $C_{14}H_{29}$ | $CH_3$ | H | H | H | H | H | $CH_3$ | H |

-continued

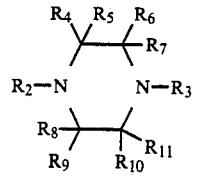

| | $R^2$ | $R^3$ | $R^4$ | $R^5$ | $R^6$ | $R^7$ | $R^8$ | $R^9$ | $R^{10}$ | $R^{11}$ |
|---|---|---|---|---|---|---|---|---|---|---|
| J-20 | $C_{14}H_{29}$ | $C_{14}H_{29}$ | $CH_3$ | $CH_3$ | $CH_3$ | $CH_3$ | $CH_3$ | $CH_3$ | $CH_3$ | $CH_3$ |
| J-21 | $CH_3$ | 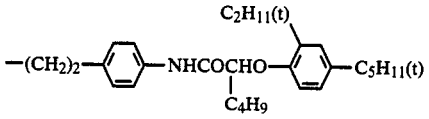 | H | H | H | H | H | H | H | H |
| J-22 | $C_{12}H_{25}$ | $CH_3$ | $CH_3$ | H | H | H | $CH_3$ | H | H | H |
| J-23 | $C_{12}H_{25}$ | $C_{12}H_{25}$ | $CH_3$ | H | H | H | H | H | $CH_3$ | H |
| J-24 | $C_{16}H_{33}$ | $C_{16}H_{33}$ | $CH_3$ | H | H | H | H | H | $CH_3$ | H |
| J-25 | $C_6H_5CH{=}CH{-}CH_2{-}$ | $C_{12}H_{25}$ | H | H | H | H | H | H | H | H |
| J-26 | $C_{12}H_{25}$ | $C_2H_5$ | $CH_3$ | H | H | H | H | H | H | H |
| J-27 | $C_{16}H_{33}$ | H | $C_2H_5$ | H | H | H | H | H | H | H |
| J-29 | $C_{14}H_{29}$ | $CH_2BrCH_2$ | H | H | H | H | H | H | H | H |
| J-30 | $CH_3O(CH_2)_4{-}$ | $CH_3O(CH_2)_4$ | H | H | H | H | H | H | H | H |

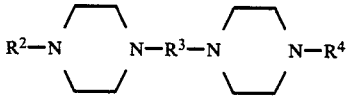

| | $R^2$ | $R^3$ | $R^4$ |
|---|---|---|---|
| J-9 | $C_{14}H_{29}$ | $(CH_2)_2$ | $C_{14}H_{29}$ |
| J-10 | $(t)C_8H_{17}$ | $(CH_2)_6$ | $(t)C_8H_{17}$ |
| J-12 | $C_{14}H_{29}$ | $CH_2$ | $C_{14}H_{29}$ |

-continued

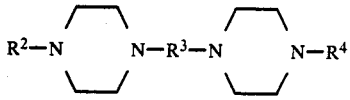

| | $R^2$ | $R^3$ | $R^4$ |
|---|---|---|---|
| J-28 | $C_{12}H_{25}$ | 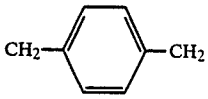 | $C_{12}H_{25}$ |

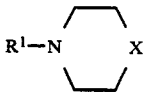

| | X | $R_1$ |
|---|---|---|
| J-31 | O | $C_{12}H_{25}$ |
| J-32 | O | $C_{14}H_{29}$ |
| J-33 | O | $C_6H_5CH{=}CH{-}$ |
| J-34 | O | 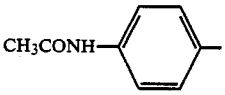 |
| J-35 | O | α-naphthyl |
| J-36 | O | 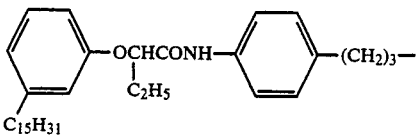 |
| J-37 | O | 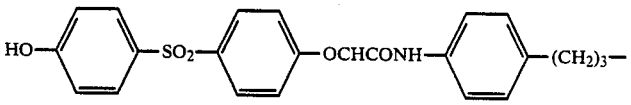 |

-continued
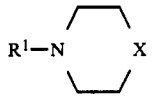
| | X | $R_1$ |
|---|---|---|
| J-38 | O | 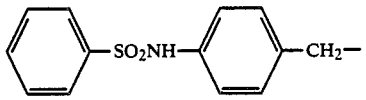 |
| J-39 | O | 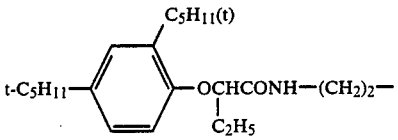 |
| J-40 | O | 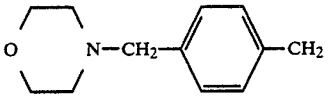 |
| J-41 | S | $C_{14}H_{29}$ |
| J-42 | S | 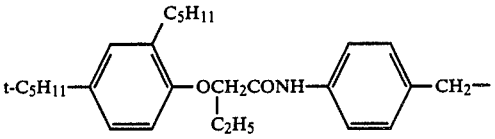 |
| J-43 | S | 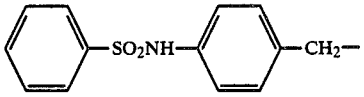 |
| J-44 | S | 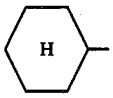 |
| J-45 | S | 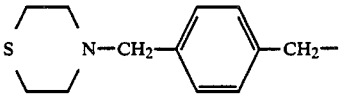 |
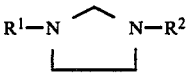
| | $R^1$ | $R^2$ |
|---|---|---|
| J-46 | $C_{12}H_{25}$ | $C_{12}H_{25}$ |
| J-47 | $C_{14}H_{29}$ | $C_{14}H_{29}$ |
| J-48 | $C_6H_5CH_2$ | $C_6H_5CH_2$ |
| J-49 | $C_{16}H_{33}$ | H |
| J-50 | $C_{16}H_{33}$ | $CH_3CO$ |
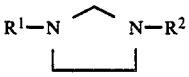
| | | |
|---|---|---|
| J-51 | $C_{16}H_{33}$ | $C_{16}H_{33}$ |
| J-52 | $C_{14}H_{29}$ | $C_{14}H_{29}$ |
| J-53 | $C_{12}H_{25}$ | $C_{12}H_{25}$ |
| J-54 | $C_{14}H_{29}$ | $CH_3CO$ |
| J-55 | $C_{14}H_{29}$ | $CF_3CO$ |

-continued
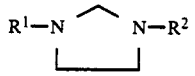
| | $R^1$ | $R^2$ |
|---|---|---|
| J-56 | $C_2H_5$ | 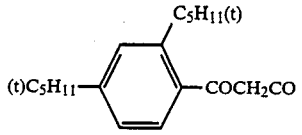 |
| J-57 | $C_{14}H_{29}$ | $C_2H_5OCO$ |
| J-58 | $C_{14}H_{29}$ | $CH_3NHCO$ |
| J-59 | $C_{14}H_{29}$ | $C_4H_9SO_2$ |
| J-60 | $C_{14}H_{29}$ | $(CH_3)_2NSO_2$ |
| J-61 | $C_{12}H_{25}$ | 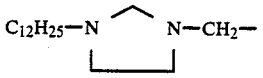 |
| J-62 | H | 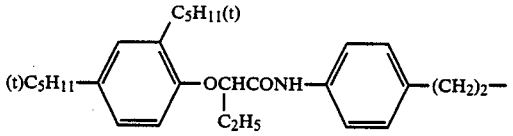 |
| J-63 | | 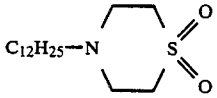 |
| J-64 | | 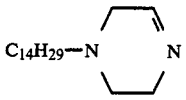 |
| J-65 | | 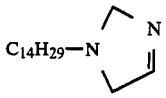 |
| J-66 | | 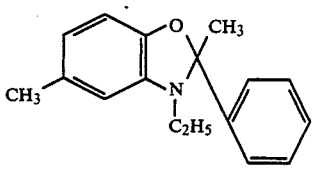 |
| J-67 | | 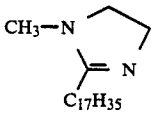 |
| J-68 | | 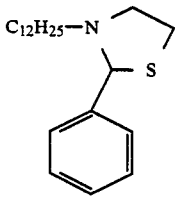 |

-continued

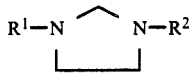

| $R^1$ | $R^2$ |
|---|---|
| J-69 | 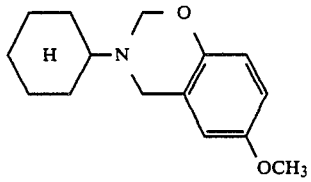 |
| J-70 | 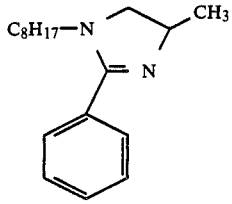 |
| J-71 | 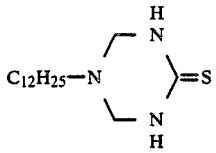 |
| J-72 | 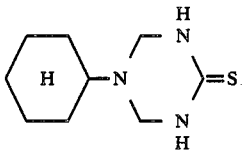 |
| J-73 | 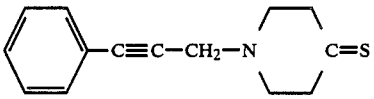 |
| J-74 | 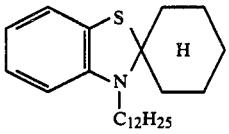 |

Of the compounds represented by the above formula [J], piperazine type compounds and homopiperazine type compounds are particularly preferable, and more preferable are compounds represented by the following formula [J-1] or [J-2].

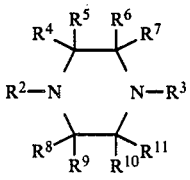

[J-1]

-continued

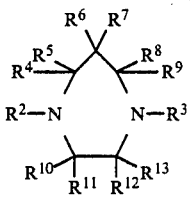

[J-2]

In the formulae, $R^2$ and $R^3$ each represent a hydrogen atom, an alkyl group or an aryl group, provided that $R^2$ and $R^3$ cannot be hydrogen atoms at the same time. Each of $R^4$ to $R^{13}$ represents a hydrogen atom, an alkyl group or an aryl group.

In the above formulae [j-1] and [J-2], $R^2$ and $R^3$ each represent a hydrogen atom, an alkyl group or an aryl group. Examples of the alkyl group represented by $R^2$ or $R^3$ include a methyl group, an ethyl group, a butyl group, an octyl group, a dodecyl group, a tetradecyl group, a hexadecyl group, an octadecyl group and the like. The aryl group represented by $R^2$ or $R^3$ may be, for example, a phenyl group and the like. The alkyl group and aryl group represented by $R^2$ or $R^3$ may have substituents, including a halogen atom, an alkyl group, an aryl group, an alkoxy group, an aryloxy group, a heterocyclic group, etc.

The total carbon atom numbers of $R^2$ and $R^3$ (including substituents) may preferably be 6 to 40.

In the above formula [J-1] or [J-2], each of $R^4$ to $R^{13}$ represents a hydrogen atom, an alkyl or aryl group. The alkyl group represented by $R^4$ to $R^{13}$ may include, for example, methyl, ethyl group and the like. The aryl group represented by $R^4$ to $R^{13}$ may be, for example, phenyl group and the like.

Specific examples of the compounds represented by the above formula [J-1] or [J-2] are as described in the above exemplary piperazine type compounds (J-1) to (J-30) and the above exemplary homopiperazine type compounds (J-51) to (J-62).

Next, synthesis examples of the typical magenta dye image stabilizers of the present invention represented by the above formula [J] are shown.

Synthesis example-1 (synthesis of the compound J-2)

In a solution of 9.0 g of piperazine and 55 g of myristyl bromide dissolved in 100 ml of acetone, 15 g of anhydrous potassium carbonate was added, and the reaction was carried out under boiling reflux for 10 hours. After the reaction, the reaction mixture was poured into 500 ml of water and then extracted with 500 ml of ethyl acetate. After the ethyl acetate layer was dried over magnesium sulfate, ethyl acetate was evaporated to obtain the desired product as white crystals. Recrystalization from 300 ml acetone gave 34 g of white scale-like crystals (yield 70%). m.p. 55°–58° C.

Synthesis example-2 (synthesis of the compound J-34)

After 18 g of 4-morphorinoaniline was dissolved in 100 ml of ethyl acetate, 12 ml of anhydrous acetic acid was added little by little under stirring while maintaining the reaction mixture at 20° C. After addition of anhydrous acetic acid, the mixture was ice-cooled, and the precipitated crystals were collected by filtration, and then recrystallized from ethyl acetate to obtain 16.5 g of white powdery crystals (yield 75%). m.p. 207°–210° C.

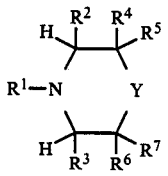

[K]

In the formula, $R^1$ represents an aliphatic, cycloalkyl or aryl group, Y represents a mere bonding or a divalent hydrocarbon group necessary for formation of a 5- to 7-membered heterocyclic ring together with the nitrogen atom. Each of $R^2$, $R^3$, $R^4$, $R^5$, $R^6$, $R^7$ represents a hydrogen atom, an aliphatic group, a cycloalkyl group or an aryl group, provided that $R^2$ and $R^4$, and $R^3$ and $R^6$ may be mutually bonded together to form a mere bonding for forming a 5- to 7-membered heterocyclic ring together with the nitrogen atom and Y. Also, when Y is a mere bonding, $R^5$ and $R^7$ may be bonded together to form a mere bonding for formation of a 5-membered heterocyclic ring together with the nitrogen atom and Y. On the other hand, when Y is not a mere bonding, $R^5$ and Y, $R^7$ and Y or Y itself may form unsaturated bonding for formation of a 6- or 7-membered heterocyclic ring together with the nitrogen atom and Y.

The aliphatic group represented by $R^1$ may include saturated alkyl groups which may have substituents and unsaturated alkyl groups which may have substituents. Examples of the saturated alkyl groups may include a methyl group, an ethyl group, a butyl group, an octyl group, a dodecyl group, a tetradecyl group, a hexadecyl group and the like, and examples of the unsaturated alkyl groups may include an ethenyl group, a propenyl group and the like.

The cycloalkyl group represented by $R^1$ may include 5- to 7-membered cycloalkyl groups which may have substituents such as a cyclopentyl group, a cyclohexyl group and the like.

The aryl group represented by $R^1$ may include a phenyl group and a naphthyl group which may have substituents.

The substituent on the aliphatic group, cycloalkyl group and aryl group represented by $R^1$ may include an alkyl group, an aryl group, an alkoxy group, a carbonyl group, a carbamoyl group, an acylamino group, a sulfamoyl group, a sulfonamide group, a carbonyloxy group, an alkylsulfonyl group, an arylsulfonyl group, a hydroxy group, a heterocyclic group, an alkylthio group, an arylthio group, etc., and these substituents may further have substituents.

In the above formula [K], Y represents a mere bonding or a divalent hydrocarbon group necessary for formation of a 5- to 7-membered heterocyclic ring together with the nitrogen atom. When Y is a mere bonding, further $R^5$ and $R^7$ may be mutually bonded together to form a mere bonding for formation of an unsaturated 5-membered heterocyclic ring; when Y is a divalent hydrocarbon group, namely in the case of a methylene group, $R^5$ and Y or $R^7$ and Y may form an unsaturated bonding for formation of an unsaturated 6-membered heterocyclic ring, or in the case of an ethylene group, $R^5$ and Y, $R^7$ and Y or Y itself may form an unsaturated bonding for formation of an unsaturated 7-membered heterocyclic ring. Further, the divalent hydrocarbon group represented by Y may have substituents and the substituents may include an alkyl group, a carbamoyl group, an alkyloxycarbonyl group, an acylamino group, a sulfonamide group, a sulfamoyl group, an aryl group, a heterocyclic group, etc.

In the above formula [K], each of $R^2$, $R^3$, $R^4$, $R^5$, $R^6$ and $R^7$ represents a hydrogen atom, an aliphatic group, a cycloalkyl group or an aryl group. The aliphatic group represented by $R^2$ to $R^7$ may include saturated alkyl groups which may have substituents and unsaturated alkyl groups which may have substituents. Examples of the alkyl group may include a methyl group, an ethyl group, a butyl group, an octyl group, a dodecyl group, a tetradecyl group, a hexadecyl group and the like, and examples of unsaturated alkyl groups may include an ethenyl group, a propenyl group and the like.

The cycloalkyl group represented by $R^2$ to $R^7$ may include 5- to 7-membered cycloalkyl group which may have substituents, such as a cyclopentyl group, a cyclohexyl group and the like.

The aryl group represented by $R^2$ to $R^7$ may include a phenyl group, a naphthyl group and the like which may have substituents.

The substituent on the aliphatic group, cycloalkyl group and aryl group represented by the above $R^2$ to $R^7$ may include an alkyl group, an aryl group, an alkoxy group, a carbonyl group, a carbamoyl group, an acylamino group, a sulfamoyl group, a sulfonamide group, a carbonyloxy group, an alkylsulfonyl group, an arylsulfonyl group, a hydroxy group, a heterocyclic group, an alkylthio group, etc.

Of the compounds represented by the above formula [K], those having 5- to 7-membered saturated heterocyclic rings are more preferable than those having unsaturated rings.

The amount of the compound represented by the above formula [K] used may preferably 5 to 300 mole %, more preferably 10 to 200 mole % based on the magenta coupler represented by the above formula (I) of the present invention.

Typical examples of the compounds represented by the above formula [K] are shown below.

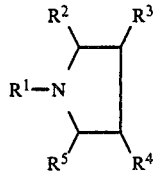

| | $R^1$ | $R^2$ | $R^3$ | $R^4$ | $R^5$ |
|---|---|---|---|---|---|
| K-1 | $C_8H_{17}$ | H | H | H | H |
| K-2 | 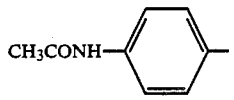 | H | H | H | H |
| K-3 | 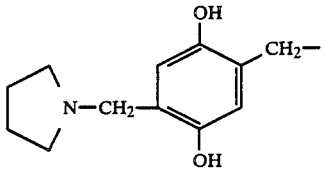 | H | H | H | H |
| K-4 | $C_{12}H_{25}$ | H | H | H | H |
| K-5 | $C_{14}H_{29}$ | H | H | H | H |
| K-6 | $C_{16}H_{33}$ | H | H | H | H |
| K-7 | $C_{14}H_{29}$ | H | 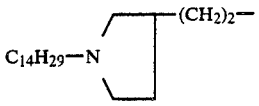 | H | H |
| K-8 | 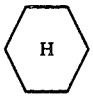 | $CH_3$ | $CH_3$ | H | H |
| K-9 | $C_6H_5CH{=}CHCH_2-$ | H | H | H | H |
| K-10 | 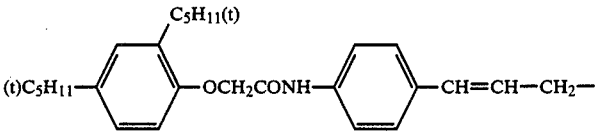 | H | H | H | H |

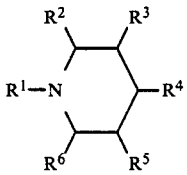

| | $R^1$ | $R^2$ | $R^3$ | $R^4$ | $R^5$ | $R^6$ |
|---|---|---|---|---|---|---|
| K-11 | $(t)C_8H_{17}$ | H | H | H | H | H |

-continued
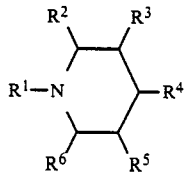
| | $R^1$ | $R^2$ | $R^3$ | $R^4$ | $R^5$ | $R^6$ |
|---|---|---|---|---|---|---|
| K-12 | 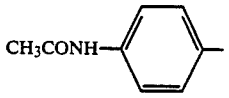 | H | H | H | H | H |
| K-13 | $C_{12}H_{25}$ | H | H | H | H | H |
| K-14 | $C_{14}H_{29}$ | H | H | H | H | H |
| K-15 | $C_{16}H_{33}$ | H | H | H | H | H |
| K-16 | $C_{14}H_{29}$ | $CH_3$ | H | H | H | H |
| K-17 | 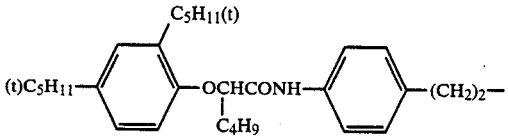 | | | H | H | H |
| K-18 | $C_8H_{17}$ | $CH_3$ | $CH_3$ | H | $CH_3$ | $CH_3$ |
| K-19 | 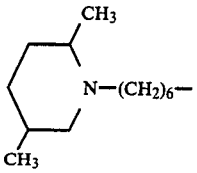 | $CH_3$ | H | H | $CH_3$ | H |
| K-20 | $CH_3$ | H | H | $C_{12}H_{25}OCOCH_2$— | H | H |
| K-21 | $CH_3$ | $CH_3$ | H | $C_{16}H_{33}OCOCH_2$— | H | $CH_3$ |
| K-22 | $CH_3$ | $C_{16}H_{33}$ | H | H | H | H |
| K-23 | $C_6H_5$ | H | H | $C_{12}H_{25}OCO$— | H | H |
| K-24 | $CH_3$ | $C_6H_5$ | H | H | H | H |
| K-25 | 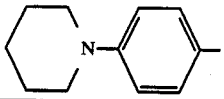 | H | H | H | H | H |
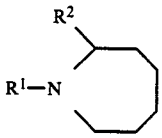
| | $R^1$ | $R^2$ |
|---|---|---|
| K-26 | $C_8H_{17}$ | H |
| K-27 | 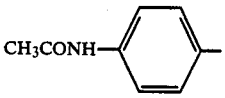 | H |
| K-28 | 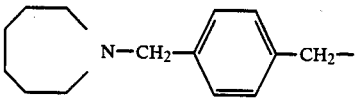 | H |
| K-29 | $C_{14}H_{29}$ | H |

-continued
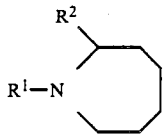
| | $R^1$ | $R^2$ |
|---|---|---|
| K-30 | 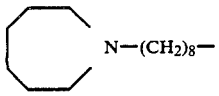  | H |
| K-31 | $C_{16}H_{33}$ | $CH_3$ |
| K-32 | 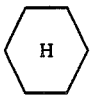  | H |
| K-33 | 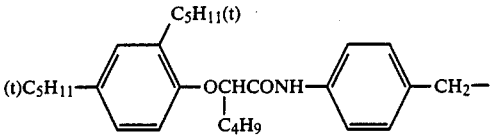  | H |
| K-34 | 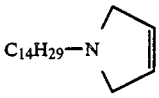  | |
| K-35 | 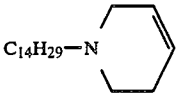  | |
| K-36 | 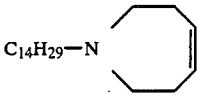  | |
| K-37 | 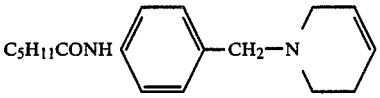  | |
| K-38 | 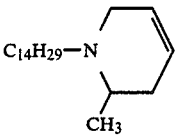  | |
| K-39 | 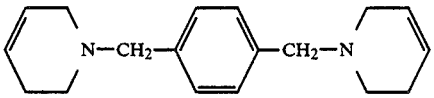  | |
| K-40 | 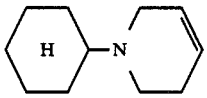  | |
| K-41 | 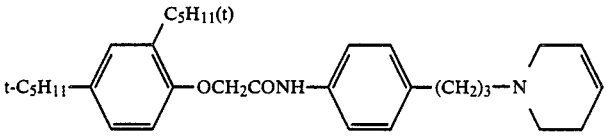  | |

Next, a typical synthesis example of the compound represented by the above formula [K] is shown.

Synthesis example-1 (synthesis of the compound K-14)

In a solution of 9.0 g of piperazine and 28 g of myristyl bromide dissolved in 60 ml of acetone, 6.0 g of anhydrous potassium carbonate was added, and the reaction was carried out under boiling reflux for 20 hours. After the reaction, 300 ml of the reaction mixture was poured into water, and extracted with 300 ml of ethyl acetate. After the ethyl acetate layer was dried over magnesium sulfate, ehtyl acetate was evaporated to obtain the desired product as white crystals. Recrystalization from 100 ml of acetone gave 12 g of white scale-like crystals (yield 43%). m.p. 175°–180° C.

In the hydrophilic colloid layer such as protective layer, intermediate layer, etc., in the light-sensitive material of the present invention, there may be contained a UV-absorber for prevention of fog due to discharging caused by charging of the light-sensitive material through friction, etc., and for prevention of deterioration of images by UV-ray.

In the color light-sensitive material using the silver halide emulsion of the present invention, it is possible to provide auxiliary layers such as filter layer, halation preventive layer and/or irradiation preventive layer, etc. In these layers and/or in the emulsion layers, there may also be contained a dye which flows out from the color light-sensitive material or is bleached during development processing.

In the silver halide emulsion layer and/or other hydrophilic colloid layers of the a light-sensitive silver halide material using the silver halide emulsion of the present invention, there may be added a matting agent with an aim to reduce the luster of the light-sensitive material, to enhance writability, to prevent sticking mutually between the light-sensitive materials, etc.

In order to reduce the sliding friction of the light-sensitive material using the silver halide emulsion of the present invention, a lubricant can be added.

In the light-sensitive material using the silver halide emulsion of the present invention, an antistatic agent can be added for the purpose of preventing charging. The antistatic agent may be sometimes used in the antistatic layer on the side of the support where no emulsion is laminated, or it may also be used in the protective colloid layer other than emulsion layers on the side of the support where emulsion layers are laminated.

In the photographic emulsion layer and/or other hydrophilic colloid layers of the light-sensitive material using the silver halide emulsion of the present invention, there may be employed various surfactants for the purpose of improvement of coating characteristic. Prevention of charging, inprovement of slipping characteristic, emulsification, prevention of adhesion and improvement of photographic characteristics (development acceleration, hard toning, sensitization, etc.).

In the light-sensitive material using the silver halide emulsion of the present invention, photographic emulsion layers and other layers can be coated flexible reflective supports such as baryta paper, papers laminated with α-olefin polymers, etc., synthetic paper, etc., films comprising semi-synthetic or synthetic polymers such as cellulose acetate, cellulose nitrate, polystyrene, polyvinyl chloride, polyethyleneterephthalate, polycarbonate, polyamide, etc., or rigid bodies such as glass, metal, porcelain, etc.

The silver halide material of the present invention, optionally after application of corona discharging, UV-ray irradiation, flame treatment, etc., on the support surface, may be coated directly or through one or two or more subbing layers (for the purpose of improvement of adhesiveness on the support surface, antistatic property, dimensional stability, abrasion resistance, hardness, halation prevention, frictional characteristic and/or other characteristics).

In coating of the photographic light-sensitive material using the silver halide emulsion of the present invention, a thickener may also be used for improvement of coating characteristic. As the coating method, extrusion coating and curtain capable of coating two of more layers simultaneously are particularly useful.

The light-sensitive material of the present invention can be exposed by use of an electromagnetic wave in the spectral region to which the emulsion layer constituting the light-sensitive material of the present invention has sensitivity. As the light source, there may be employed any of the known light sources, including natural (sun light), tungsten lamp, fluorescent lamt, marcury lamp, xenon arc lamp, carbon arc lamp, xenon flush lamp, cathode-ray tube flying spot, various laser beams, emission diode beam, light emitted from a phosphor excited by electron beam, X-ray, γ-ray, α-ray, etc.

The exposure time may be from 1 msec. to 1 sec. which is conventionally used in cameras, as a matter of course, and even are exposure shorter than 1 msec., for example, exposure for 100 μsec. to 1 μsec. by use of a cathode-ray tube or quicenone flash lamp, and also exposure longer than 1 sec. may be possible. Said exposure may be effected either continuously or intermittently.

In the light-sensitive silver halide photographic material of the present invention, an image can be formed by practicing color development known in this field of the art.

The aromatic primary amine color developing agent to be used in the color developing solution in the present invention may include known compounds which are used widely in various color photographic processes. These developing agents include aminophenol type and p-phenylenediamine type derivatives. These compounds are used generally in the form of salts such as hydrochlorides or sulfates for the purpose of stability rather than under free state. These compounds are used at a concentration of about 0.1 g to about 30 g per liter of the color developing solution, preferably about 1 g to about 15 g per 1 liter of the color developing solution.

The aminophenol type developing solution may contain, for example, o-aminophenol, p-aminophenol, 5-amino-2-oxytoluene, 2-amino-3-oxytoluene, 2-oxy-3-amino-1,4-dimethylbenzene and the like.

Particularly useful primary aromatic amino type color developing agents are N,N'-dialkyl-p-phenylenediamine type compounds, and the alkyl group and phenyl group may be substituted with any desired substituent. Among them, examples of particularly useful compounds include N,N'-diethyl-p-phenylenediamine hydrochloride, N-methyl-p-phenylenediamine hydrochloride, N,N'-dimethyl-p-phenylenediamine hydrochloride, 2-amino-5-(N-ethyl-N-dodecylamino)-toluene, N-ethyl-N-β-methanesulfonamidoethyl-3-methyl-4-aminoaniline sulfate, N-ethyl-N-β-hydroxyethylamioaniline, 4-amino-3-methyl-N,N'-diethylaniline, 4-amino-N-(2-methoxyethyl)-N-ethyl-3-methylaniline-p-toluenesulfonate and the like.

In the color developing solution to be used in processing of the present invention, in addition to the above primary aromatic amine type color developing agent, there may be further added various components ordinarily added in color developing solutions, including alkali agents such as sodium hydroxide, sodium carbonate, potassium carbonate, etc., alkali metal sulfites, alkali metal bisulfites, alkali metal thiocyanates, alkali metal halides, benzylalcohol, water softeners and thickeners. The color developing solutin has a pH value generally of 7 or higher, most generally about 10 to about 13.

In the present invention, after color developing processing, processing is performed with a processing liquor having fixing ability. In the case when the processing liquor having said fixing ability is a fixing solution, bleaching processing is performed prior to fixing. As the bleaching agent to be used in said bleaching step, a metal complex of an organic acid is used, and said metal complex has the action of oxidizing the metal silver formed by development to return it back to silver halide simultaneously with color forming the non-color formed portion of the color forming agent, and it is constituted of an organic acid such as aminopolycarboxylic acid, oxalic acid, citric acid, etc., coordinated with metal ions such as iron, cobalt, copper, etc. Most preferable organic acids to be used for formation of such a metal complex or organic acid may include polycarboxylic acids or aminopolycarboxylic acids. These polycarboxylic acids or aminopolycarboxylic acids may be alkali metal salts, ammonium salts or water-soluble amine salts.

Typical specific examples of these compounds may include the following:

[1] ethylenediaminetetraacetic acid
[2] nitrilotriacetic acid
[3] iminodiacetic acid
[4] disodium ethylenediaminetetraacetate
[5] tetra(trimethylammonium)ethylenediaminetetraacetate
[6] tetrasodium ethylenediaminetetraacetate
[7] sodium nitrilotriacetate.

The bleaching agent used contains such a metal complex of an organic acid as mentioned above and can also contain various additives. As the additive, it is particularly desirable to incorporate an alkali halide or an ammonium halide such as a rehalogenating agent (e.g. potassium bromide, sodium bromide, sodium chloride, ammonium bromide, etc.), a metal salt or a chelating agent. It is also possible to add suitably additives known to be conventionally added into a bleaching solution such as pH buffers (e.g. borate, oxalate, acetate, carbonate, phosphate, etc.), alkylamines, polyethyleneoxides, etc.

Further, the fixing solution and the bleach-fixing solution can also contain one or two or more kinds of pH buffers comprising various salts, including sulfites such as ammonium sulfite, potassium sulfite, ammonoium bisulfite, potassium bisulfite, sodium bisulfite, ammonium metabisulfite, potassium metabisulfite, sodium metabisulfite, etc., boric acid, borax, sodium hydroxide, potassium hydroxide, sodium carbonate, potassium carbonate, sodium bisulfite, sodium bicarbonate, potassium bicarbonate, acetic acid, sodium acetate, ammonium hydroxide, etc.

In the case when processing of the present invention is carried out while supplementing a bleach-fixing supplementing agent into a bleach-fixing solution (bath), a thiosulfate, thiocyanate or a sulfite may be contained in said bleach-fixing solution (bath), or these salts may be contained in said bleach-fixing supplementing solution and supplemented into the processing bath.

In the present invention, for enhancing activity of the bleach-fixing solution, blowing of air or blowing of oxygen may be performed in the bleach-fixing bath and the storage tank for the bleach-fixing supplementing solution, or a suitable oxidizing agent such as hydrogen peroxide, hydrobromic acid salt, a persulfate, etc., may be added as desired.

Referring now to the following examples, the present invention is described in more detail.

EXAMPLE 1

On a support, comprising a polyethylene-coated paper, a layer was provided by coating so as to give attached amounts of coating of 4 mg/dm$^2$ of the exemplary magenta coupler 2, 2 mg/dm$^2$ calculated on silver of a green-sensitive silver chlorobromide, 4 mg/dm$^2$ of dioctylphthalate and 16 mg/dm$^2$ of gelatin.

Further, its upper layer comprising gelatin was provided by coating so as to give an attached amount of coating of 9 mg/dm$^2$. The sample thus prepared is called Sample 1 (Comparative).

Next, the Samples 2 to 29 were prepared in the same manner as Sample 1 except for adding couplers, metal complexes and oil-soluble dyes according to the combinations shown in Table 1 in the coupler-containing layer of the above Sample 1.

These samples were subjected to optical wedge exposure of green light by means of sensitometer (KS-7 model, produced by Konishiroku Photo Industry Co., Ltd.) and then the following processings were conducted.

Standard processing steps (processing temperature and processing time)

| | | |
|---|---|---|
| [1] Color developing | 38° C. | 3 min. 30 sec. |
| [2] Bleach-fixing | 33° C. | 1 min. 30 sec. |
| [3] Water washing | 25–30° C. | 3 min. |
| [4] Drying | 75–80° C. | about 2 min. |

[Color developing solution]

| | |
|---|---|
| Benzyl alcohol | 15 ml |
| Ethyleneglycol | 15 ml |
| Potassium sulfite | 2.0 g |
| Potassium bromide | 0.7 g |
| Sodium chloride | 0.2 g |
| Potassium carbonate | 30.0 g |
| Hydroxylamine sulfate | 3.0 g |
| Polyphosphoric acid (TPPS) | 2.5 g |
| 3-Methyl-4-amino-N—(β-methanesulfonamidoethyl)aniline sulfate | 5.5 g |
| Fluorescent brightener (4,4'-diaminostilbenzsulfonic acid derivative) | 1.0 g |
| Potassium hydroxide | 2.0 g |
| (made up to a total quantity of one liter with addition of water, and adjusted to pH 10.20). | |

[Bleach-fixing solution]

| | |
|---|---|
| Ferric ammonium ethylenediaminetetraacetate dihydrate | 60 g |
| Ethylenediaminetetraacetic acid | 3 g |
| Ammonium thiosulfate (70% solution) | 100 ml |
| Ammonium sulfite (40% solution) | 27.5 ml |
| (adjusted to pH 7.1 with potassium carbonate or glacial acetic acid, and made up to a total quantity of one liter | |

-continued with addition of water).

After processing, light resistance test, measurement of whiteness, measurement of sharpness were carried out in the following manners.

[Light resistance test]

The respective images formed on each sample were irradiated with sun light by use of Underglass outdoor exposure stand for 30 days, and the fading percentage $\{(D_0-D)/(D_0)\}\times 100$ (wherein $D_0$ represents the initial density (1.0) and D represents the density after fading) was measured.

[Measurement of whiteness]

The white portion (unexposed portion) of each sample obtained was subjected to measurement of a*b* value by means of Hitachi color analyzer model 607 on the basis of the method for measuring entity color as determined by JIS Z8722 and Z8727.

Increase of a* value indicates increase of red color, and its reduction indicates increase of green color. Also, increase of b* value indicates increase of yellow color, and its reduction indicates increase of blue color.

Also visual judgment of whiteness was conducted.

[Sharpness test]

MTF (Modulation Transfer Function) of the light-sensitive silver halide emulsion layer was determined by a microdensitometer, and the MTF values at space frequency of 5/mm were compared. Judgment of sharpness of image by MTF is well known among those skilled in the art, and it is described in The Theory of the Photographic Process, Third Edition. These results of measurements are shown in Table 1.

TABLE 1

| Sample No. | | Metal complex | Oil-soluble dye | Light-resistance | Whiteness a* | Whiteness b* | Whiteness Judgement with eyes | Sharpness MTF (%) | Singlet oxygen quenching constant |
|---|---|---|---|---|---|---|---|---|---|
| | Coupler | | | | | | | | |
| 1 (Comparative) | MC - 1 | — | — | 63 | +0.51 | −0.48 | white | 37 | — |
| 2 (Comparative) | MC - 1 | 8 | — | 39 | +0.04 | −0.52 | yellowish green | 39 | $2\times 10^8$ |
| 3 (This invention) | MC - 1 | 8 | 4 (0.1 mg/m²) 9 (0.1 mg/m²) | 39 | +0.68 | −0.62 | white | 51 | $2\times 10^8$ |
| 4 (This invention) | MC - 1 | 15 | 4 (0.1 mg/m²) 9 (0.1 mg/m²) | 35 | +0.70 | −0.71 | white | 52 | $2\times 10^8$ |
| 5 (This invention) | MC - 1 | 18 | 4 (0.1 mg/m²) 9 (0.1 mg/m²) | 33 | +0.59 | −0.65 | white | 50 | $2\times 10^8$ |
| 6 (Comparative) | MC - 2 | — | — | 88 | +0.49 | −0.60 | white | 35 | — |
| 7 (This invention) | MC - 2 | 18 | 4 (0.1 mg/m²) 9 (0.1 mg/m²) | 32 | +0.49 | −0.68 | white | 54 | $2\times 10^8$ |
| 8 (Comparative) | MC - 4 | — | — | 95 | +0.45 | −0.65 | white | 36 | — |
| 9 (This invention) | MC - 4 | 18 | 4 (0.1 mg/m²) 9 (0.1 mg/m²) | 45 | +0.51 | −0.78 | white | 53 | $2\times 10^8$ |
| 10 (Comparative) | CC - 4 | — | — | 43 | +0.50 | −0.40 | white | 33 | — |
| 11 (This invention) | CC - 4 | 26 | 4 (0.1 mg/m²) 9 (0.1 mg/m²) | 32 | +0.57 | −0.71 | white | 48 | $2\times 10^8$ |
| | Magenta coupler | | | | | | | | |
| 12 (Comparative) | YC - 1 | — | — | 65 | +0.49 | −0.43 | white | 31 | — |
| 13 (This invention) | YC - 1 | 26 | 4 (0.1 mg/m²) 9 (0.1 mg/m²) | 44 | −0.58 | +0.61 | white | 47 | $2\times 10^8$ |
| 14 (Comparative) | 2 | — | — | 65 | +0.45 | −0.59 | white | 38 | — |
| 15 (Comparative) | 2 | 8 | — | 46 | +0.03 | −0.69 | yellowish green | 39 | $2\times 10^8$ |
| 16 (This invention) | 2 | 8 | 4 (0.1 mg/m²) 9 (0.1 mg/m²) | 45 | +0.38 | −0.67 | white | 55 | $2\times 10^8$ |
| 17 (This invention) | 2 | 15 | 4 (0.1 mg/m²) 9 (0.1 mg/m²) | 46 | +0.35 | −0.71 | white | 56 | $2\times 10^8$ |
| 18 (This invention) | 2 | 18 | 4 (0.1 mg/m²) 9 (0.1 mg/m²) | 33 | +0.37 | −0.65 | white | 55 | $2\times 10^8$ |
| 19 (This invention) | 2 | 26 | 4 (0.1 mg/m²) 9 (0.1 mg/m²) | 34 | +0.39 | −0.72 | white | 58 | $2\times 10^8$ |
| 20 (Comparative) | 5 | — | — | 63 | +0.42 | −0.61 | white | 37 | — |
| 21 (This invention) | 5 | 18 | 4 (0.1 mg/m²) 9 (0.1 mg/m²) | 32 | +0.39 | −0.65 | white | 56 | $2\times 10^8$ |
| 22 (Comparative) | 36 | — | — | 62 | +0.42 | −0.60 | white | 38 | — |
| 23 (This invention) | 36 | 18 | 4 (0.1 mg/m²) 9 (0.1 mg/m²) | 31 | +0.32 | −0.71 | white | 57 | $2\times 10^8$ |
| 24 (Comparative) | 57 | — | — | 38 | +0.43 | −0.65 | white | 37 | — |
| 25 (This invention) | 57 | 18 | 4 (0.1 mg/m²) 9 (0.1 mg/m²) | 25 | +0.29 | −0.81 | white | 58 | $2\times 10^8$ |
| 26 (Com- | 60 | — | — | 39 | +0.44 | −0.61 | white | 37 | — |

TABLE 1-continued

| Sample No. | | Metal complex | Oil-soluble dye | Light-resistance | Whiteness a* | Whiteness b* | Whiteness Judgement with eyes | Sharpness MTF (%) | Singlet oxygen quenching constant |
|---|---|---|---|---|---|---|---|---|---|
| parative) | | | | | | | | | |
| 27 (This invention) | 60 | 18 | 4 (0.1 mg/m$^2$) 9 (0.1 mg/m$^2$) | 24 | +0.45 | −0.82 | white | 58 | $2 \times 10^8$ |
| 28 (Comparative) | Comparative magenta coupler | — | — | 59 | +0.43 | −0.70 | white | 37 | — |
| 29 (Comparative) | Comparative magenta coupler | 18 | 4 (0.1 mg/m$^2$) 9 (0.1 mg/m$^2$) | 42 | +0.39 | −0.80 | white | 48 | $2 \times 10^8$ |

The control magenta coupler used in Table 1 had a structural formula shown below.

Comparative magenta coupler

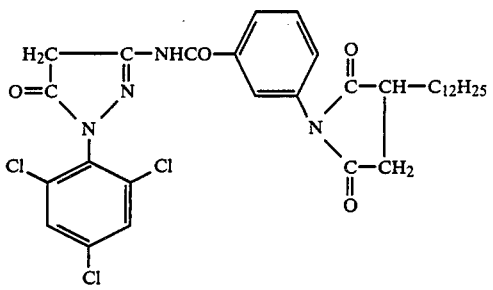

As is apparent from Table 1, in samples containing couplers alone (1, 6, 8, 10, 12, 14, 20, 22, 24, 26 and 28) light resistance is poor and also sharpness is bad.

In the Samples 2 and 15 wherein only the metal complex of according to the present invention is used, whiteness at the white portion is deteriorated, although improvement of light resistance can be seen. In samples of the present invention (3 to 5, 7, 9, 11, 13, 16 to 19, 21, 23, 25 and 27), not only light resistance is improved without deterioration of whiteness, but also sharpness is improved. Also, in samples of the present invention, the degree of improvement of light resistance as well as the degree of improvement of sharpness are greater as compared with the sample (29) employing the control magenta coupler.

EXAMPLE 2

Samples 30 to 61 which are the same as the Sample 1 except for adding the metal complex and the oil-soluble dyes according to the combinations indicated in Table 2 in the coupler containing layer of Sample 1 or Sample 14 in Example 1 were prepared.

The samples thus prepared were applied with the same exposure treatment as Example 1. For the respective samples obtained after processing, light resistance, whiteness and sharpness of the magenta dye image were measured similarly as Example 1. The results are shown in Table 2.

TABLE 2

| Sample No. | Coupler | Metal complex | Oil-Soluble dye | Light-resistance | Whiteness a* | Whiteness b* | Whiteness Judgement with eyes | Sharpness MTF (%) | Singlet oxygen quenching constant |
|---|---|---|---|---|---|---|---|---|---|
| 1 (Comparative) | MC - 1 | — | — | 63 | +0.51 | −0.48 | white | 37 | — |
| 2 (Comparative) | MC - 1 | 8 | — | 39 | +0.04 | +0.52 | yellowish green | 39 | $2 \times 10^8$ |
| 3 (This invention) | MC - 1 | 8 | 4 (0.1 mg/m$^2$) 9 (0.1 mg/m$^2$) | 39 | +0.68 | −0.62 | white | 51 | $2 \times 10^8$ |
| 30 (Comparative) | MC - 1 | 10 | — | 38 | +0.02 | +0.59 | yellowish green | 38 | $2 \times 10^8$ |
| 31 (This invention) | MC - 1 | 10 | 4 (0.1 mg/m$^2$) 9 (0.1 mg/m$^2$) | 40 | +0.58 | −0.65 | white | 52 | $2 \times 10^8$ |
| 32 (Comparative) | MC - 1 | 16 | — | 37 | +0.07 | −0.69 | yellowish green | 39 | $2 \times 10^8$ |
| 33 (This invention) | MC - 1 | 16 | 4 (0.1 mg/m$^2$) 9 (0.1 mg/m$^2$) | 36 | +0.58 | −0.68 | white | 50 | $2 \times 10^8$ |
| 34 (Comparative) | MC - 1 | 20 | — | 36 | +0.07 | +0.71 | yellowish green | 38 | $2 \times 10^8$ |
| 35 (This invention) | MC - 1 | 20 | 4 (0.1 mg/m$^2$) 9 (0.1 mg/m$^2$) | 35 | +0.51 | −0.59 | white | 53 | $2 \times 10^8$ |
| 36 (Comparative) | MC - 1 | 35 | — | 39 | −0.51 | +1.53 | yellowish green | 39 | $3 \times 10^9$ |
| 37 (This invention) | MC - 1 | 35 | 4 (0.3 mg/m$^2$) 9 (0.3 mg/m$^2$) | 37 | +0.51 | −0.42 | white | 54 | $3 \times 10^9$ |
| 38 (Comparative) | MC - 1 | 57 | — | 38 | −0.48 | +1.51 | yellowish green | 38 | $3 \times 10^9$ |
| 39 (This invention) | MC - 1 | 57 | 4 (0.3 mg/m$^2$) 9 (0.3 mg/m$^2$) | 36 | +0.35 | −0.41 | white | 51 | $3 \times 10^9$ |
| 40 (Comparative) | MC - 1 | 105 | — | 41 | −0.49 | +1.58 | yellowish green | 37 | $3 \times 10^9$ |
| 41 (This | MC - 1 | 105 | 4 (0.3 mg/m$^2$) | 39 | +0.37 | 0.45 | white | 52 | $3 \times 10^9$ |

TABLE 2-continued

| Sample No. | | Metal complex | Oil-Soluble dye | Light-resistance | Whiteness a* | Whiteness b* | Whiteness Judgement with eyes | Sharpness MTF (%) | Singlet oxygen quenching constant |
|---|---|---|---|---|---|---|---|---|---|
| invention) | | | 9 (0.3 mg/m$^2$) | | | | | | |
| 42 (Comparative) | MC - 1 | 127 | — | 38 | −0.57 | +1.59 | yellowish green | 38 | $3 \times 10^9$ |
| 43 (This invention) | MC - 1 | 127 | 4 (0.3 mg/m$^2$) 9 (0.3 mg/m$^2$) | 37 | +0.31 | −0.42 | white | 51 | $3 \times 10^9$ |
| 44 (Comparative) | MC - 1 | Comparative metal complex | — | 61 | +0.12 | +0.36 | yellowish green | 38 | $2 \times 10^7$ |
| 45 (Comparative) | MC - 1 | Comparative metal complex | 4 (0.1 mg/m$^2$) 9 (0.1 mg/m$^2$) | 62 | +0.39 | −0.69 | white | 42 | $2 \times 10^7$ |
| | Magenta coupler | | | | | | | | |
| 14 (Comparative) | 2 | — | — | 65 | +0.45 | −0.59 | white | 38 | — |
| 15 (Comparative) | 2 | 8 | — | 46 | −0.03 | +0.69 | yellowish green | 39 | $2 \times 10^8$ |
| 16 (This invention) | 2 | 8 | 4 (0.1 mg/m$^2$) 9 (0.1 mg/m$^2$) | 45 | +0.38 | −0.67 | white | 55 | $2 \times 10^8$ |
| 46 (Comparative) | 2 | 10 | — | 44 | +0.09 | +0.61 | yellowish green | 38 | $2 \times 10^8$ |
| 47 (This invention) | 2 | 10 | 4 (0.1 mg/m$^2$) 9 (0.1 mg/m$^2$) | 43 | +0.40 | −0.71 | white | 57 | $2 \times 10^8$ |
| 48 (Comparative) | 2 | 16 | — | 33 | +0.05 | +0.65 | yellowish green | 37 | $2 \times 10^8$ |
| 49 (This invention) | 2 | 16 | 4 (0.1 mg/m$^2$) 9 (0.1 mg/m$^2$) | 32 | +0.48 | −0.72 | white | 56 | $2 \times 10^8$ |
| 50 (Comparative) | 2 | 20 | — | 32 | +0.05 | +0.71 | yellowish green | 38 | $2 \times 10^8$ |
| 51 (This invention) | 2 | 20 | 4 (0.1 mg/m$^2$) 9 (0.1 mg/m$^2$) | 31 | +0.45 | −0.69 | white | 58 | $2 \times 10^8$ |
| 52 (Com-) parative) | 2 | 35 | — | 45 | −0.49 | +1.59 | yellowish green | 39 | $3 \times 10^9$ |
| 53 (This invention) | 2 | 35 | 4 (0.3 mg/m$^2$) 9 (0.3 mg/m$^2$) | 45 | +0.39 | −0.43 | white | 57 | $3 \times 10^9$ |
| 54 (Comparative) | 2 | 57 | — | 44 | −0.47 | +1.57 | yellowish green | 37 | $3 \times 10^9$ |
| 55 (This invention) | 2 | 57 | 4 (0.3 mg/m$^2$) 9 (0.3 mg/m$^2$) | 43 | +0.36 | −0.42 | white | 57 | $3 \times 10^9$ |
| 56 (Comparative) | 2 | 105 | — | 45 | −0.49 | +1.59 | yellowish green | 38 | $3 \times 10^9$ |
| 57 (This invention) | 2 | 105 | 4 (0.3 mg/m$^2$) 9 (0.3 mg/m$^2$) | 44 | +0.35 | −0.47 | white | 56 | $3 \times 10^9$ |
| 58 (Comparative) | 2 | 127 | — | 46 | −0.51 | +1.68 | yellowish green | 38 | $3 \times 10^9$ |
| 59 (This invention) | 2 | 127 | 4 (0.3 mg/m$^2$) 9 (0.3 mg/m$^2$) | 45 | +0.32 | −0.45 | white | 56 | $3 \times 10^9$ |
| 60 (Comparative) | 2 | Comparative metal complex | — | 62 | +0.12 | +0.36 | yellowish green | 39 | $2 \times 10^7$ |
| 61 (Comparative) | 2 | Comparative metal complex | 4 (0.1 mg/m$^2$) 9 (0.1 mg/m$^2$) | 61 | +0.40 | −0.72 | white | 45 | $2 \times 10^7$ |

The control metal complex used in Table 2 has a structure shown below.

Comparative metal complex

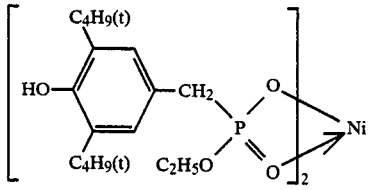

As clearly be seen from Table 2, in the samples in which only metal complex was used with the coupler of the present invention (2, 15, 30, 32, 34, 36, 38, 40, 42, 46, 48, 50, 52, 54, 56 and 58), deterioration of whiteness occurs. In the samples of the present invention in which a metal complex and an oil-soluble dye were used in combination with the coupler of the present invention (3, 16, 31, 33, 35, 37, 39, 41, 43, 47, 49, 51, 53, 55, 57 and 59), there is no deterioration of whiteness, and images good in both light resistance and sharpness were obtained. On the other hand, in the sample employing the control metal complex, this effect could not be seen.

EXAMPLE 3

On a support comprising a polyethylene-coated paper, the respective layers shown below were successively provided by coating from the support side to prepare a light-sensitive silver halide photographic material for multi-color.

First layer: blue-sensitive silver halide emulsion layer a layer was provided by coating to give the attached amounts of coating of 8 mg/dm$^2$ of α-pivalyl-α-(1-benzyl-2,4-dioxo-imidazolidin-3-yl)-2-chloro-5-[γ-(2,4-di-t-amylphenoxy)butyramido]acetoanilide as the yellow coupler, 3 mg/dm$^2$ calculated on silver of a blue-sensitive silver chlorobromide, 3 mg/dm$^2$ of 2,4-di-t-butylphenol-3',5'-di-t-amyl-4'-hydroxybenzoate, 3 mg/dm$^2$ of dioctyl phthalate and 16 mg/dm$^2$ of gelatin.

Second layer: intermediate layer gelatin was provided by coating to an attachment amount of coating of 4 mg/dm$^2$.

Third layer: green-sensitive silver chlorobromide emulsion layer a layer was provided by coating to give attached amounts of coating of 4 mg/dm$^2$ of the above exemplary magenta coupler (MC-1 or 57), 2 mg/dm$^2$ calculated on silver of a green-sensitive silver chlorobromide emulsion, 4 mg/dm$^2$ of dioctyl phthalate and 16 mg/dm$^2$ of gelatin.

Fourth layer: intermediate layer a layer was provided by coating so as to give attached amounts of coating of 31 mg/dm$^2$ of a UV-ray absorber 2-hydroxy-3',5'-di-t-amylphenol)benzotriazole, 3 mg/dm$^2$ of 2-(2'-hydroxy-3',5'-di-t-butylphenol)-benzotriazole, 4 mg/dm$^2$ of dioctyl phthalate and 14 mg/dm$^2$ of the gelatin.

Fifth layer: red-sensitive silver chlorobromide emulsion layer a layer was provided by coating to give attached amounts of coating of 1 mg/dm$^2$ of 2,4-dichloro-3-methyl-6-[α-(2,4-di-t-amylphenoxy)butyramido]-phenol as the cyane coupler, 3 mg/dm$^2$ of 2-(2,3,4,5,6-pentafluorophenyl)acylamino-4-chloro-5-[α-(2,4-di-tert-amylphenoxy)pentylramido], 2 mg/dm$^2$ of dioctyl phthalate and 3 mg/dm$^2$ calculated on silver of a red-sensitive silver chlorobromide emulsion.

Sixth layer: intermediate layer a layer was provided by coating so as to give attached amounts of coating of 2 mg/dm$^2$ of 2-(2'-hydroxy-3',5'-di-t-amylphenol)benzotriazole as the UV-ray absorber, 2 mg/dm$^2$ of 2-(2'-hydroxy-3',5'-di-t-butylphenol)benzotriazole, 2 mg/dm$^2$ of dioctyl phthalate and 6 mg/dm$^2$ of gelatin.

Seventh layer: protective layer

Gelatin was applied to an amount of 9 mg/dm$^2$.

The samples thus prepared are called Samples 62 (using the magenta coupler MC-1 in the third layer) and 76 (using the magenta coupler 57 in the third layer).

Next, Samples 63 to 75 which are the same as Sample 62 and Samples 77 to 89 which are the same as Sample 76, except for adding a metal complex (coated at a ratio of 0.5 mole per coupler) and an antioxidant (applied at a ration of 0.5 mole per coupler) to the third layer of the above sample 62 and an oil-soluble dye to the fourth layer according to the combinations shown in Table 3 were prepared.

The samples thus prepared were applied with the same exposure treatment as Example 1.

For the respective samples obtained after processing, light resistance, whiteness, sharpness of the magenta color image were measured in the same manner as Example 1. The results are shown in Table 3.

TABLE 3

| Sample No. | Metal complex | Oil-soluble dye | Anti-oxidant | Light-resistance | Whiteness a* | Whiteness b* | Whiteness Judgement with eyes | Sharpness MTF (%) | Singlet oxygen quenching constant |
|---|---|---|---|---|---|---|---|---|---|
| 62 (Comparative) | — | — | — | 55 | +0.39 | −0.51 | white | 35 | — |
| 63 (Comparative) | 20 | — | — | 34 | +0.02 | +0.61 | yellowish green | 37 | 2 × 10$^8$ |
| 64 (This invention) | 20 | 4 (0.1 mg/m$^2$)<br>9 (0.1 mg/m$^2$) | — | 34 | +0.38 | −0.62 | white | 49 | 2 × 10$^8$ |
| 65 (This invention) | 20 | 1 (0.1 mg/m$^2$)<br>7 (0.1 mg/m$^2$) | — | 34 | +0.37 | −0.60 | white | 48 | 2 × 10$^8$ |
| 66 (This invention) | 20 | 14 (0.1 mg/m$^2$)<br>6 (0.1 mg/m$^2$) | — | 32 | +0.35 | −0.65 | white | 51 | 2 × 10$^8$ |
| 67 (This invention) | 20 | 16 (0.1 mg/m$^2$)<br>6 (0.1 mg/m$^2$) | — | 33 | +0.35 | −0.67 | white | 47 | 2 × 10$^8$ |
| 68 (This invention) | 20 | 4 (0.1 mg/m$^2$)<br>9 (0.1 mg/m$^2$) | A - 8 | 25 | +0.38 | −0.69 | white | 51 | 2 × 10$^8$ |
| 69 (This invention) | 20 | 4 (0.1 mg/m$^2$)<br>9 (0.1 mg/m$^2$) | A - 13 | 24 | +0.38 | −0.69 | white | 50 | 2 × 10$^8$ |
| 70 (This invention) | 20 | 4 (0.1 mg/m$^2$)<br>9 (0.1 mg/m$^2$) | B - 35 | 21 | +0.34 | −0.68 | white | 52 | 2 × 10$^8$ |
| 71 (This invention) | 20 | 4 (0.1 mg/m$^2$)<br>9 (0.1 mg/m$^2$) | C - 2 | 26 | +0.35 | −0.59 | white | 49 | 2 × 10$^8$ |
| 72 (This invention) | 20 | 4 (0.1 mg/m$^2$)<br>9 (0.1 mg/m$^2$) | G - 25 | 27 | +0.37 | −0.58 | white | 51 | 2 × 10$^8$ |
| 73 (This invention) | 20 | 4 (0.1 mg/m$^2$)<br>9 (0.1 mg/m$^2$) | J - 1 | 19 | +0.38 | −0.65 | white | 52 | 2 × 10$^8$ |
| 74 (This invention) | 20 | 4 (0.1 mg/m$^2$)<br>9 (0.1 mg/m$^2$) | J - 2 | 20 | +0.35 | −0.69 | white | 50 | 2 × 10$^8$ |
| 75 (This invention) | 20 | 4 (0.1 mg/m$^2$)<br>9 (0.1 mg/m$^2$) | J - 53 | 18 | +0.30 | −0.70 | white | 51 | 2 × 10$^8$ |
| 76 (Comparative) | — | — | — | 58 | +0.29 | −0.52 | white | 35 | — |
| 77 (Comparative) | 20 | — | — | 27 | +0.02 | +0.62 | yellowish green | 38 | 2 × 10$^8$ |
| 78 (This invention) | 20 | 4 (0.1 mg/m$^2$)<br>9 (0.1 mg/m$^2$) | — | 26 | +0.39 | −0.70 | white | 53 | 2 × 10$^8$ |
| 79 (This invention) | 20 | 1 (0.1 mg/m$^2$)<br>7 (0.1 mg/m$^2$) | — | 26 | +0.37 | −0.69 | white | 52 | 2 × 10$^8$ |
| 80 (This | 20 | 14 (0.1 mg/m$^2$) | — | 25 | +0.31 | −0.59 | white | 51 | 2 × 10$^8$ |

TABLE 3-continued

| Sample No. | Metal complex | Oil-soluble dye | Anti-oxidant | Light-resis-tance | Whiteness a* | Whiteness b* | Whiteness Judgement with eyes | Sharp-ness MTF (%) | Singlet oxygen quenching constant |
|---|---|---|---|---|---|---|---|---|---|
| invention) | | 6 (0.1 mg/m$^2$) | | | | | | | |
| 81 (This invention) | 20 | 16 (0.1 mg/m$^2$)<br>6 (0.1 mg/m$^2$) | — | 21 | +0.32 | −0.71 | white | 52 | $2 \times 10^8$ |
| 82 (This invention) | 20 | 4 (0.1 mg/m$^2$)<br>9 (0.1 mg/m$^2$) | A - 8 | 21 | +0.31 | −0.71 | white | 50 | $2 \times 10^8$ |
| 83 (This invention) | 20 | 4 (0.1 mg/m$^2$)<br>9 (0.1 mg/m$^2$) | A - 13 | 21 | +0.32 | −0.72 | white | 51 | $2 \times 10^8$ |
| 84 (This invention) | 20 | 4 (0.1 mg/m$^2$)<br>9 (0.1 mg/m$^2$) | B - 35 | 18 | +0.35 | −0.74 | white | 52 | $2 \times 10^8$ |
| 85 (This invention) | 20 | 4 (0.1 mg/m$^2$)<br>9 (0.1 mg/m$^2$) | C - 2 | 22 | +0.32 | −0.75 | white | 50 | $2 \times 10^8$ |
| 86 (This invention) | 20 | 4 (0.1 mg/m$^2$)<br>9 (0.1 mg/m$^2$) | G - 25 | 23 | +0.32 | −0.72 | white | 50 | $2 \times 10^8$ |
| 87 (This invention) | 20 | 4 (0.1 mg/m$^2$)<br>9 (0.1 mg/m$^2$) | J - 1 | 18 | +0.32 | −0.73 | white | 52 | $2 \times 10^8$ |
| 88 (This invention) | 20 | 4 (0.1 mg/m$^2$)<br>9 (0.1 mg/m$^2$) | J - 2 | 17 | +0.32 | −0.72 | white | 52 | $2 \times 10^8$ |
| 89 (This invention) | 20 | 4 (0.1 mg/m$^2$)<br>9 (0.1 mg/m$^2$) | J - 53 | 18 | +0.32 | −0.71 | white | 53 | $2 \times 10^8$ |

As is apparent from Table 3, in the Samples 62 and 76 in which only the coupler of the present invention is used, light resistance and sharpness are inferior. Also, in the Samples 63 and 77 in which a metal complex is added to the coupler of the present invention, deterioration of whiteness occurs and sharpness is not also improved. In the samples of the present invention (64 to 75 and 78 to 89) in which a metal complex and an oil-soluble dye were used in combination with the coupler of the present invention, both of light resistance and sharpness are good and there occurs no deterioration of whiteness to give a clear image.

Also, in the samples in which antioxidants are used in combination (68 to 75 and 82 to 89), light resistance was further improved to give more fast dye images.

EXAMPLE 4

Samples 90 to 95 were prepared in the same manner as in the Sample 64 and samples 96 to 101 were prepared in the same manner as in the Sample 78, except that a metal complex and a high boiling organic solvent were used in the Samples 64 and 78 of Example 3 according to the combinations shown in Table 4.

These samples were subjected to the same exposure treatment as Example 3, and light resistance, whiteness and sharpness of the magenta color image were measured. The results are shown in Table 4.

TABLE 4

| Sample No. | Metal complex | Oil-soluble dye | High-boiling point organic solvent | Light-resis-tance | Whiteness a* | Whiteness b* | Whiteness Judgement with eyes | Sharp-ness MTF (%) |
|---|---|---|---|---|---|---|---|---|
| 62 (Comparative) | — | — | DOP | 55 | +0.39 | −0.51 | white | 35 |
| 63 (Comparative) | 20 | — | DOP | 34 | +0.02 | +0.61 | yellowish green | 37 |
| 64 (This invention) | 20 | 4 (0.1 mg/m$^2$)<br>9 (0.1 mg/m$^2$) | DOP | 34 | +0.38 | −0.62 | white | 49 |
| 90 (This invention) | 20 | 4 (0.1 mg/m$^2$)<br>9 (0.1 mg/m$^2$) | TNP | 33 | +0.37 | −0.61 | white | 48 |
| 91 (This invention | 20 | 4 (0.1 mg/m$^2$)<br>9 (0.1 mg/m$^2$) | DEP | 39 | +0.37 | −0.62 | white | 48 |
| 92 (Comparative) | 22 | — | DOP | 35 | +0.01 | +0.71 | yellowish green | 36 |
| 93 (This invention) | 22 | 4 (0.1 mg/m$^2$)<br>9 (0.1 mg/m$^2$) | DOP | 35 | +0.30 | −0.63 | white | 48 |
| 94 (This invention) | 22 | 4 (0.1 mg/m$^2$)<br>9 (0.1 mg/m$^2$) | TNP | 34 | +0.32 | −0.65 | white | 47 |
| 95 (This invention) | 22 | 4 (0.1 mg/m$^2$)<br>9 (0.1 mg/m$^2$) | DEP | 40 | +0.32 | −0.64 | white | 47 |
| 76 (Comparative) | — | — | DOP | 58 | +0.29 | −0.52 | white | 35 |
| 77 (Comparative) | 20 | — | DOP | 27 | +0.02 | +0.62 | yellowish green | 38 |
| 78 (This invention) | 20 | 4 (0.1 mg/m$^2$)<br>9 (0.1 mg/m$^2$) | DOP | 26 | +0.39 | −0.70 | white | 53 |
| 96 (This invention) | 20 | 4 (0.1 mg/m$^2$)<br>9 (0.1 mg/m$^2$) | TNP | 25 | +0.38 | −0.71 | white | 50 |
| 97 (This invention) | 20 | 4 (0.1 mg/m$^2$)<br>9 (0.1 mg/m$^2$) | DEP | 33 | +0.39 | −0.71 | white | 50 |
| 98 (Comparative) | 22 | — | DOP | 28 | +0.02 | +0.68 | yellowish green | 37 |
| 99 (This | 22 | 4 (0.1 mg/m$^2$) | DOP | 28 | +0.34 | −0.70 | white | 48 |

TABLE 4-continued

| Sample No. | Metal complex | Oil-soluble dye | High-boiling point organic solvent | Light-resistance | Whiteness a* | Whiteness b* | Whiteness Judgement with eyes | Sharpness MTF (%) |
|---|---|---|---|---|---|---|---|---|
| invention) | | 9 (0.1 mg/m$^2$) | | | | | | |
| 100 (This invention) | 22 | 4 (0.1 mg/m$^2$) 9 (0.1 mg/m$^2$) | TNP | 27 | +0.35 | −0.71 | white | 47 |
| 101 (This invention) | 22 | 4 (0.1 mg/m$^2$) 9 (0.1 mg/m$^2$) | DEP | 34 | +0.35 | −0.70 | white | 47 |

*Metal complex was added at a proportion of 0.5 mole per mole of the coupler.
*POP: dioctyl phthalate (dielectric constant 5.3)
*TNP: triisononyl phthalate (dielectric constant 4.5)
*DEP: diethyl phthalate (dielectric constant 7.6)

As is apparent from Table 4, in the samples of the present invention, light resistance, whiteness, and sharpness are all good.

Also, in the Samples 64, 78, 90, 93, 94, 96, 99 and 100 wherein DOP, TNP with lower dielectric constants were employed, the degree of improvement of light resistance is more effectively greater as compared with the Samples 91, 95, 97 and 101 in which DEP with higher dielectric constant was employed.

We claim:

1. A light-sensitive silver halide photographic material having a silver halide emulsion layer containing a coupler on a support, comprising at least one of the metal complexes having a quenching constant of singlet oxygen of $3\times10^7 M^{-1}.sec^{-1}$ or higher and at least one of oil-soluble dyes; and wherein said metal complexes are at least one selected from the group consisting of the compounds represented by the formulae (II) to (V) shown below:

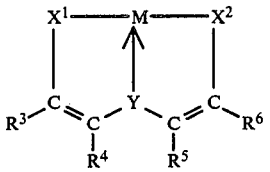

(II)

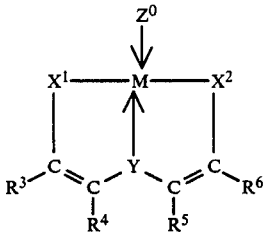

(III)

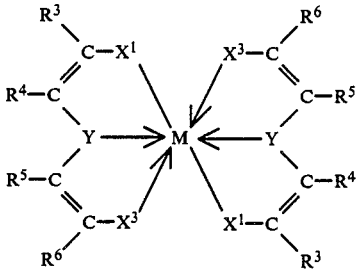

(IV)

wherein M represents a metal atom; $X^1$ and $X^2$ each represent an oxygen atom, a sulfur atom or —$NR^7$— where $R^7$ represents a hydrogen atom, an alkyl group, an aryl group or a hydroxyl group; $X^3$ represents a hydroxy group or a mercapto group; Y represents an oxygen atom or a sulfur atom; $R^3$, $R^4$, $R^5$ and $R^6$ each represent a hydrogen atom, a halogen atom, a cyano group; or an alkyl group, an aryl group, a cycloalkyl group or a heterocyclic group each of which is bonded directly or through a divalent linking group to the carbon atom, at least one of the combinations of $R^3$ and $R^4$, and $R^5$ and $R^6$ may be linked together to form a 5- or 6-membered ring together with the carbon atom bonded thereto; $Z^0$ represents a compound coordinatable with M or a residue thereof,

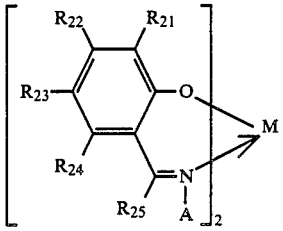

(IV)

wherein $R_{21}$, $R_{22}$, $R_{23}$ and $R_{24}$ each represent a hydrogen atom, a halogen atom, a hydroxy group, a cyano group; or an alkyl group, an aryl group, a cycloalkyl group or a heterocyclic group each of which is bonded directly or indirectly through a divalent linking group to the carbon atom on the benzene ring, and $R_{21}$ and $R_{22}$, $R_{22}$ and $R_{23}$ or $R_{23}$ and $R_{24}$ may be bonded together to form a 6-membered ring; $R_{25}$ represents a hydrogen atom, an alkyl group or an aryl group; A represents a hydrogen atom, an alkyl group, an aryl group or a hydroxy group; and M represents a nickel atom.

2. The light-sensitive silver halide photographic material according to claim 1, wherein said metal complexes have a quenching constant of singlet oxygen of $1\times10^8 M^{-1}.sec^{-1}$ or higher.

3. The light-sensitive silver halide photographic material according to claim 1, wherein said metal complexes are used in a coated amount of from about 20 mg/m$^2$ to 500 mg/m$^2$.

4. The light-sensitive silver halide photographic material according to claim 3, wherein said metal complexes are used in a coated amount of from 50 mg/m$^2$ to 300 mg/m$^2$.

5. The light-sensitive silver halide photographic material according to claim 1, wherein said oil-soluble dye is an organic dye having a solubility of $1\times10^{-2}$ g/100 g water in water at 20° C.

6. The light-sensitive silver halide photographic material according to claim 1, wherein said oil-soluble dye has a molecular extinction coefficient of the maximum absorption wavelength of 5,000 or higher at the wavelength of 400 nm or longer in chloroform.

7. The light-sensitive silver halide photographic material according to claim 1, wherein said oil-soluble dye is used in a coated amount of 0.01 mg/m$^2$ to 10 mg/m$^2$.

8. The light-sensitive silver halide photographic material according to claim 1, wherein said oil-soluble dyes are anthoraquinone type compounds and azo type compounds.

9. The light-sensitive silver halide photographic material according to claim 8, wherein said oil-soluble dyes are compounds represented by the formula (VI) or (VII) shown below:

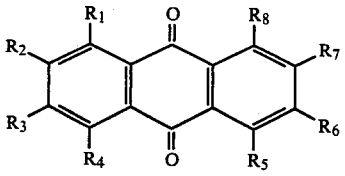

(VI)

wherein $R_1$ to $R_8$ each represent a hydrogen atom, a hydroxy group, an amino group or a halogen atom,

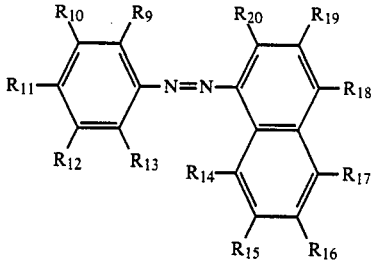

(VII)

wherein $R_9$ to $R_{20}$ each represent a hydrogen atom, a halogen atom, a nitro group, a hydroxy group, an alkyl group, an alkoxy group, an aminocarbonyl group, an amino group or an —N=N—R group where R is an aryl group.

10. The light-sensitive silver halide photographic material according to claim 9, wherein said light-sensitive silver halide photographic material further comprises at least one of the magenta couplers represented by the formula (I) shown below:

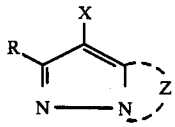

(I)

wherein Z represents a group of non-metal atoms necessary for formation of a nitrogen-containing heterocyclic ring, and the ring formed by said Z may have substituents; X represents a hydrogen atom or a substituent eliminable through the reaction with the oxidized product of a color developing agent; and R represents a hydrogen atom or a substituent.

11. The light-sensitive silver halide photographic material acording to claim 10, wherein said coupler is used in an amount of from $1\times10^{-3}$ mole per 1 mole of silver halide.

* * * * *